US010730684B2

(12) United States Patent
Mitchell et al.

(10) Patent No.: US 10,730,684 B2
(45) **Date of Patent: *Aug. 4, 2020**

(54) SOFT-SIDED INSULATED CONTAINER WITH LID FITTING

(71) Applicant: California Innovations Inc., Toronto (CA)

(72) Inventors: Elizabeth Mitchell, Toronto (CA); Mike Baatz, Laval (CA); William Kearns, Brampton (CA); Christopher Edwards, Nepean (CA); Melvin Mogil, North York (CA); Richard Stephens, Chicago, IL (US); Alexander Barattin, Toronto (CA); Jingchao Wu, Milton (CA)

(73) Assignee: CALIFORNIA INNOVATIONS INC. (CA)

( * ) Notice: Subject to any disclaimer, the term of this patent is extended or adjusted under 35 U.S.C. 154(b) by 0 days.

This patent is subject to a terminal disclaimer.

(21) Appl. No.: 16/201,628

(22) Filed: Nov. 27, 2018

(65) Prior Publication Data

US 2019/0193918 A1 Jun. 27, 2019

Related U.S. Application Data

(63) Continuation-in-part of application No. 15/804,795, filed on Nov. 6, 2017, now Pat. No. 10,138,048, (Continued)

(51) Int. Cl.
*B65D 81/38* (2006.01)
*A45C 11/20* (2006.01)
(Continued)

(52) U.S. Cl.
CPC ..... *B65D 81/3888* (2013.01); *A45C 7/0077* (2013.01); *A45C 9/00* (2013.01); *A45C 11/20* (2013.01); *A45F 3/02* (2013.01); *B65D 43/16* (2013.01); *B65D 43/22* (2013.01); *B65D 81/3818* (2013.01); *B65D 81/3823* (2013.01); (Continued)

(58) Field of Classification Search
CPC ..... B65B 63/08; B65B 1/04; B65D 81/38; B65D 81/3888; B65D 81/3813; B65D 45/00; B65D 25/14; B65D 25/28; B65D 43/16; B65D 43/22; A45F 3/02; (Continued)

(56) References Cited

U.S. PATENT DOCUMENTS 294,622 A 3/1884 Honinger
3,791,547 A 2/1974 Branscum
(Continued)

FOREIGN PATENT DOCUMENTS

CA 2149491 11/1996

*Primary Examiner* — Elizabeth J Volz
(74) *Attorney, Agent, or Firm* — Ostrolenk Faber LLP

(57) ABSTRACT

A soft-sided insulated container assembly has a generally box-shaped form. The lid of the box defines a work surface on which to place objects such as foodstuffs and beverages. The work surface may be formed in a substantially rigid molded stiffener member, and may be divided into sub-regions with raised retainers to discourage sliding of objects where not precisely level. It may have an upstanding peripheral retainer. The work surface may be sunken relative to the periphery of the lid assembly.

20 Claims, 37 Drawing Sheets

Related U.S. Application Data which is a continuation of application No. 14/955,790, filed on Dec. 1, 2015, now Pat. No. 9,809,376, which is a continuation-in-part of application No. 14/793,063, filed on Jul. 7, 2015, now Pat. No. 10,287,055, and a continuation-in-part of application No. 14/312,108, filed on Jun. 23, 2014, now Pat. No. 9,422,099, which is a continuation of application No. 13/532,182, filed on Jun. 25, 2012, now Pat. No. 8,777,045.

(51) Int. Cl.

| | |
|---|---|
| ***A45F 3/02*** | (2006.01) |
| ***A45C 7/00*** | (2006.01) |
| ***B65D 43/16*** | (2006.01) |
| ***A45C 9/00*** | (2006.01) |
| ***B65D 43/22*** | (2006.01) |
| *B65D 25/14* | (2006.01) |
| *B65D 45/00* | (2006.01) |
| *B65B 1/04* | (2006.01) |
| *B65D 25/28* | (2006.01) |
| *B65B 63/08* | (2006.01) |

(52) U.S. Cl.

CPC ..... *A45C 2200/20* (2013.01); *B65B 1/04* (2013.01); *B65B 63/08* (2013.01); *B65D 25/14* (2013.01); *B65D 25/28* (2013.01); *B65D 45/00* (2013.01); *B65D 81/38* (2013.01); *B65D 81/3813* (2013.01)

(58) Field of Classification Search

CPC ..... A45C 7/0077; A45C 11/20; A45C 9/00; A45C 2200/20

USPC ..... 220/6, 254.3, 315, 521, 523, 592.02, 220/592.03, 592.2, 666, 720, 752; 53/446, 467; 383/2, 110, 119

See application file for complete search history.

(56) References Cited

U.S. PATENT DOCUMENTS

| | | | | |
|---|---|---|---|---|
| 4,286,440 | A | 9/1981 | Taylor | |
| 4,323,180 | A | 4/1982 | Sloop | |
| 4,499,998 | A | 2/1985 | Carlson | |
| 4,537,313 | A | 8/1985 | Workman | |
| 4,673,117 | A | 6/1987 | Calton | |
| 4,819,793 | A | 4/1989 | Willard | |
| 4,889,257 | A | 12/1989 | Stellae | |
| D328,550 | S | 8/1992 | Mogil | |
| 5,156,291 | A | 10/1992 | Mielke | |
| D340,387 | S | 10/1993 | Melk | |
| D340,621 | S | 10/1993 | Melk | |
| D340,840 | S | 11/1993 | Melk | |
| 5,337,911 | A | 8/1994 | Holub | |
| D355,568 | S | 2/1995 | Paulin | |
| 5,403,095 | A | 4/1995 | Melk | |
| 5,501,338 | A | 3/1996 | Preston | |
| D368,387 | S | 4/1996 | Bureau | |
| 5,505,307 | A | 4/1996 | Shink | |
| D371,052 | S | 6/1996 | Melk | |
| 5,537,911 | A | 7/1996 | Ohlrogge | |
| D373,514 | S | 9/1996 | Melk | |
| D373,515 | S | 9/1996 | Melk | |
| 5,649,658 | A | 7/1997 | Hoffman | |
| D382,771 | S | 8/1997 | Mogil | |
| D382,772 | S | 8/1997 | Mogil | |
| D387,249 | S | 12/1997 | Mogil | |
| D391,121 | S | 2/1998 | Melk | |
| D394,552 | S | 5/1998 | Melk | |
| 5,857,778 | A | 1/1999 | Ells | |
| D408,225 | S | 4/1999 | Hodosh | |
| 5,904,230 | A | 5/1999 | Peterson | |
| 5,924,303 | A | 7/1999 | Hodosh | |
| 5,938,646 | A | 8/1999 | Carter | |
| D419,770 | S | 2/2000 | Mogil | |
| D421,366 | S | 3/2000 | Mogil | |
| 6,047,976 | A | 4/2000 | Wang | |
| 6,067,816 | A | 5/2000 | Hodosh | |
| 6,068,402 | A | 5/2000 | Freese | |
| 6,092,661 | A | 7/2000 | Mogil | |
| 6,105,844 | A | 8/2000 | Walters | |
| 6,116,045 | A | 9/2000 | Hodosh | |
| D435,342 | S | 12/2000 | Mogil | |
| D435,968 | S | 1/2001 | Mogil | |
| D436,442 | S | 1/2001 | Mogil | |
| 6,234,677 | B1 | 5/2001 | Mogil | |
| 6,237,776 | B1 | 5/2001 | Mogil | |
| 6,238,091 | B1 | 5/2001 | Mogil | |
| 6,247,328 | B1 | 6/2001 | Mogil | |
| D445,307 | S | 7/2001 | Fickle | |
| D446,937 | S | 8/2001 | Mogil | |
| 6,296,165 | B1 | 10/2001 | Mears | |
| D452,075 | S | 12/2001 | Mogil | |
| 6,336,342 | B1 | 1/2002 | Zeddies | |
| D453,625 | S | 2/2002 | Mogil | |
| 6,363,739 | B1 | 4/2002 | Hodosh | |
| 6,439,389 | B1 | 8/2002 | Mogil | |
| 6,481,239 | B2 | 11/2002 | Hodosh | |
| 6,513,661 | B1 | 2/2003 | Mogil | |
| 6,582,124 | B2 | 6/2003 | Mogil | |
| 6,644,063 | B2 | 11/2003 | Mogil | |
| 6,821,019 | B2 | 11/2004 | Mogil | |
| 7,162,890 | B2 | 1/2007 | Mogil | |
| 7,669,436 | B2 | 3/2010 | Mogil | |
| 8,777,045 | B2 | 7/2014 | Mitchell | |
| 9,422,099 | B2 * | 8/2016 | Mitchell | A45C 11/20 |
| 9,809,376 | B2 * | 11/2017 | Mitchell | A45C 7/0077 |
| 9,868,583 | B2 | 1/2018 | Mitchell | |
| 2001/0010312 | A1 | 8/2001 | Mogil | |
| 2001/0039807 | A1 | 11/2001 | Mogil | |
| 2002/0043076 | A1 | 4/2002 | Hodosh | |
| 2002/0126920 | A1 | 9/2002 | Mogil | |
| 2003/0024960 | A1 | 2/2003 | Greenstein | |
| 2003/0198408 | A1 | 10/2003 | Mogil | |
| 2004/0035143 | A1 | 2/2004 | Mogil | |
| 2004/0074936 | A1 | 4/2004 | McDonald | |
| 2004/0136621 | A1 | 7/2004 | Mogil | |
| 2005/0103044 | A1 | 5/2005 | Mogil | |
| 2005/0117817 | A1 | 6/2005 | Mogil | |
| 2005/0205459 | A1 | 9/2005 | Mogil | |
| 2005/0263527 | A1 | 12/2005 | Maldonado | |
| 2007/0237432 | A1 | 10/2007 | Mogil | |
| 2008/0245793 | A1 | 10/2008 | Hanson | |
| 2009/0095757 | A1 | 4/2009 | Ramundi | |
| 2010/0089929 | A1 | 4/2010 | Ramundi | |
| 2010/0116830 | A1 | 5/2010 | Mogil | |
| 2010/0282769 | A1 | 11/2010 | Mogil | |
| 2011/0127274 | A1 | 6/2011 | Mogil | |

* cited by examiner

SOFT-SIDED INSULATED CONTAINER WITH LID FITTING

CROSS-REFERENCE TO RELATED APPLICATIONS

This application claims the benefit of the priority as a continuation-in-part of U.S. patent application Ser. No. 15/804,795 (now U.S. Pat. No. 10,138,048), filed Nov. 6, 2017, which was a continuation of U.S. patent application Ser. No. 14/955,790 (now U.S. Pat. No. 9,809,376), filed Dec. 1, 2015, which was a continuation-in-part of U.S. patent application Ser. No. 14/793,063 filed Jul. 7, 2015, and also a continuation-in-part of U.S. patent application Ser. No. 14/312,108 (now U.S. Pat. No. 9,422,099) filed Jun. 23, 2014, which was a continuation claiming the benefit of U.S. patent application Ser. No. 13/532,182 (now U.S. Pat. No. 8,777,045) filed Jun. 25, 2015, the specification and drawings of all of the foregoing being hereby incorporated by reference in their entirety.

FIELD OF THE INVENTION

This invention relates to the field of insulated portable containers.

BACKGROUND OF THE INVENTION

Portable, soft-sided insulated containers may be used to transport articles that may best be served cool, such as beverages or salads, or warm, such as appetizers, hot dogs, and so on. Such containers are also used to carry liquids, whether hot liquids, such as soup containers, coffee or tea, or cold liquids such as beer, soft drinks, or other carbonated beverages, juices and milk. The containers are typically made in a generally cube-like shape, whether of sides are of equal length or not, having a base, four upstanding walls, and a top. The top wall is often a lid which opens to permit articles to be placed in, or retrieved from, the container. In soft-sided coolers, the main closure of the lid has tended to depend on the closing of a zipper, often a zipper running around three sides of a rectangle, with the fourth side being hinged.

It may be that some people would prefer not to have the sometimes cumbersome bother of opening the main closure, particularly if it requires the use of two hands, and if the process is awkward. They may prefer the use of a closure member that can be used with one hand, such as a zipperless closure member. Further, while opening the main closure member to fill the insulated container may be appropriate, and may occur in the kitchen or at another loading location where full access is desired and convenient, it may also be that when the unit is being used, opening the full main closure member may lead to more rapid heat loss (or gain, as may be) than if a smaller, auxiliary, closure member were used.

Furthermore, when an object is removed from the cooler, it may be that it would be convenient to have some place to rest that object temporarily. It may be that one wishes to put down a drink in a glass while reaching for a can of ginger ale or cola to freshen a drink, or to have a place where a lemon or lime can be sliced suitably. For whatever reason, it may be desirable to have a place for resting objects, even if merely to free one's hand to close the cooler. It may also be convenient for that resting place to be adjacent to the easily accessed opening; for that resting place to be firm, such that objects placed upon it may be less prone to wobble or tip, and for that resting place to be washable such that it may be wiped clean with a cloth should drinks or other objects be spilled on it. Further still, it may be convenient for that resting place to be such as may discourage, or limit, the extent to which objects may slide if the surface is not precisely level, as may be the case at a picnic, at a sporting venue, or at the beach.

In the event that the insulated container is a collapsible insulated container that may be collapsed or folded to a collapsed position when not in use, it may be that a rigid working surface, or table top, however it may be called, may be mounted in such a way as not to obstruct movement of the assembly to the folded or collapsed, or storage condition. Alternatively, the rigidity of the work surface may define a frame, or stiffening member, that, when in place, may tend to encourage the assembly to maintain its shape when in use.

It may also, or alternatively, be helpful to have a work surface that may tend to catch spills, and that may discourage items from falling off, or that may

SUMMARY OF THE INVENTION

In an aspect of the invention there is a soft-sided insulated container. It has a soft-sided insulated body that defines an insulated chamber therewithin. It has a lid. The lid has a proximal portion hingedly mounted to a rearward portion of the soft-sided insulated body. The soft-sided proximal portion is non-rigid. The lid has a distal portion most distant from the rearward portion. The distal portion has a rigid fitting extending therealong. The rigid fitting includes at least one rigid socket. The socket has a well protruding inwardly of the lid. The socket has a retainer arrayed about the socket and extending outwardly proud of the lid.

In a feature of that aspect of the invention, the rigid fitting defines a leading edge margin of the distal portion most distant from the rearward portion. In another feature, the rigid fitting has a substantially planar web. The web defines a rigid forward extension of the proximal portion. The well of the socket protrudes inwardly shy of the web and the retainer stands outwardly proud of the web. In another feature, the socket is a first socket, the distal portion has a second socket. The rigid fitting includes a substantially planar medial web extending between the first and second sockets. In another feature, the lid is releasably secured to the soft-sided insulated body by a first closure member. The first closure member is operable to permit the lid to move between an open position and a closed position. The lid has a second closure member defined therein amidst the proximal portion of the lid. In yet another feature, the second closure member is a zipperless closure. In still another feature, the second closure member includes a soft-sided panel hingedly mounted within the proximal portion. In still another feature, the body is collapsible, and the proximal portion is foldable thereover when the body is collapsed. In a further feature, a soft-sided closure member is mounted amidst the proximal portion, and the soft-sided closure member is foldable with the proximal portion. In a still further feature, a soft-sided closure member is mounted amidst the proximal portion, and the soft-sided closure member opens toward the rigid fitting.

In another aspect of the invention there is a soft-sided insulated container. It has a soft-sided insulated body defining an insulated chamber therewithin, and a lid hingedly mounted thereto. The lid is movable between an open position and a closed position relative to the chamber. There is a securement by which releasably to retain the lid in the closed position. The body is movable between a collapsed configuration and an expanded configuration. The lid is hingedly connected to a rearward portion of the body. When the body is in the collapsed configuration, the lid is foldable over the body whereby a distal portion of the lid extends in front of the body. The distal portion of the lid includes a rigid member running along a margin thereof most distant from the rearward portion of the body. The rigid member has at least one retainer defined therein. The retainer includes a rigid well that protrudes inwardly relative to the chamber when the lid is secured in the closed position, and a rim that stands outwardly of the lid.

In a feature of that aspect of the invention, the lid has an inset access panel mounted intermediate the rigid member and the rearward portion. In another feature, the inset access panel is soft-sided and has a zipperless closure. In another feature, the rigid member has two of the retainers, and a medial web extending therebetween. In still another feature, the lid has a proximal portion closest to the rearward portion of the body.

In another aspect there is a soft-sided insulated container. It has a soft-sided insulated body defining an insulated chamber therewithin. It has a lid. The lid has a proximal portion hingedly mounted to a rearward portion of the soft-sided insulated body. The soft-sided proximal portion is non-rigid. The lid has a distal portion most distant from the rearward portion. The distal portion has a rigid fitting extending therealong. The rigid fitting occupies a minority of the lid. In a feature, the rigid fitting includes a drink pocket. In another feature the rigid fitting includes a portion that is co-planar with the lid. A first portion of the drink pocket extends proud of the lid. A second portion of the drink pocket includes a well that extends shy of the lid.

In another aspect of the invention there is a soft-sided insulated container. It has a soft-sided insulated body and a top. The body defines an insulated chamber therewithin. The top defines a first closure member of the container and is hingedly movable relative to the body between an open position and a closed position. The top has a first rigid member. The first rigid member defines a first work surface upon which to rest objects. The container has a second rigid member. The second rigid member is mounted to the body adjacent to the top. The second rigid member is movable between a deployed position and a retracted position. In the deployed position, the second rigid member defining a second work surface upon which to rest objects.

In a feature, the second rigid member is hingedly mounted to the container body. The deployed position is a position in which the second rigid member is horizontal, and the retracted position is a position in which the second rigid member is extends downwardly away from the top. The container includes a movable stay. The stay is movable between a stored position and a deployed position. In the deployed position the stay is positioned to prop up the second rigid member. The body is collapsible, and, when collapsed, the first rigid member of the top lies folds in front of the body, and is secured thereto. The first rigid member of the top has a table-top portion, the table-top portion is surrounded by a peripheral rim extending around the first work surface. In another feature, the second rigid member is a folding shelf. In still another feature, the first rigid member spans the top in at least one of (a) a side-to-side direction. and (b) a front-to-back direction. In a further feature, the top is hingedly attached to the body along an upper rear margin of the body, and the second rigid member is also hingedly connected to the body at the upper rear margin of the body.

In another aspect of the invention, there is a soft-sided insulated container assembly. It has a soft-sided insulated lower portion, and an upper portion co-operable therewith. The soft-sided insulated lower portion has a base and an insulated peripheral wall upstanding from the base. The base and the peripheral wall define an insulated chamber that has a top opening. The upper portion is hingedly mounted to the lower portion. The upper portion defines a first closure member of the insulated chamber, and is movable between a closed position and an open position to govern access thereto. The upper portion has a first rigid member. The first rigid member is externally positioned. The first rigid member defines a first rigid work surface. The first rigid work surface defines a table-top thereof. The first rigid member has a molded web extending in a span-wise direction of the upper portion. The first rigid member has a molded drink pocket formed therein, the molded drink pocket has a well extending inwardly of the web relative to the chamber and a molded rim standing outwardly of the web. The container has a second rigid member mounted to the body. The second rigid member defines a second rigid work surface of the container.

In a feature of that aspect the second rigid work surface is movable between a deployed position, and a retracted position. In another feature, the second rigid member has a drink pocket formed therein. The second rigid member has a web portion. A drink pocket well extends downwardly of the web. A drink pocket rim standing upwardly of the web. The upper portion defines a top panel of the container. The top panel has a breadth and a width. The rigid member has at least one of (a) a breadth less than the breadth of the top panel. and (b) a width that is less than the width of the top. In still another feature the rigid member spans the top panel in one direction. In another feature, the second rigid member is mounted to a front face of the body of the container, and is located lower than the first rigid member when the first closure member is closed. In another feature, the second rigid member has a web portion. The web portion has first and second drink pockets molded therein and a central web extending between the drink pockets and forming a working surface. Each of the first and second drink pockets has a drink pocket well extending downwardly of the web, and a drink pocket rim standing upwardly of the web. In a further feature, the upper portion defines a top panel. The top panel has a front edge and an opposed rear edge at which the top panel is joined to the body, a left hand edge and an opposed right hand edge. The rigid member spans the top panel cross-wise between the left hand and right hand edges. In a further feature, the rear edge of the top panel is hingedly connected to the lower portion of the container, and the externally positioned rigid member has rear a margin spaced forwardly from the rear edge of the top panel. In still another feature, the second rigid member is a foldable table mounted to an upper rearward margin of the body. In still another feature, the peripheral wall of the lower portion has a width and a height. The upper portion defines a top panel hingedly connected to an upper margin of the peripheral wall of the lower portion. The insulated container has a hinge at which the upper portion is connected to the lower portion. The top panel has a proximal portion adjacent to the hinge, and a distal portion distant from the hinge. The distal portion includes the rigid member. The rigid member has a width and length, the width is measured predominantly parallel to the upper margin of the rear wall, and the length is measured cross-wise to the width. The length of the rigid member is one of (a) less than, and (b) equal to, the height of the front wall of the body.

In an aspect of the invention there is a soft-sided insulated container, or container assembly. It has a soft-sided insulated body that defines an insulated chamber therewithin. There is a lid. The lid is hingedly mounted to a rearward portion of the soft-sided insulated body, and is movable between open and closed positions to govern access to the insulated chamber. The lid has a distal portion most distant from the rearward portion. The lid has a rigid fitting. The rigid fitting defines a work surface extending across the distal portion of the lid. The rigid fitting including an inset opening. The inset opening has an access door movable to give access to the chamber. The rigid fitting defining a work surface. The rigid fitting has an upstanding retainer extending outwardly proud of the work surface. The upstanding retainer extends peripherally about at least a portion of the work surface.

In a feature of that aspect, the rigid fitting defines a leading edge margin of the distal portion most distant from the rearward portion. In another feature, the rigid fitting has a substantially planar web, the web has a socket formed therein, the socket defining a well, and the well of the socket protrudes inwardly shy of the web and the retainer stands outwardly proud of the web. In another feature, the socket is a first the socket, the rigid fitting has a second the socket, and the rigid fitting includes a substantially planar medial web extending between the first and second sockets. In another feature, the lid is releasably secured to the soft-sided insulated body by a first closure member, the first closure member is operable to permit the lid to move between an open position and a closed position. In another feature the inset opening is sunken relative to the work surface. In a further feature, the access door of the inset opening is one of (a) flush, and (b) shy, relative to the work surface when closed. In another feature the body is collapsible, and the proximal portion is foldable thereover when the body is collapsed. In an additional feature, the rigid fitting has an upstanding peripheral wall, the wall has an outermost peripheral rim, and the work surface is sunken relative to the outermost peripheral rim. In another feature, the inset opening access door opens toward the work surface.

In another aspect of the invention, there is a soft-sided insulated container. It has a soft-sided insulated body defining an insulated chamber therewithin, and a lid assembly hingedly mounted thereto, the lid assembly is movable between an open position and a closed position relative to the chamber. There is a securement by which releasably to retain the lid assembly in the closed position. The lid assembly is hingedly connected to a rearward portion of the body. The distal portion of the lid assembly includes a rigid member running along a margin thereof most distant from the rearward portion of the body. The rigid member has at least one retainer defined therein, the retainer including a rigid well that protrudes inwardly relative to the chamber when the lid is closed, and a rim that stands outwardly of the lid assembly.

In a feature of that aspect, the lid has an inset opening and an access panel mounted amidst the rigid member, the access panel is movable to open and close the inset opening. In another feature, the inset access panel is a hingedly mounted access door, and the hingedly mounted access door is mounted in a recess in the work surface. In a further feature, the body is movable between a collapsed configuration and an expanded configuration. In still another feature, the lid assembly has a proximal portion closest to the rearward portion of the body. The well of the rigid member includes a work surface. The lid has an inset opening and an access panel mounted amidst the work surface of the rigid member, the access panel is movable to open and closed positions relative to the inset opening. The inset access panel is a hingedly mounted access door, and the hingedly mounted access door is mounted in a recess in the work surface, the access door is one of (a) flush with and (b) shy of, the work surface. The rigid member has an upstanding web that extends away from the work surface, and a peripheral outermost flange distant from the work surface, the outermost flange, the upstanding web and the work surface forming a Z-section. The rigid member has a depression formed therein to define the recess in which to locate the access door. The depression includes a web and a flange formed peripherally about inset opening. The web and flange formed about the inset opening co-operate with the working surface of the rigid member to define a reinforced structural section framing the inset opening. The access panel is hingedly mounted, the access panel opening toward the work surface. In an open position the rim of the rigid member supporting the access door in that open position.

In an aspect of the invention there is a soft-sided insulated container. It has a soft-sided insulated body defining an insulated chamber therewithin. There is a lid. The lid has a proximal portion hingedly mounted to a rearward portion of the soft-sided insulated body. The lid has a distal portion most distant from the rearward portion. The distal portion has a rigid fitting extending therealong. The rigid fitting occupying a majority of the lid. The rigid fitting defining a wipeable work surface. The rigid fitting including a peripheral retaining rim standing upwardly proud of the work surface.

In a feature of that aspect, the rigid fitting includes a drink pocket amidst the work surface. In another feature, the lid assembly includes soft-sided insulated fabric and the rigid member mounted together, and the work surface is sunken relative to the soft-sided insulated fabric.

In another feature, the rigid fitting includes a portion that is co-planar with the lid, a first portion of the drink pocket extends proud of the lid. A second portion of the drink pocket includes a well that extends shy of the lid. In still another feature, the lid assembly has a proximal portion closest to the rearward portion of the body. The well of the rigid member includes a work surface. The lid has an inset opening and and access panel mounted amidst the work surface of the rigid member, the access panel is movable to open and closed positions relative to the inset opening. The inset access panel is a hingedly mounted access door, and the hingedly mounted access door is mounted in a recess in the work surface, the access door is one of (a) flush with and (b) shy of, the work surface. The rigid member has an upstanding web that extends away from the work surface, and a peripheral outermost flange distant from the work surface, the outermost flange, the upstanding web and the work surface forming a Z-section. The rigid member has a depression formed therein to define the recess in which to locate the access door. The depression includes a web and a flange formed peripherally about inset opening. The web and flange formed about the inset opening co-operate with the working surface of the rigid member to define a reinforced structural section framing the inset opening. The access panel is hingedly mounted, the access panel opens toward the work surface. In an open position the rim of the rigid member supporting the access door in that open position.

In another aspect of the invention there is any combination of any of the features of any one of embodiments shown or described herein, in combination with the features of any other embodiment shown or described herein, except to the extent those features are mutually exclusive. In another aspect of the invention, there is any apparatus substantially as shown or described herein, in whole or in part.

BRIEF DESCRIPTION OF THE DRAWINGS

These aspects and other features of the invention can be understood with the aid of the following illustrations of a number of exemplary, and non-limiting, embodiments of the principles of the invention in which.

DETAILED DESCRIPTION

Figure 3A:
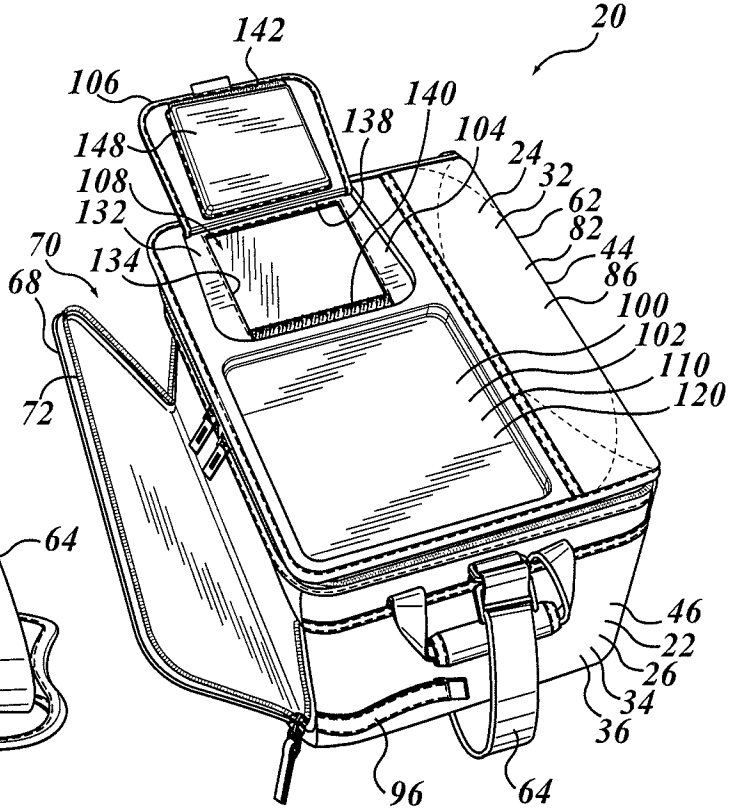
FIG. 3A shows an isometric view of the container assembly of FIG. 1A, showing an auxiliary closure member of the top panel in an open condition, and showing a front auxiliary compartment closure member in an open position.
Figure 3B:
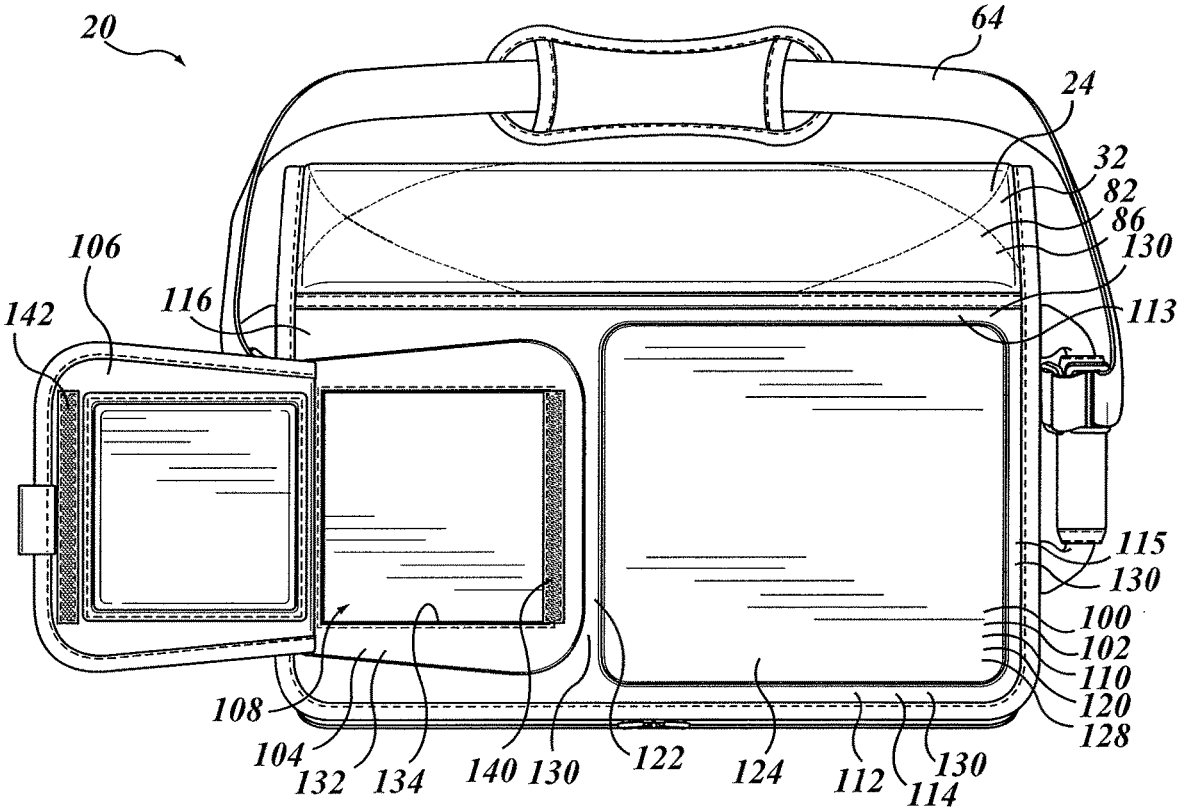
FIG. 3B shows a top view of the container assembly of FIG. 3A from above with its auxiliary closure member in an open position.
Figure 3D:
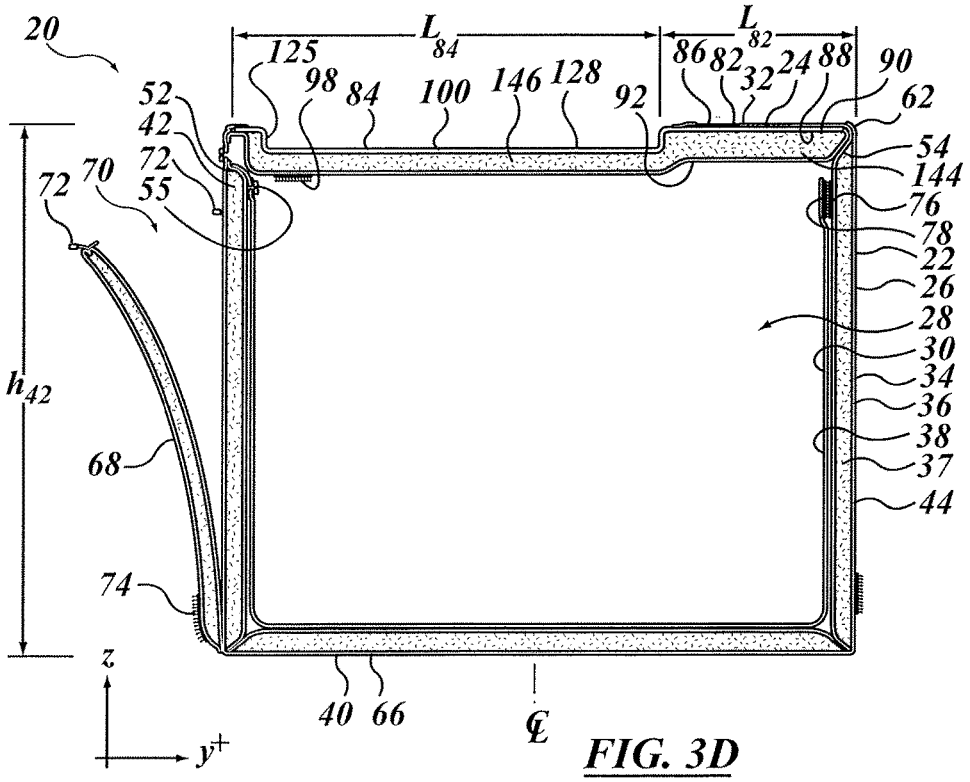
FIG. 3D is a cross-sectional view of the container assembly of FIG. 1A; taken on section '3D-3D' of FIG. 1C.

The description that follows, and the embodiments described therein, are provided by way of illustration of an example, or examples, of particular embodiments of the principles of the present invention. These examples are provided for the purposes of explanation, and not of limitation, of those principles and of the invention. In the description, like parts are marked throughout the specification and the drawings with the same respective reference numerals. The drawings may be understood to be to scale and in proportion unless otherwise noted. FIG. 3D is not drawn to scale for example. The wording used herein is intended to include both singular and plural where such would be understood, and to include synonyms or analogous terminology to the terminology used, and to include equivalents thereof in English or in any language into which this specification many be translated, without being limited to specific words or phrases.

For the purposes of this description, it may be that a Cartesian frame of reference may be employed. In such a frame of reference, the long, or largest, dimension of an object may be considered to extend in the direction of the x-axis, the base of the article, where substantially planar, may be considered to extend in an x-y plane, and the height of the article may be measured in the vertical, or z-direction. When the container assembly is sitting on its bottom panel, the largest predominantly upstanding panels may be designated arbitrarily as the front and rear sides, faces, or portions of the container. Similarly, the closure member, or opening, of the bag is arbitrarily designated as being at the top, and the base panel is designated as being at the bottom, as these terms may be appropriate for the customary orientation in which the objects may usually be found, sold, or employed, notwithstanding that the objects may be picked up and placed on one side or another from time to time at the user's choice. It should also be understood that, within the normal range of temperatures to which human food and human touch is accustomed, although the term cooler, or cooler container, or cooler bag, may be used, such insulated structures may generally also be used to keep food, beverages, or other objects either warm or hot as well as cool, cold, or frozen. Unless noted otherwise, the terms "inside" and "outside", "inwardly" and "outwardly", refer to location or orientation relative to the enclosed spaces of the container assembly, as may be.

In this specification reference is made to insulated containers. The adjective "insulated" is intended to be given its customary and ordinary meaning as understood by persons skilled in the art. It is not intended to encompass single layers, or skins, of conventional webbing materials, such as Nylon™, woven polyester, canvas, cotton, burlap, leather, paper and so on, that are not otherwise indicated as having, or being relied upon to have, particular properties as effective thermal insulators other than in the context of being provided with heat transfer resistant materials or features beyond that of the ordinary sheet materials in and of themselves. In this description, when an item, or structure, or wall, is indicated as being insulated, such term is understood to mean that the wall has a layer of insulation, as distinct from merely being a layer of plastic or canvas, or paper or cardboard, or webbing in and of itself by virtue of its own resistance to heat transfer. For example, an insulated wall may have an outer surface or skin, or covering, which, in the context of soft-sided insulated containers may be a layer of nylon, which may be a woven or textured nylon. The wall may have an inner surface or skin, or covering, such as a vinyl liner or sheet. A layer of insulating material which may typically be a closed-cell or open cell foam, may be captured between the inner and outer skins. This commentary is provided to supplant any dictionary definition, and to prevent interpretation in any Patent Office that strays from the customary and ordinary meaning of the term "insulated" as provided herein.

Similarly, this description may tend to discuss various embodiments of soft-sided containers, as opposed to hard shell containers. In the jargon of the trade, a soft sided cooler, or bag, or container, is one that does not have a substantially rigid, high density exoskeleton (typically a molded shell, e.g., of ABS or polyethylene, or other common types of molded plastic). Rather, as noted, a soft-sided insulated container wall may tend to have, for example, an outer skin, a layer of insulation, and an internal skin, both the internal and external skins being of some kind of webbing, be it a woven fabric, a nylon sheet, or some other membrane. The layer of insulation, which may be a sandwich of various components, is typically a flexible or resilient layer, perhaps of a relatively soft and flexible foam.

A soft-sided container may still be a soft-sided container where, as described herein, it may include one or more substantially rigid internal liners that seat within the soft-sided wall structure, or it may include one or more battens (which may be of a relatively hard plastic) concealed within the soft sided wall structure more generally, or where hard, moulded, fittings may be used whether at a container rim or lip, or to provide a base or a mounting point for wheels, but where the outside of the assembly is predominantly of soft-sided panels. Again, this definition is intended to forestall interpretation by any patent office of the term "soft-sided" in a manner that diverges from the ordinary and customary meaning of the term as understood by persons of ordinary skill in the art in the industry, and as explained herein.

Further, in this description, when an object is indicated as being collapsible, the meaning is of being intentionally collapsible, or foldable, as opposed to being something the will crush if subject to sufficient force. A collapsible container is one that moves between a known, collapsed position, and a known deployed, or expanded, position.

Referring to the Figures, and by way of a general overview, a soft-sided insulated container assembly is indicated generally as 20. Container assembly 20 has a first, or main, portion, or body, 22, and a second part or portion, 24, that co-operates with first portion 22. Typically, the main portion or body 22 has a wall structure, or outer casing, 26 that defines an internal volume, or cavity, receptacle, or chamber, 28, however it may be termed, for receiving objects such as may be desired to be kept cool or warm, a variety of such objects being indicated in FIG. 1A as 'A' and 'B'. Outer casing 26 may be in the nature of a soft-sided, insulated wall structure 34, as described below. Second portion 24 may be, or include, a top wall or top panel that defines a closure member, or lid, 32, movable between open and closed positions to govern access to the interior of main body 22. Lid 32 may define a first main or primary closure member of container assembly. Where it is desired to contain liquids, container assembly 22 may include a liner 30 for use within wall structure 26. To the extent that main body, or portion, 22 includes an internal liner 30, in one embodiment that liner 30 may be made by folding a monolithic plastic sheet, typically a clear plastic vinyl sheet, with the corners folded as shown and described in U.S. Pat. No. 6,582,124 issued Jun. 24, 2003. Liner 30 may have an upper margin, and may be releasably secured at that upper margin by a tracked fastener, or by hook-and-eye fabric strip fasteners, or a combination thereof, such that liner 30 is watertight, and is removable from within wall structure 28, and of container assembly 20 more generally, for example to facilitate washing or replacement thereof.

Outer casing 26 may be made of an insulative material 37 for thermally insulating chamber 28. The insulative material 37 may be located between an outer covering 36 and an inner surface sheet 38. The insulative material inhibits heat transfer between chamber 28 and the surroundings of container assembly 20. This may tend to help to maintain a temperature of items such as food products stored within the receptacle, i.e., chamber 28, whether cooler or warmer, as may be. When lid 32 is in a closed position, heat transfer may be inhibited to a greater extent. Insulative material 37 may additionally be soft, such as a resilient foam, whether closed cell or open cell, so that the container may tend not to damage, or be damaged by, objects with which it may come into contact. If a suitable plastic or other material or stain resistant surface coating or surface treatment is used, then outer casing 26 may also be readily cleaned to remove dirt and other debris acquired through use.

Outer casing 26 may have an insulated bottom panel 40, and insulated wall panels, namely a front panel 42, a rear panel 44, and a pair of left-hand and right-hand end panels, or side panels, 46 and 48. The choice of front and rear, left and right, is arbitrary. However, for the purposes of this description rear panel 44 may be understood as the panel having an upper margin to which lid 24 is attached, and front panel 42 is the panel opposed to rear panel 64 and distant therefrom. Although other embodiments can be made, typically, the front and rear panels may lie predominantly in x-z planes; the end or side panels may lie predominantly in y-z planes, and the bottom panel may lie predominantly, in an x-y plane, the various wall panels co-operating to define five sides of a box, with an internal cavity, or volume, for receiving objects to be kept warm or cool as may be, identified as chamber 28. Each panel 40, 42, 44, 46 and 48 may be located at substantially right angles to two adjacent wall panels. For example, panel 44 is located adjacent panel 46 at one end, and adjacent panel 48 at an opposite end. The bottom panel may be attached to all four panels 42, 44, 46 and 48, along edges thereof. Bottom panel 40 and panels 42, 44, 46 and 48, may typically be rectangular, with respective opposite panels 42 and 44, and 46 and 48. In this configuration, chamber 28 is a generally cube-like. Panels 42, 44, 46 and 48, and bottom panel 40 may be fastened to one another by sewing, gluing or some other suitable fastening means. The front, left hand side and right hand side panels 42, 46 and 48, may be made from a single piece of insulated material. Lid 32, rear panel 44 and bottom panel 40 may also be formed from a single piece of material. For example, rear panel 44 and lid 32 may be formed from a single piece of material having a fold therein, as at hinge 62, to define rear panel 44 and lid 32. It may be noted that lid 32 may thusly be connected to the upper margin of rear panel 44 by a flexible fabric hinge.

In alternative embodiments, outer casing 26 may have either less than four, or more than four, predominantly upright panels (not shown). For example, outer casing 26 may be configured to have one continuous panel defining a round wall, thereby forming a right cylinder, or some other generally rounded shape.

Chamber 28 may have a lip or rim, 50, which may define the main or primary opening 60 through which objects may be introduced into or withdrawn from chamber 28 of container assembly 20. Panels 42, 44, 46 and 48 may each have an upper, or distal, edge or margin 52, 54, 56 and 58, respectively, which in the case of edges or margins 52, 56 and 58 is also a free edge. Margin 54 may be, or may terminate at, a hinge 62, which may be a fabric or web hinge. The four margins 52, 54, 56 and 58 co-operate to define a periphery bounding main container opening 60. Lid 32 is hingedly, or pivotally attached to rear panel margin 54, as indicated at hinge 62, and is movable pivotally about its rearward hinged edge between the closed, or sealed position, and an open, and unsealed, position, thereby governing access the interior of the assembly, namely to chamber 28 and thereby to permit or obstruct the introduction or withdrawal of objects to be received in the container. In the closed position, lid 32 may be secured in place by a tracked closure member, such as the zipper shown in the illustrations. Outer casing 26 may have a lifting member, such as a shoulder strap 64 attached thereto, for example, at side panels 46 and 48.

FIG. 3D, in which thicknesses may have been exaggerated as the purpose of illustration shows the general structure of a cross-section of any of the insulated wall panels, revealing the layers of construction. With the exception of auxiliary pouch 24, this section is typical not only of front panel 42 but also, generally, of rear panel 44, side panels 46 and 48, bottom panel 40. The outer layer, or facing, or covering, 36, of the panel (be it 42, 44, 46 or 48) is an outer skin which in the nature of a nylon, woven nylon, canvas or other covering layer 68, which may tend to be abrasion resistant. It overlays an intermediate thermal insulation medium, such as may be in the nature of closed cell foam insulation layer 37 for impeding, which is to say discouraging, heat transfer between the interior of container assembly 20 and external ambient. The inner face of the insulated wall panel, namely inner surface sheet 38, may be an inner skin which may be in the nature of a flexible sheet, whether of Vinyl™ or of plasticised metallic foil sheeting that is shiny and reflective. The metallic foil sheeting material may be the type sold under the name Therma-Flect™. This same general structural arrangement prevails in bottom panel 40, although outer covering layer 66 may be a rather thicker, scuff-resistant material than the outer skin of the upwardly extending side walls.

Container assembly 20 may include a further, or secondary, wall panel, or wall panel assembly 68 that may be mounted to the front face of front panel 42 to define a secondary enclosure, chamber, pocket, pouch, receptacle or compartment, however it may be named, indicated at 70. Although the embodiment of wall panel assembly 68 shown is insulated, in other embodiments this insulation may be optional. Wall panel assembly may extend across substantially the entire width of front panel 42, or only a portion thereof, and may extend over substantially the full height of wall panel 42, or a lesser portion thereof. Some embodiments of container assembly 20 may not include wall panel assembly 68. Wall panel assembly 68 may include a closure member, and that closure member may include a tracked fastener, such as a zipper, or such other fastening fitting or fittings as may be appropriate, indicated as 72. The lower portion of wall panel assembly 68, or if no such wall panel 68 is used, then the lower portion of front panel 42, may have securement fittings, such as indicated at 74.

To the extent that a liner 30 is employed, it may be a folded vinyl liner, which may be a clear vinyl liner, and liner 30 may be removable and washable. Liner 30 may have the same generally box-shaped form as chamber 28, and may fit therewithin accordingly. The top side of liner 30 is typically open, corresponding to opening 60, and the upper edge or periphery of liner 30 may typically be sewn into a seam. It may have a zipper half 55 sewn along the edges of three sides, those three sides mating with the opposing zipper half of zipper 55 mounted to the three free edges, at respective upper margins 52, 56 and 58, of casing 26. The upper edge, margin 54, of the rear wall of liner 30 may include a hook-and-eye fabric fastening strip (e.g., Velcro™ as at 76 for mating with a corresponding hook-and-eye fabric fastening strip 78 mounted to the upper margin of the inside face of rear panel 44.

Turning now to the top panel of container assembly 20, namely that panel defining lid 32, as noted it is movable between first and second positions, one position being relatively more obstructive of opening 60 than the other. The top panel, or lid, 32 may be sized generally to fit opening 60. That is, to the extent that opening 60 can be said to have a shape and size, which may be taken as a projection in the z-direction such as may give a footprint of that opening, lid 32 may have a corresponding shape and size or footprint. In some embodiments the footprint of opening 60, and lid 32, may correspond also to the footprint of bottom panel 40.

Lid 32 may have a first portion, 82, and a second portion 84. Taking the juncture of hinge 62 at the upper margin 54 of rear panel 44 as a reference datum, first portion 82 may be referred to as a proximal portion, and second portion 84 may be referred to as a distal portion. From outside to inside, proximal portion 82 may include an outer surface layer 86, a flexible reinforcement or batten 88, a layer of insulation, 90, and an inner surface layer 92. Outer surface layer 86 may be a flexible fabric web, or plastic sheet, which may be a woven fabric. The flexible reinforcement, 88, which may be employed in some embodiments, may tend to function to protect the layer of insulation, and also to function as a spring. Flexible reinforcement 88, when used, may be placed either inside or outside layer of insulation 90 and functions to provide a higher resistance to bending than merely insulation layer 90 by itself, such that first portion 82 is more resistant to bending than the soft-sided wall structure generally, and may tend to form a curve, or curl, rather than a crease, when bent. It may be noted that while reinforcement 88 is soft, or springy, or complaint, in bending out-of-plane, namely-out-of-the-x-y plane, (as when lid 32 is folded about the other panels in the collapsed and secured configuration shown in FIGS. 2A, 2B, 2C, 2H and 2I, reinforcement 88 is relatively stiff in resisting in-plane (i.e., in the x-y plane) shear in the x-direction (i.e., as when a shear force in the −x direction is placed upon the proximal margin of reinforcement 88 at hinge 62, and a reaction shear force in the +x direction is placed upon the corresponding distal margin of reinforcement 88).

In some embodiments container assembly 20 may be collapsible. That is, in those embodiments container assembly 20 is movable between a first position, which may be identified as the expanded or deployed condition or position shown in the first series of FIGS. 1A to 1H and a second position, which may be identified as a collapsed or retracted or folded, or storage position, whatever terminology may be used, as shown in the second series of FIGS. 2A-2I. Those first and second positions are pre-determined, deliberate, repeatable configurations of container assembly 20. Container assembly 20 may include securements, or securement fittings 94, which may be hook-and-eye fabric strips, that are engaged by mating fasteners such as found at the end of retaining straps 96, whereby the container assembly 20 is secured in the collapsed position or condition. The distal margin of lid 32 may similarly have lid underside securement fittings 98 for engagement in the collapsed position with securement fittings 74. It may be noted that in the folded position front panel 42 maintains, or substantially maintains, a generally planar and parallel orientation relative to rear panel 44 (keeping in mind the general flexibility of the structure, the extent to which the panels are either planar or precisely parallel is approximate). In collapsing, however, side panels 46 and 48, and bottom panel 40, fold as seen in FIGS. 2A, 2B, 2C, 2G and 2I. As folded, the spacing of the front face of front panel 42 from the front face of rear panel 44 is then a function of the double-folded thickness of the side panels 46, 48 plus the thickness of front panel 42.

In the expanded or deployed position, container assembly may be in its accustomed form of a generally cube-like squarish or rectangular box. In this position or condition, lid 32 pivots between open and closed positions on hinge 62, and may have a generally flat condition. By contrast, in the collapsed or folded position the distance in the y-direction from the front face of rear panel 44 to the front face of front panel 42 is non-trivial. However, in this condition proximal portion 82 functions, in effect, as a large extended hinge that curves or curls over or reaches about, the other elements of container assembly 20, the reach of proximal portion 82 being sufficient to permit distal portion 84 to seat against, front panel 42, and to be secured thereto by the engagement of lid underside securement fittings 98 with securement fittings 74.

Second portion 84 may define or include a substantially rigid member 100, having a work surface. That work surface may be referred to for convenience as a table top, 110. In some embodiments, second portion 84 (and hence table top 110), may amount to all, or nearly all, of lid 32 from hinge 62 to the most distant extremity of lid 32 (that is, there may be little or no "first portion"). Alternatively, the relative proportions of first portion 82 to second portion 84, in terms of respective lengths in the x-direction, $L_{82}$ and $L_{84}$, may be in the range of $0<L_{82}/L_{84}<1/2$, and perhaps $1/5<L_{82}/L_{84}<2/5$, and perhaps more narrowly, $1/4<L_{82}/L_{84}<1/5$, it being understood that the length of lid 32 in the y-direction may generally be the sum of $L_{82}$ and $L_{84}$.

Figure 1A:
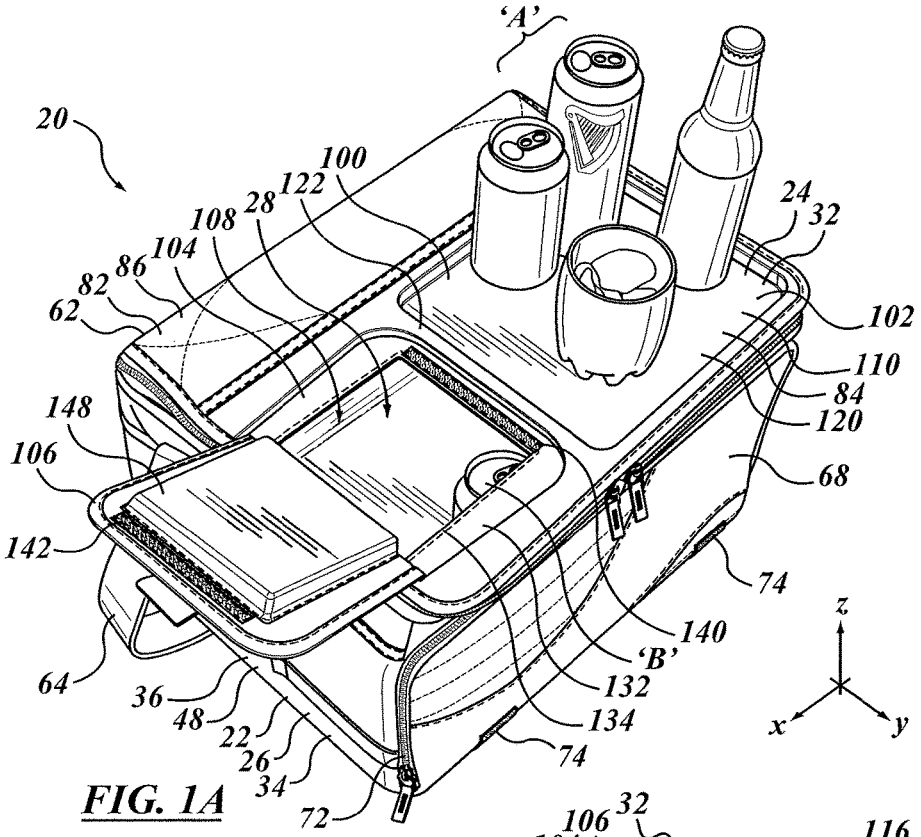
FIG. 1A shows a perspective view taken from in front, above, and to the right, of an embodiment of a soft-sided container assembly according to an aspect of the present invention, the assembly being shown in an expanded condition and with its auxiliary closure member open.

Similarly, in some embodiments, as in the collapsible embodiment noted above, main body 22 may have a height in the z-direction, that height being the distance from the bottom surface of bottom panel 40 to rim 50, and being substantially the same (if not identical to) the z-direction extent of front panel 42, such that it may be identified as $h_{42}$. In the embodiment of FIG. 1A, the length of second portion 84 may be less than or equal to the height of front panel 42, that is, $L_{82}<h_{42}$, such that in the collapsed condition second portion 84 may lie against, or generally adjacent to, from panel 44 in a compact, folded position, without interfering with or obstructing, the ability of body 22 more generally to be folded.

Second portion 84 may include a first region, 102, and a second region 104. First region 102 may include table top 110. Second region 104 may include a second, or secondary, or auxiliary, or alternate, closure member (or closure member assembly) 106 that provides access to chamber 28 through a second, or secondary, opening 108.

Substantially rigid member 100 is, or underlies, or defines first region 102, including table top 110. In some embodiments it may be that substantially rigid member 100 is of such an extent that a portion thereof also underlies, or extends about, or defines, second region 104, although this need not necessarily be so. In some embodiment the auxiliary closure member need not necessarily be reinforced with a rigid member, but may be formed in a soft-sided, unreinforced wall panel structure, instead.

Member 100 may have a generally rectangular periphery 112, which lies, generally in a first x-y plane $P_{112}$. Periphery 112 may include a rearward, or proximal, margin 113 closest to hinge 62, and adjoining first portion 82 of lid 32; and a distal margin 114 opposite thereto most distant from hinge 62. Margins 113 and 114 may run generally parallel to hinge 62 in the x-direction. Periphery 112 may also include a left hand margin 115 and a right hand margin 116, those left and right hand margins being space apart and opposed. When the cooler is expanded and lid 32 is closes, margins 115 and 116 may run in the y-direction.

It may be that margin 113 adjoins first portion 82, or, in embodiments in which there is no first portion 82, then adjoining hinge 62. It may also be that margin 114 extends along the distal-most edge of lid 32 farthest from hinge 62 such that member extends the full length of second portion 84 in the radial direction relative to hinge 62, which may also be expressed as the full length of second portion 84 in the y-direction when lid 32 is closed. In such instance, when lid 32 is closed, and the main closure securement, be it a zipper or other tracked fastener is in place in a mating, closed, configuration, margin 114 may be adjacent to, and to run along part or all of, upper margin 52 of front panel 42.

Similarly, when lid 32 is closed, it may be that left hand margin 115 runs along the left-most edge of lid 32, and, for part or all of its run in the y-direction it may run along upper margin 56 of left hand end panel 46, and right hand margin 116 may run along the right-most edge of lid 32, and, for part or all of its run in the y-direction it may run along upper margin 58 or right hand end panel 48. Where margins 115 and 116 run along the left-most and right-most margins of lid, then member 100 spans the full width of lid 32, or, expressed differently, member 100 extends the full length of lid 32 in the x-direction.

Where the margins of member 100 run along the edges of lid 32, overlying the upper margins of panels 42, 46 and 48, to such extent as may be, member 100 may tend locally to stiffen those upper margins and fix their position. Where the margins of member 100 run along any two of them, or are mated to the distal margin of reinforcement member 88, reinforcement member 100 may tend to stabilize that upper margin, to stabilize the relative positions of the upper margins so linked, and to function as a substantially rigid shear panel between those wall panels, thereby tending to maintain (if not to establish) the side wall panels in rectangular relation relative to each other, and to maintain the generally rectangular plan form of container assembly 20 in the expanded position more generally. When viewed on a projection in the z-direction, (with lid 32 closed on rim 50), member 100 may have the same, or substantially the same, extent, or footprint, as second portion 84, e.g., in the lengthwise and widthwise directions. In other embodiments, table top 100 may be smaller than second portion 84.

Periphery 112 may have a profiled of recessed leg or toe 118 at the outermost extremity. The downward step or recess, indicated at 108, may be such that it provides a seat for fabric materials that may be sewn or otherwise fastened to it, whereby the fabric may be flush.

Substantially rigid member 100 presents a work surface 120 upon which objects, such as a can, a bottle, or a glass, cup, or tumbler, may be placed. Work surface 112 is oriented to face away from chamber 28, and may present a cutting board surface upon which an apple, a lemon or a lime (or other fruit, or vegetable, or cheese), or a sandwich may be sliced. It may be made of, or surfaced with, any suitable rigid material, even such materials as wood, metal or ceramic. It may most typically be made of a formed plastic member, such as may be made from a high density plastic such as polyurethane sheet, nylon sheet, UHMW plastics, and so on. The sheet stock from which table top 100 is moulded or formed may have a nominal thickness in the range of perhaps 1/32" to 1/8", but may typically be if the order of 1/16" to 3/32" thick.

Considering the embodiment illustrated in FIGS. 4A to 4D, first region 102 and second region 104 lie to either side of an intermediate member 122, which, in the embodiment shown, runs in the y-direction across member 100 between margin 113 and margin 114.

First region 102 has a depressed central portion, or central web 124 that is surrounded at its various edges by margins 113, 114, 115 and intermediate member 122. Central portion or web 124 may be substantially flat and planar, and may lie in a plane $P_{124}$ that is substantially parallel to, and offset from, plane $P_{112}$. In each case depressed central portion 124 is adjoined by a web or wall 126 that stands predominantly in the z-direction joining central portion or web 124 to margins 113, 114, 115 and member 122, whereby the effect is to define flanges 130 around a flat central portion. The upper, or outwardly facing surface 128 of central web 124 defines the work surface of the table top, or it may be faced with a surface member or surface treatment, as may be appropriate, e.g., such as form making a cutting-board surface, or for having a no-slip roughened surface to discourage sliding. The peripheral flange also defined a retainer, or peripheral wall, that may tend to discourage the sliding of objects there-off in the event that cooler assembly 20 is placed on a surface that it not precisely level, and the may tend to some extent to retain spills until they can be cleaned up.

It is not necessary that table top 120 defined by surface 128 be square or rectangular. It could, for example, be circular, or elliptic, or oblong, as may be. A square or rectangular surface of substantial area may be desirable, where the maximum y-direction width corresponds to $h_{42}$, or roughly so. The x-direction extent may be comparable, and in some embodiments may be greater, even to the extent of the x-dimension length of lid 32.

Second region 104 may also have a depressed portion 132, which itself may be substantially planar in an x-y plane $P_{132}$ offset from plane $P_{112}$ by some distance in the z-direction. This offset distance may be less than, equal to or greater than the offset distance of plane $P_{124}$ from plane $P_{112}$. Depressed portion 132 is surrounded by part or all of margins 113, 114, 116 and intermediate member 122, such that, again, the effect is to form a continuous, flanged periphery. (In the embodiment illustrated, member 122 effectively becomes a channel-section or rib defining a divider between regions 102 and 104). Web 132 has a central cut-out, or opening 134. In plan-view, the profile of web 132 may be square, or rectangular, as may be, or may have the shape shown, in which one side (at the staff) is straight and relatively short, and the distant (or distaff) side is relatively longer, with the remaining two edges following a widening or splaying shape, so that the overall outline is that of a trapezoid, with two sharp corners and two corners formed on relatively large radii. As assembled, a closure member 136 is mounted with a fixed edge along one side (the short side), defining a hinge 138. Closure member may have the form of a flap movable between open and closed positions to govern access to chamber 28 through opening 108. A zipperless securement, such as mating hook-and-eye fabric fastening strips 140, 142 may be provided to permit the user to operate closure member 136 with one hand. Although it is not necessary, it may be convenient for the distaff (or distal) edge of closure member 106 to be oriented toward, or amidst, table top 120, such that when closure member 106 is open, the flap hangs over the outboard edge of lid 32, tending thereby not to impede the convenient removal of objects from chamber 28, and the placement of those objects, without obstruction, on table top 120. In some embodiments, the underside, or inside, of first portion 82 of lid 32 may be lined with an insulating layer 144, and the inner skin of layer 144 may be a reflective skin. Similarly, the underside of portion 84 may have an insulation layer 146, which may have a reflective inner skin. The underside of the flap of auxiliary closure member 106 may likewise have an insulation layer, or blanket, as at 148.

In the embodiment of FIGS. 1A to 1H, the first and second regions of distal portion 84 are located side-by-side in a left-hand and right-hand orientation, with the opening of auxiliary closure member 106 facing toward table top 110. Alternate embodiments are possible. For example, closure member 106 could face the front of the unit, i.e., toward margin 114, or such other direction as may be appropriate. The arrangement need not be left-hand-right hand. For example, in the embodiment of FIGS. 5A-5D, soft-sided insulated container assembly 150 has a top wall defining a lid portion, or lid, 152 that includes a rigid member 154 that is substantially co-extensive with lid portion 152 (and of the footprint of the base of assembly 150 more generally. Rigid member 154 may include a first portion 156 defining a work surface, or table top, 158, and a second portion 160 that defines a zipperless auxiliary closure member 162. Closure member 162 has an hinged margin 164 that is located adjacent to the hinged margin 166 of lid portion 152 more generally. Closure member 162 opens toward table top 158, i.e., toward the center or centroid thereof, but in this instance is mounted along the rear margin of lid 152, and is in an intermediate position in the left-to-right width direction. That position may be on the centerline of the unit. Rigid member 154 may be a moulding of relatively deep section, and may include peripheral retaining features such as a continuous peripheral lip 168 or raised corners 170, or both. As seen most clearly in FIG. 5C, working surface 172 of table top portion, or work surface, 158 is a textured surface with non-slip features.

Figure 3C:
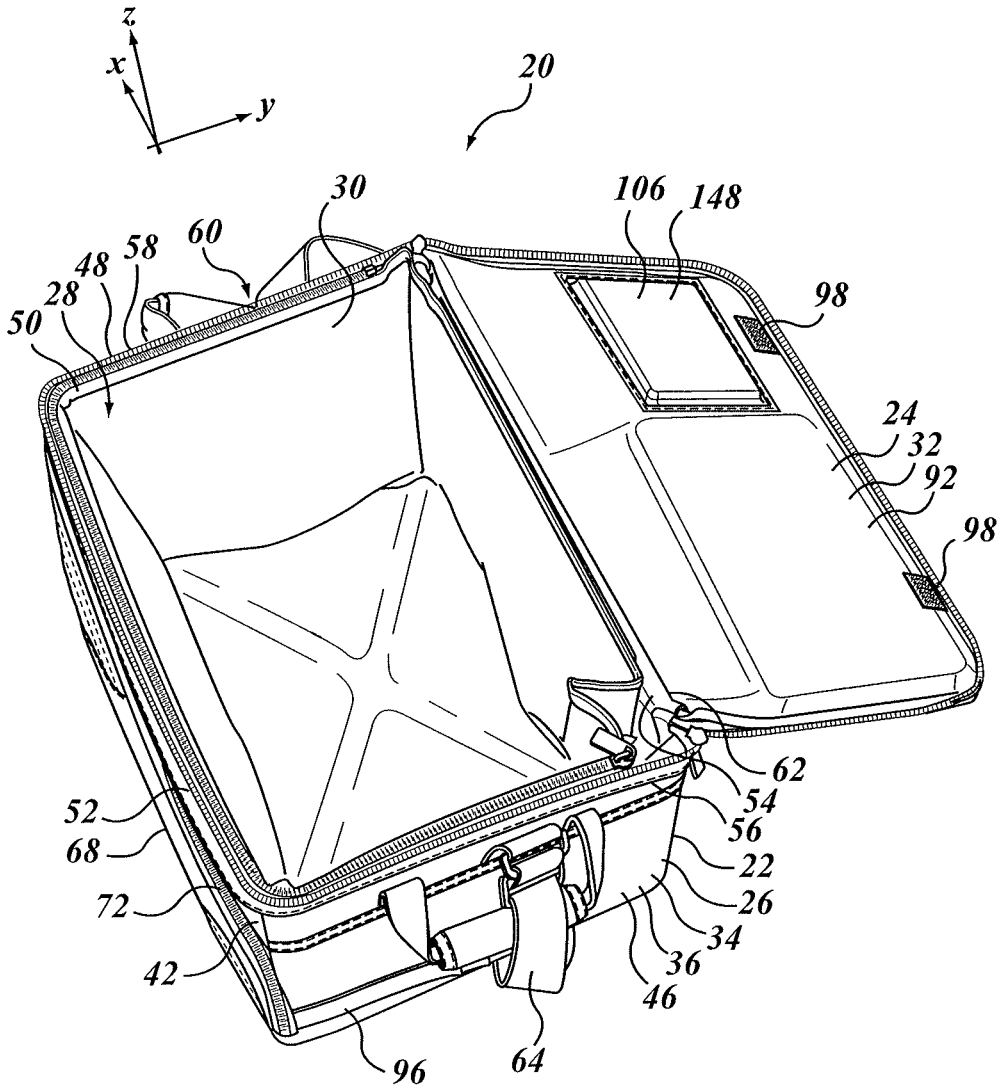
FIG. 3C shows the container assembly of FIG. 3A from above and to the left with the main closure member thereof in a fully open condition.
Figure 4A:
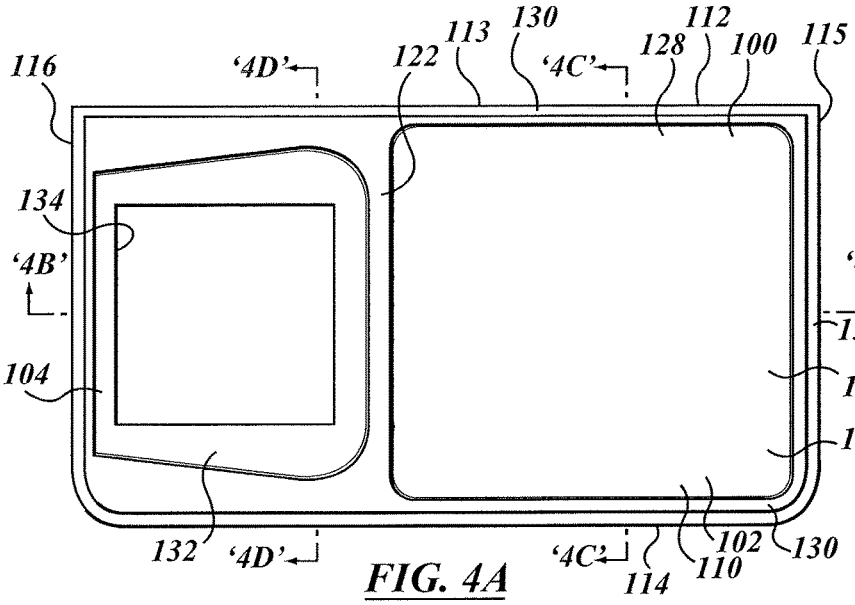
FIG. 4A is a top view of a substantially rigid member of the container of FIG. 1A.
Figure 4C:
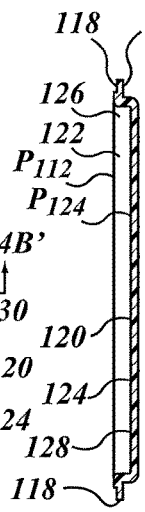
FIG. 4C is a view on a lengthwise cross-section of the member of FIG. 4A taken on section '4C-4C'.
Figure 4D:
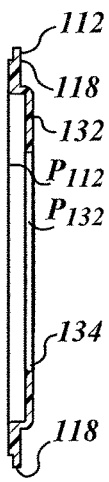
FIG. 4D is a view on a lengthwise cross-section of the member of FIG. 4A taken on section '4D-4D'.
Figure 4B:
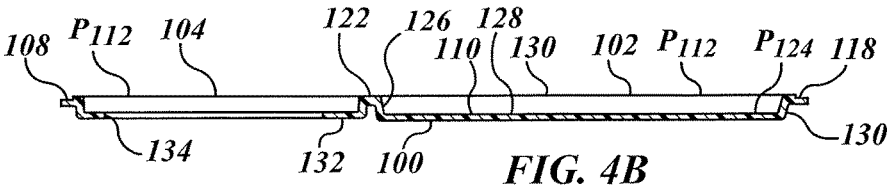
FIG. 4B is a view on a lengthwise cross-section of the member of FIG. 4A taken on section 4B-4B'.

As shown in the illustrations, the work surface 158 of lid 152 may span the entire width of the surface in the x-direction, and may also span the entire depth of the surface from the rear edge to the front edge in the y-direction (when the assembly is in the expanded condition). As above, it may also form a rigid frame to maintain the general box shape of the assembly when deployed. In this configuration, the lower margin of formed rigid member 154 may have a securement, such as a tracked fastener 155 (e.g., a zipper) by which it is joined to the lower portion, or body, 153 of assembly 150 more generally when the assembly is in the expanded position and lid 152 is in the closed position relative thereto. When tracked fastener 155 is released, lid 152 may be moved to an open position, analogous to that shown in for assembly 20 in FIG. 3C, thereby permitting, for example, loading of container assembly 152 generally.

When assembly 150 is moved to the collapsed position or condition, an internal flexible hinge, or web member, 174, which may be made of Nylon™ or other cloth, or of an elasticized, or somewhat elasticized, or "stretchy", material, in whole or in part, permits the rear margin of lid 152 to separate from the upper margin of the rear wall of body 153, the extended length of member 174 permitting lid 152 to be folded over the front of the unit as collapsed, with member 174 being curved over the collapsed sidewalls in a manner similar to the curvature of portion 82 of assembly 20 in the collapsed condition. When assembly 150 is in the expanded position, member 174 hangs inside the main internal enclosure of assembly 150, analogous to chamber 28 of assembly 20.

Figure 5A:
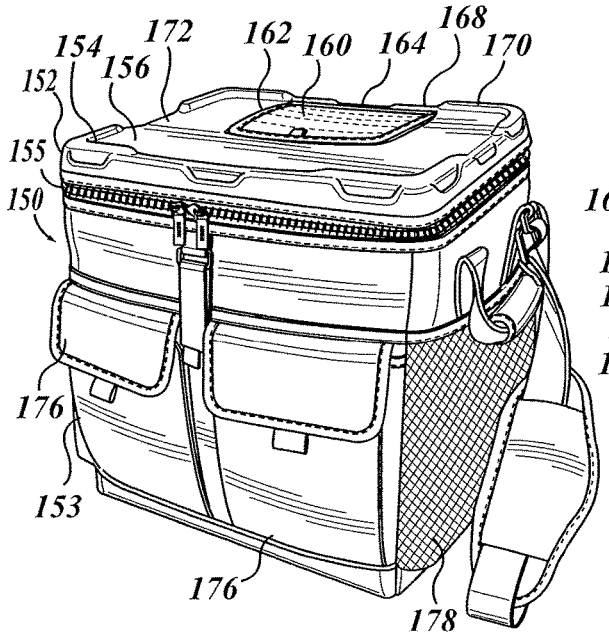
FIG. 5A is a perspective view of an alternate arrangement of soft-sided insulated container assembly to that of FIG. 1A shown in an expanded condition.
Figure 5B:
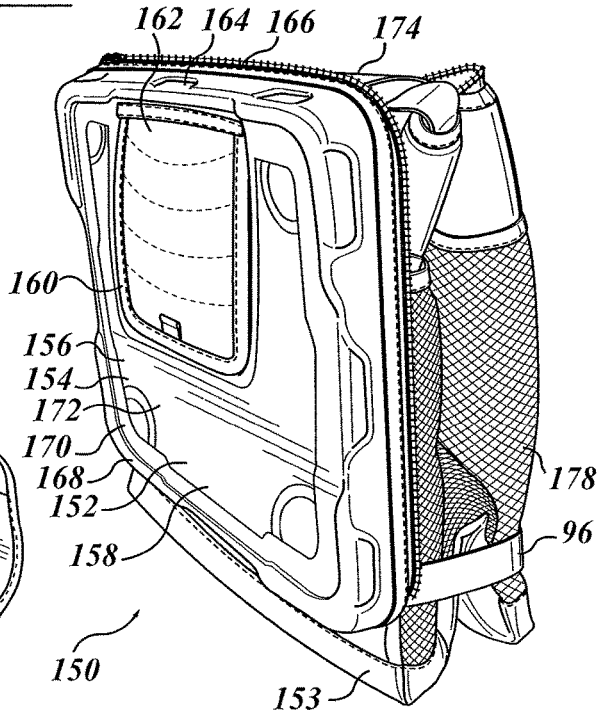
FIG. 5B is a perspective view of the soft-sided cooler assembly of FIG. 5A in a collapsed, retracted, or storage position or configuration.
Figure 5D:
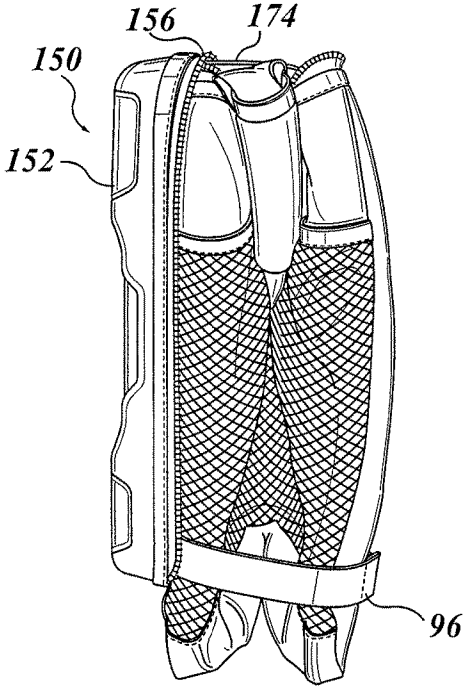
FIG. 5D is a front view of the soft-sided container assembly of FIG. 5B.
Figure 5C:
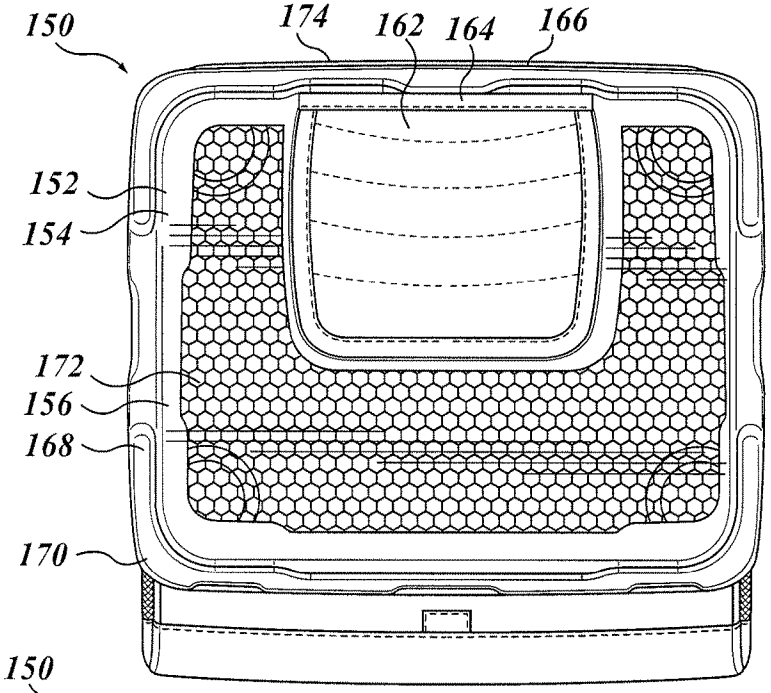
FIG. 5C is an end, view of the soft-sided insulated container assembly of FIG. 5B.
Figure 5E:
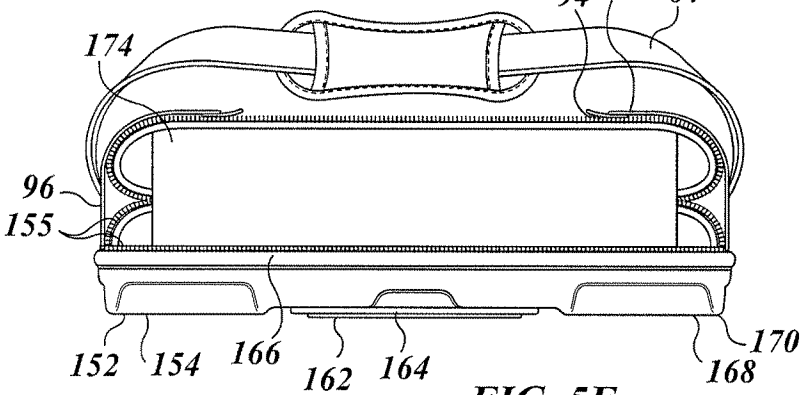
FIG. 5E is a top view of the soft-sided insulated container assembly of FIG. 5B.

The secondary members of the structure of assembly 150 may differ from assembly 20, as indicated by external pockets 176 and netting 178. In other respects, the construction of insulated container assembly 150 is substantially the same as container assembly 20. The insulated wall structure construction is the same, and assembly 150 may include a removable liner, also as described above. Assembly 150 is a collapsible soft-sided insulated container assembly, as shown in FIG. 5D. As with container assembly 20, the substantially rigid member is of similar length and width to the front face of container assembly 150 more generally, such that when collapsed as in FIG. 5D, the collapsed container sections nest against, and have substantially the same projected profile as, rigid member 154.

In another alternate embodiment, FIGS. 6A-6H show a soft-sided insulated container assembly 180. It has a first portion 182 and a second portion 184. First portion 182 defines the lower portion of the container body, and may be taken as being substantially the same in construction as main body 22 of container assembly 20, with the exception of front auxiliary container compartments 183 and 185 in place of secondary wall panel assembly 68.

Second portion 184 may be taken as being the same as lid portion 32 of container assembly 20, having a first portion 186 substantially the same as first portion 82, differing therefrom to the extent that second portion 188 of lid portion 184 has an extendible table top structure or assembly, identified as substantially rigid assembly 190 in place of substantially rigid member 100. To that extent the description of lid portion 32 is not repeated.

In place of substantially rigid member 100, assembly 190 has a three piece sandwich assembly that includes a movable member as described hereinbelow. The first piece of the three piece assembly is a base member or base frame, identified as first substantially rigid member 192, which has the same arrangement of margins and footprint as member 100, and is sewn to the underlying fabric and insulation elements of second portion 184 in the same manner. Rigid member 192 has a substantially planar central web portion 194 which spans second portion 188 in the x and y directions, and which is bounded on three sides of its periphery by out-of-plane reinforcement members, or flanges, identified as first (or left hand), second (or front), and third (or right hand) flanges 196, 197, and 198 respectively that stand in the z direction out of the x-y plane of central web portion 194. These reinforcements may also function as retainers or retaining walls for guiding or inhibiting motion. While out-of-plane reinforcements may have many shapes, in the embodiment shown items 196, 197 and 198 have the form of top-hat, or channel, sections moulded into member 192. The outer leg 199 of the top hat section may be co-planar (or substantially co-planar) with central web portion 194, though it may be of thinner section. The resultant U-shaped wall (as seen from above) terminates at its rearward margin at left and right hand, turned-in abutments, or stops, indicated as 200, 202. Other than stops 200, 202, the rearward margin of member 192 may be substantially clear and planar.

Rigid member 192 has a depressed, or stepped-down flanged portion 204 which has defined therein an auxiliary opening 206. An auxiliary or secondary closure member, 210 may be mounted to flanged portion 204 in substantially the same manner as auxiliary closure member 136 is mounted to depressed portion 132. The clear, unimpeded, flat central portion of substantially rigid member 192, indicated as 208, defines a first region 212 of member 192, and depressed flanged portion 204 defines a second region 214 of member 190. First region, 212, when exposed defines a first work surface 216 upon which objects may be placed.

Assembly 190 also includes a second rigid member, 220. Member 220 has a substantially planar central web portion 222 bounded on three sides of its periphery by out-of-plane reinforcement members, or flanges, identified as first (or left hand), second (or rear), and third (or right hand) flanges 224, 225, and 226 respectively that form a continuous three-sided wall. The rearward reinforcement section may be asymmetric, having a longer outboard depending leg. The other reinforcements may also have the form of channel sections, and may function as retainers or retaining walls. While out-of-plane reinforcements may have many shapes, in the embodiment shown items 224, 225 and 226 have the form of a channel, sections moulded into the respective peripheral edges of member 220. A further flange, in the form of a channel section 230, may be formed along the front margin of web portion 222 and define a reinforced edge, or flange thereof. At the front-ward corners of the left and right hand margins are shown outwardly protruding abutments, or stops 232, 234 respectively. Second member 220, or the central web portion thereof may be made of a see-through, i.e., transparent material. The central web portion of second member 220 defines another work surface 228. Work surface 228 is a movable work surface that may translate between a first, retracted or storage position entirely or predominantly overlying first member 192, and a second, extended or deployed position or condition less predominantly overlying member 192, and in which second position member 192 may be predominantly or entirely exposed, and member 220, or a substantial portion thereof may be moved to a cantilevered position overhanging portion 182, and having a free edge extending therebeyond. Work surface 228 may be a cutting-board surface, or a textured non-slip surface, or a plain smooth surface, as may be, that working surface being bounded by a retainer in each direction.

Assembly 190 further includes a third member 240, which is a retainer, or cap plate, or closing member which mounts to the backs of the top hat sections of the three-sided U-shaped wall of member 192, entrapping member 220 vertically in a sandwich arrangement. Third member 240 may have the general shape of a picture-frame, or bezel, or peripheral strip that extends about the perimeter of second region 188, with an open central region 248 that may be predominantly rectangular, and that exposes the upper surface of the underlying member, be it first member 192 or second member 220, through that generally rectangular opening (it need not be rectangular, but could be some other appropriate shape). The relationship of second member 220 to first member 190 and third member 240 is such that there is a single degree of freedom of motion, in this case translation in the y-direction parallel to the planes of the respective central webs of both first member 190 and second member 220. The mutual engagement or co-operation of the respective left and right hand side flanges of first member 190 and second member 210 define guides for each other and for their respective stops, second member 210 being nested within the side flanges of first member 190. Motion in the forward direction is limited by engagement of the leading edge of flange 230 of member 220 against the rear or inward wall of the front flange 197 of member 192, and sliding motion in the opposite direction being bounded, or limited, or arrested, by the mutual engagement of the stops 200 and 202 of stationary member 192 with stops 232, 234 of movable member 220.

Member 240 may fit closely upon and have substantially the same footprint when seem from above as the U-shaped three sided reinforcement wall of item 190, the width of member 240 inwardly along the left and right hand edges being at least partially to overlap, and therefore capture in the vertical direction, the left and right hand side flanges of member 220, such that the cooperative relationship of the left and right hand side portions 236, 238 of member 240 and the vertical space of the top hat sections of the side reinforcements of member 190 function as a guideway, or pathway, or track, for the slidingly mutually engaged side edge reinforcements of member 220. On its rearward margin, or run, or edge 242 member 240 has a forwardly deviating relief, or dog-leg, as at 244, which co-operates with a corresponding rearwardly deviating dog-leg portion 246 in the rearward edge of member 220 to give access to the handle thereby defined by portion 246 of rear margin flange 226 of member 224 exposed when member 220 is in the closed or retracted position shown in FIG. 6E. When in the closed position, member 220 covers, and conceals, auxiliary closure member 210. When access is desired, member 220 is moved to its extended position as shown in FIG. 6D.

Figure 6A:
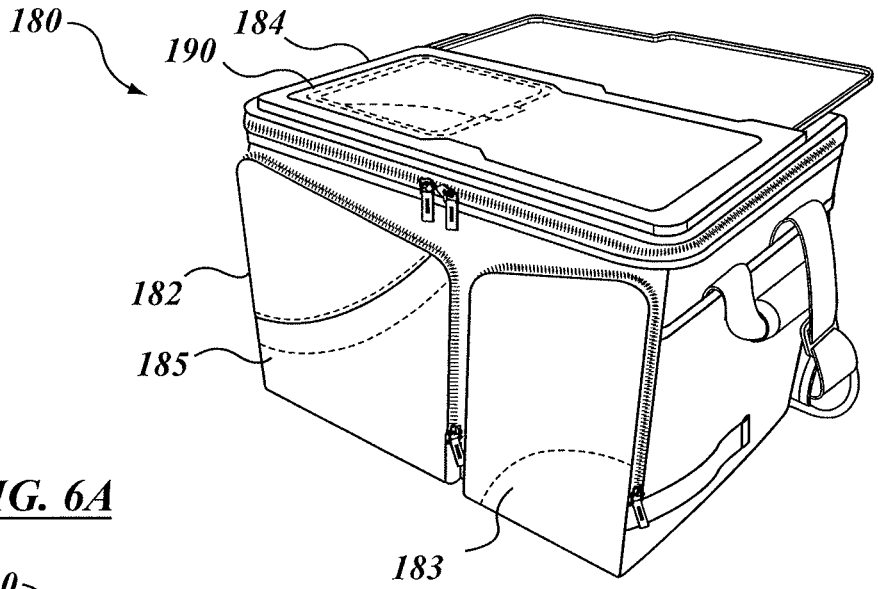
FIG. 6A shows a perspective view of an alternate soft-sided container assembly to that of FIG. 1A with a movable work surface member in an extended position.
Figure 6B:
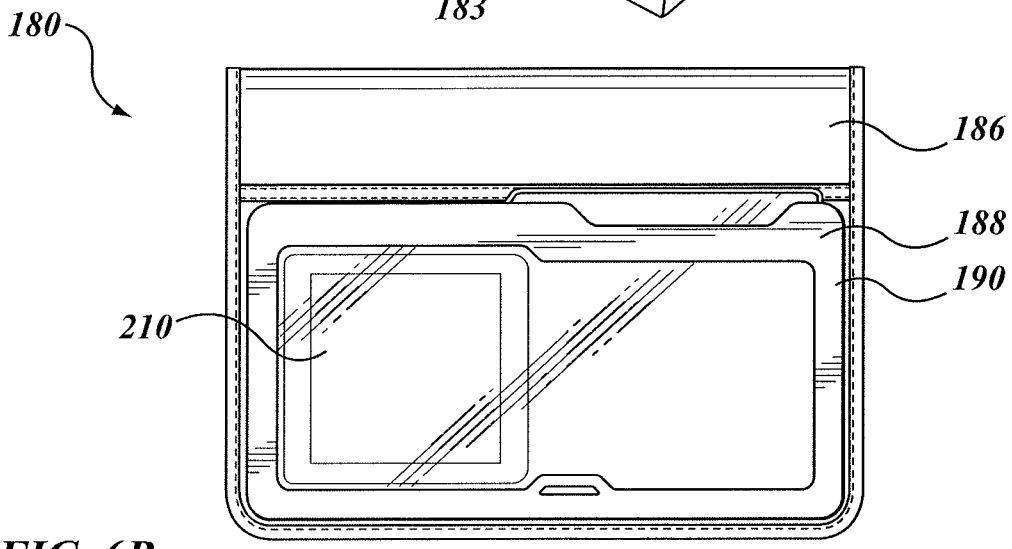
FIG. 6B is a top view of the container assembly of FIG. 6A with the work surface in a stored or retracted position.
Figure 6C:
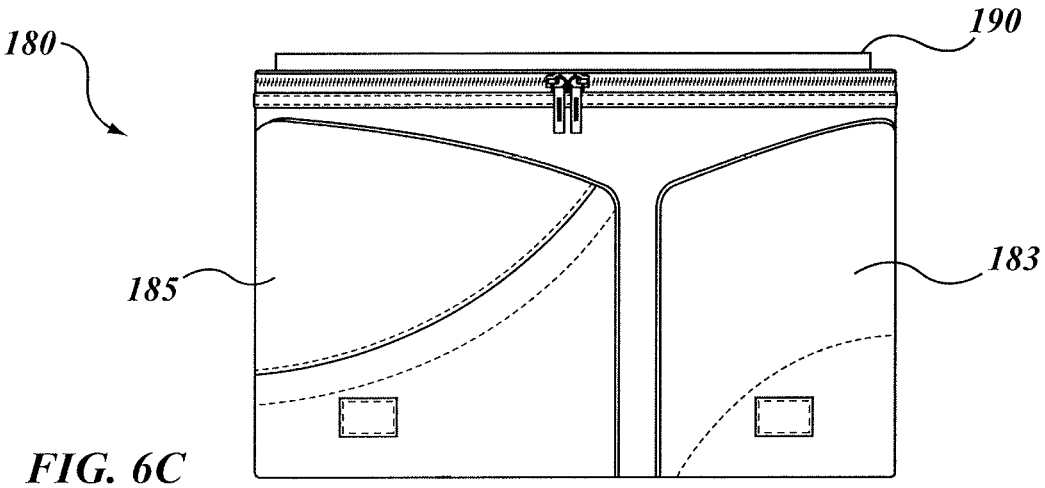
FIG. 6C is a front view of the container assembly of FIG. 6B.
Figure 6E:
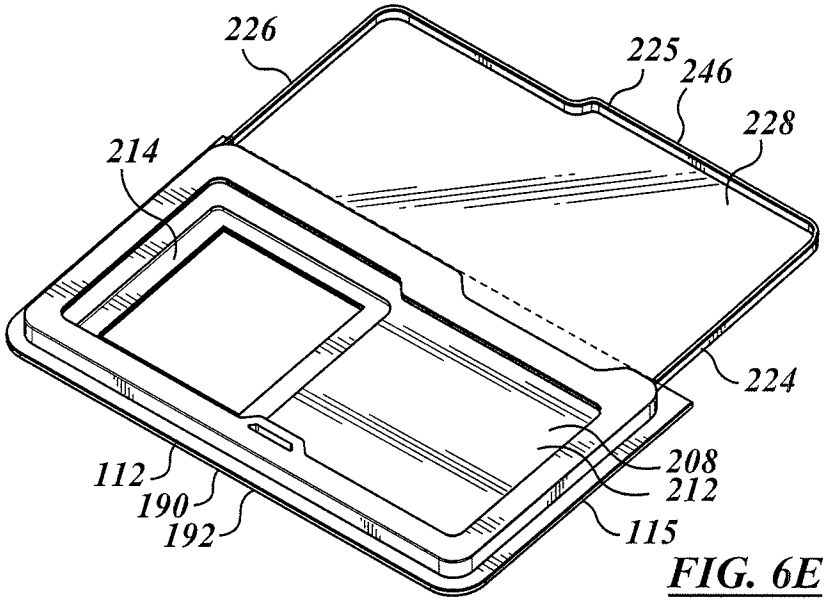
FIG. 6E shows the assembled members of with work surface assembly of FIG. 6D in an extended condition.
Figure 6F:
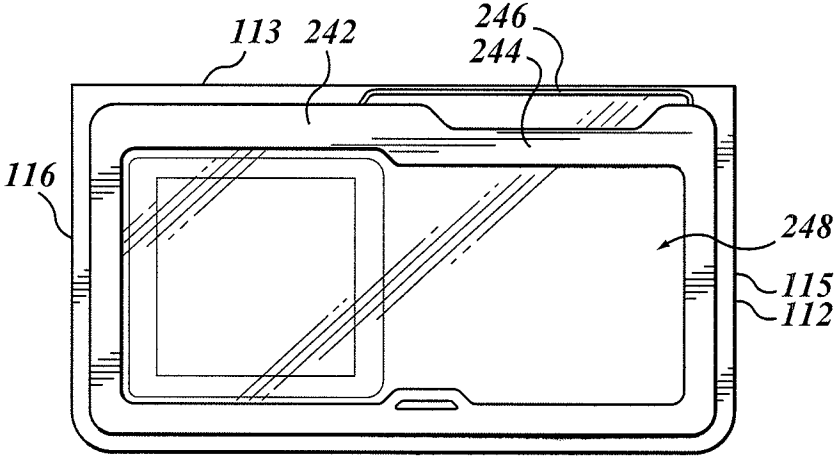
FIG. 6F shows a top view of the assembly of FIG. 6E in a closed or retracted position.
Figure 6D:
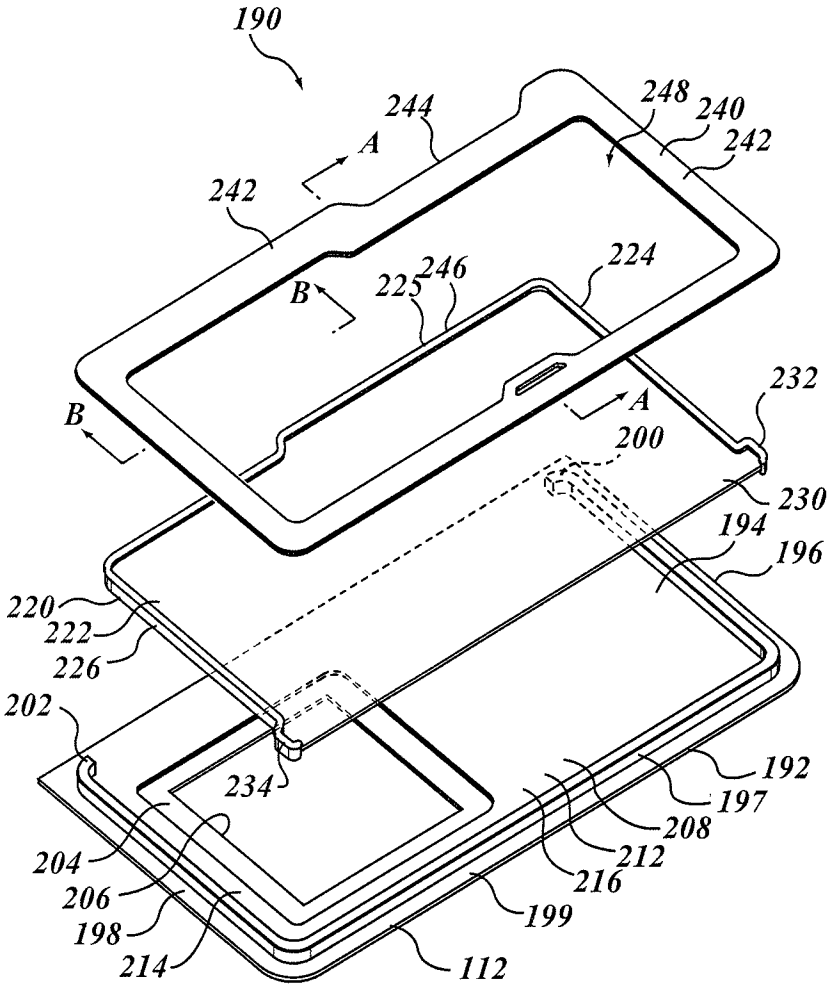
FIG. 6D is an exploded view of a three-part work surface sandwich assembly used in the container assembly of FIG. 6A.

In the extended position shown in FIGS. 6A and 6E, member 220 forms a cantilever. It may extend over portion 186 to (or, indeed, past) hinge 62. Portion 186 may support member 220, to the point of hinge 62 functioning as a fulcrum, or reaction, of the cantilever. A reaction moment is provided by the engagement of the front edge flange 230 of member 220 with the rear marginal spanning edge portion 242 of member 240. Member 240 may have substantially rectangular opening 248 defined therein such as to permit access to auxiliary opening 206, and also to the upwardly facing working surface 212 of member 192 when member 240 is in the extended position. Further, opening 248 gives access to work surface 228 when member 220 is in the closed, retracted, or storage position of FIG. 2E. Thus in the expanded position the total area of work surface available includes both region 212 and work surface 228, and in the closed position, work surface 228. This combined table top may provide a suitably sized area for preparing foods or drinks, or for eating while on a picnic or other outing.

Figure 7A:
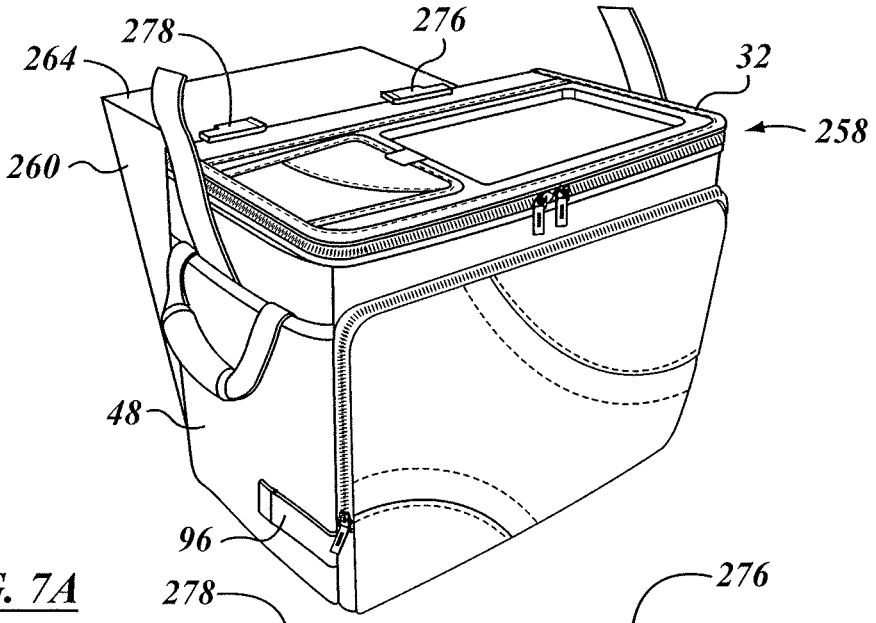
FIG. 7A is a perspective view from the front right hand corner of a further soft-sided insulated container assembly to that of FIG. 1A, having an extending shelf assembly mounted to a rear wall thereof.
Figure 7B:
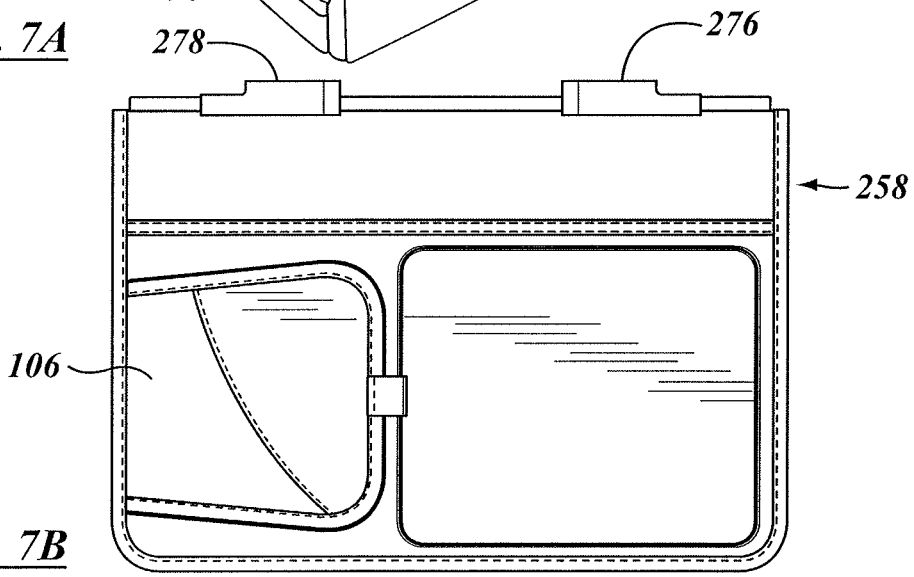
FIG. 7B is a top view of the container assembly of FIG. 7A.
Figure 7C:
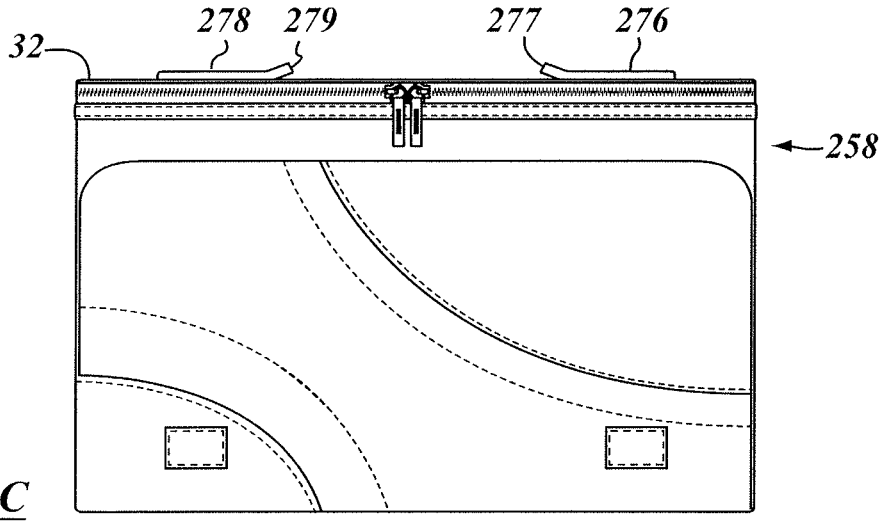
FIG. 7C is a front view of the container assembly of FIG. 7A.
Figure 7D:
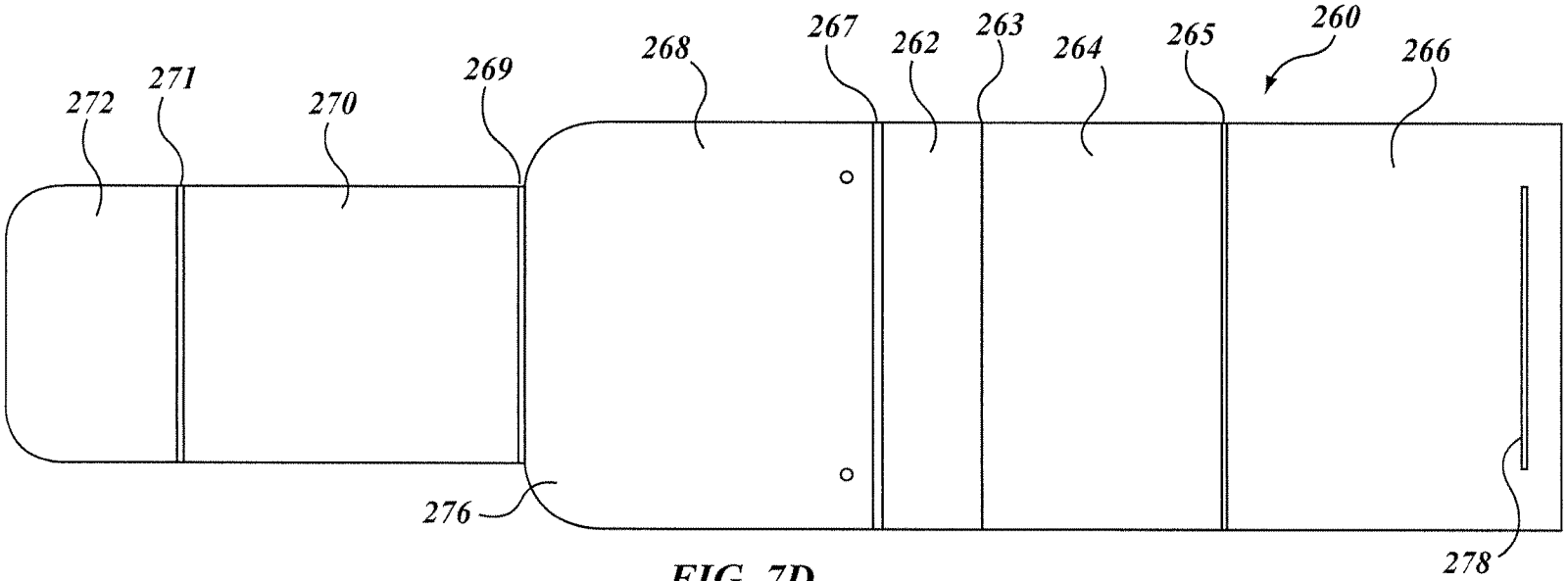
FIG. 7D is a developed, that is, unfolded, view of the shelf assembly of the container assembly of FIG. 7A.
Figure 7F:
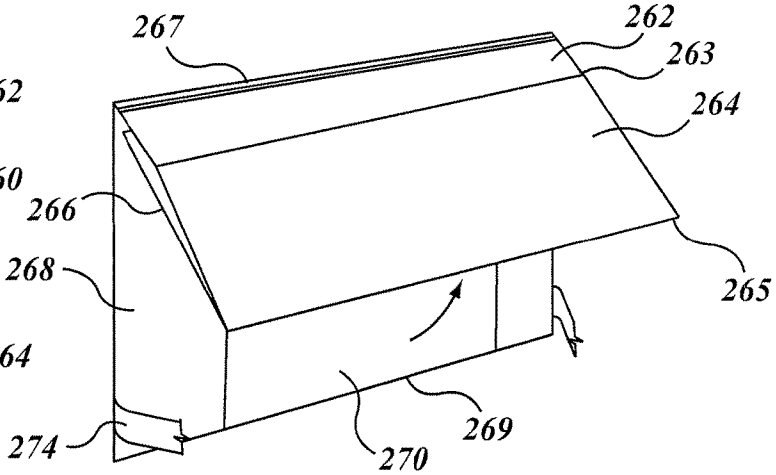
FIG. 7F is a perspective view of the shelf assembly of FIG. 7E in a partially unfolded position.
Figure 7E:
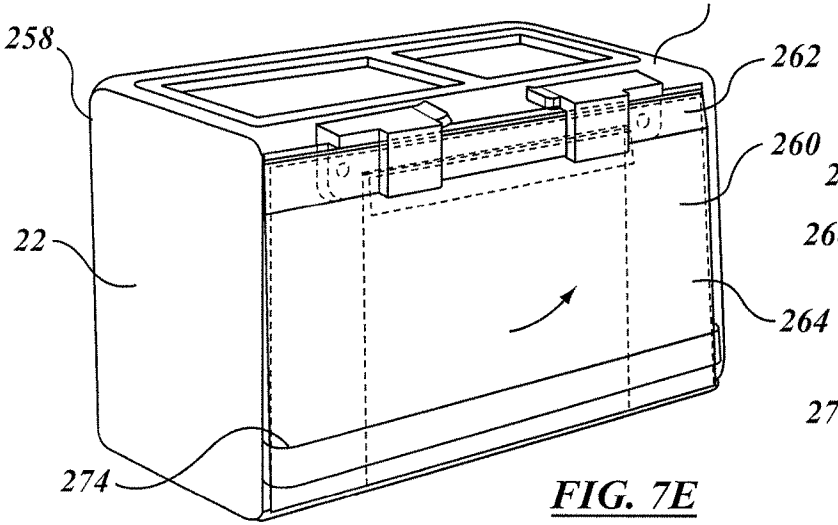
FIG. 7E is a perspective view of the shelf assembly of FIG. 7D in a collapsed or folded position.
Figure 7G:
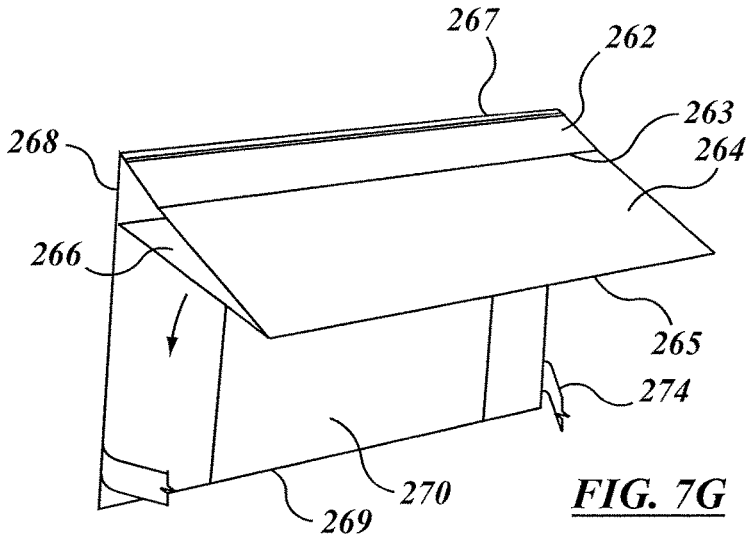
FIG. 7G is a perspective view of the shelf assembly of FIG. 7E in a partially unfolded position.
Figure 7H:
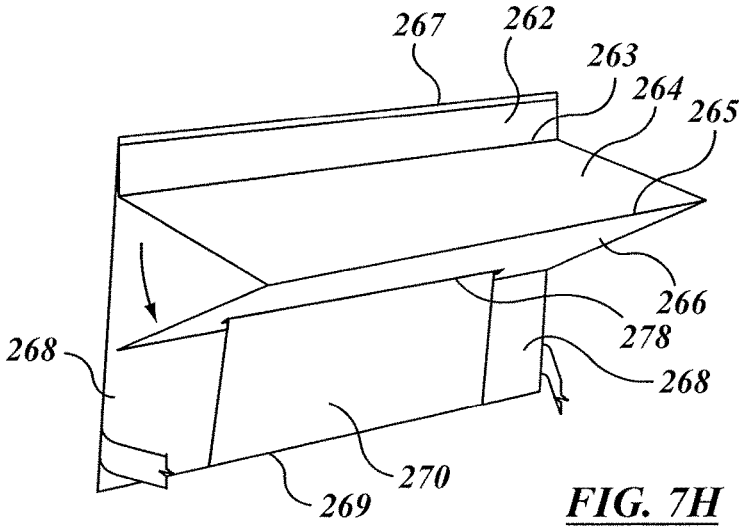
FIG. 7H is a perspective view of the shelf assembly of FIG. 7E in a partially unfolded position.
Figure 7I:
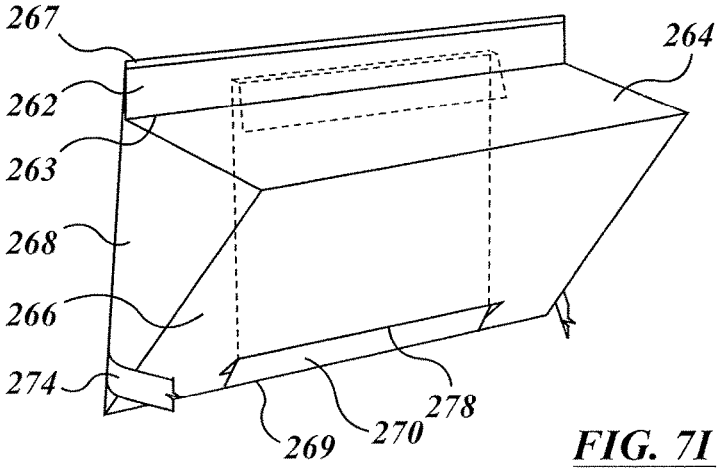
FIG. 7I is a perspective view of the shelf assembly of FIG. 7E in a partially unfolded position.
Figure 7J:
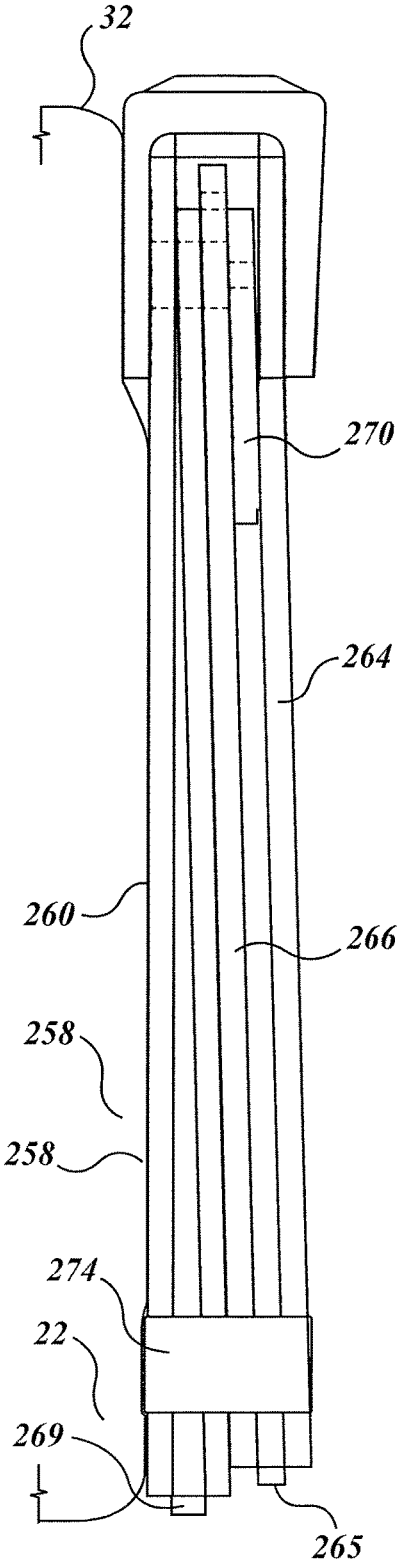
FIG. 7J is a side view of the shelf assembly of FIG. 7E in a fully folded position or condition as in FIG. 7E.
Figure 7K:
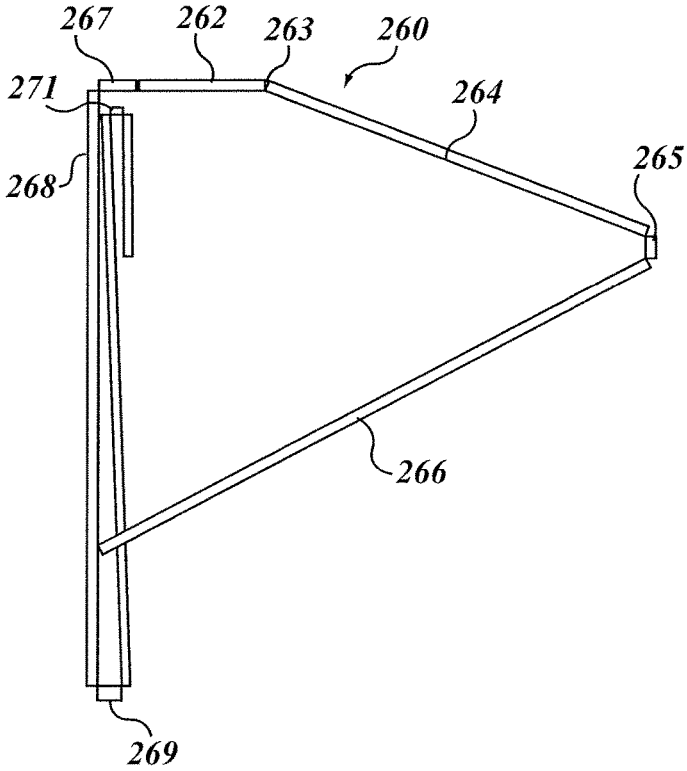
FIG. 7K is a side view of the shelf assembly of FIG. 7J in a partially unfolded position.

In a further alternative, shown in FIGS. 7A-7L, an extended, or extendable, work surface assembly 260 may be mounted to the rear wall panel of a container assembly 258, which may be substantially similar to a body such as body 22 of soft-sided insulated container assembly 20. Working surface assembly 260 may be a folding assembly made of rigid members 262, 264, 266, 268, 270 and 272. A storage position or condition retainer element is identified as 274. Item 274 may have the form of an elasticized band or strip or cord having first and second ends mounted in appropriately convenient locations such as the nether (i.e., lower) regions of the container end walls 46, 48 of body 22, perhaps at or near the junction with the insulated rear wall. Left and right hand securement fittings, are identified as clamps 276 and 278, respectively. Clamps 276 and 278 are movable from a locked position, as shown in FIGS. 7E and 7J, to an unlocked position by lifting on the slightly raised thumb tabs, or end levers, 277, 279, causing them to pivot on their pivots 275 to a raised, disengaged position, allowing motion of the various other members. When assembly 260 has been moved to its open, or deployed position, clamps 276, 278 are pivoted in the other direction and returned to their securing, or locking position. When assembly 260 is folded, the procedure is reversed.

In one embodiment, with the exception of retaining hardware such as clamps 276, 278 and retainer element 274, working surface assembly 260 may be manufactured from a single, monolithic sheet, 276, with folds, and a cut out or aperture 278, as indicated in FIG. 7D. The single fold between items 262 and 264 is indicated as hinge 263; the double fold between items 264 and 266 is indicated as hinge 265; the double fold between items 262 and 268 is indicated as hinge 267; the double fold between items 268 and 270 is indicated as hinge 269; and the double fold between items 270 and 272 is indicated as hinge 271.

Figure 7L:
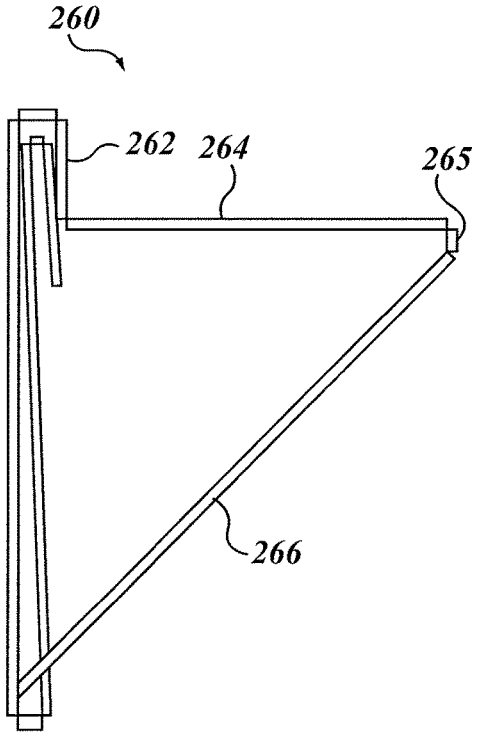
FIG. 7L is a side view of the shelf assembly of FIG. 7J in a fully expanded and deployed position or condition.

As can be seen in FIGS. 7A and 7J, in the collapsed, or folded condition, the tray, or table-top work surface extension, in the form of a rigid member 264, lies adjacent to its various strut members adjacent and substantially parallel to the back panel 256 of assembly 258, and is secured in that position by clamps 276, 278 and retainer 274. When a work surface is desired, the retainer and the clamps are released from the securement position shown in FIG. 7E, such that member 264 may be lifted upwardly and outwardly in a curving path as suggested in FIG. 7F, and that member 262 may pivot upwardly and outwardly on hinge 263 while this happens. As it does so, first strut member 266 is released, and falls or slides downwardly, with aperture 278 sliding down strut portion 270, which itself can swings or flex outwardly somewhat on hinge 279 until members 266 and 270 are locked against each other and can rotate no further outward, with the distal end of member 266 seating adjacent hinge 269, thus defining a strut supporting the distal edge of member 264. Rigid base panel 268 maintains the spacing between hinge 267 and hinge 269 to which member 262 is attached. In the last position, of FIG. 7G, panel 264 has rotated to a right angle relative to panel 262, which now sits flat parallel to members 268, 270, and 272. Inasmuch as the working surface of member 264 is exposed even when in the closed position, retaining walls or flanges can be formed in the lateral margins thereof if desired without interfering with the function of the apparatus, and a retaining wall, or lip may be mounted across the distal end of member 264 adjacent to hinge 265. In the position of FIG. 7L clamps 276, 278 may be rotated laterally inwardly and downwardly on their pivots pins 282, to hold member 262, and thus the proximal end of member 264 close to the wall. Pivot pins 282 may pass through apertures 284 in member 268, and protrude to act as stops for the back side of member 262. In the reverse process, when the clamps are released, member 266 can be squeezed toward member 264, and the structure will fold, with slots 286 being clearance slots for pins 282.

Figure 7M:
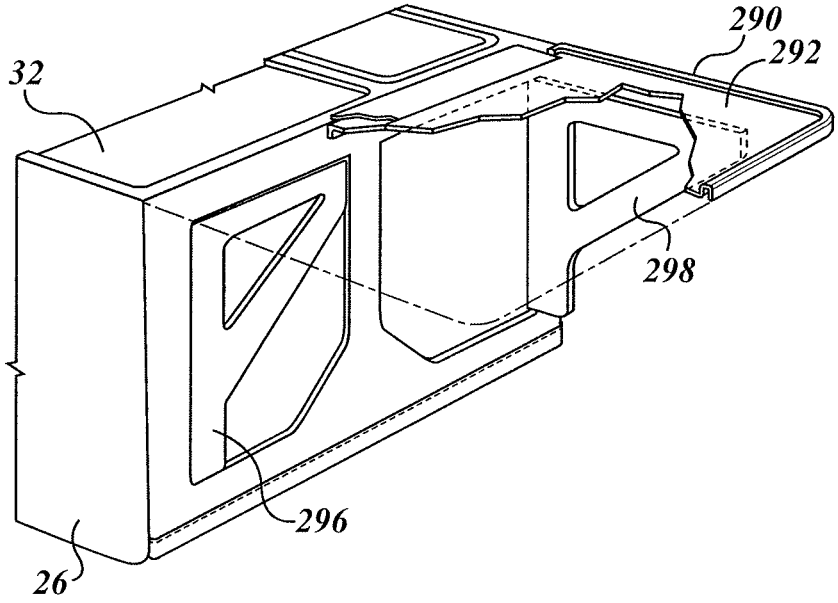
FIG. 7M is a scrap perspective view of an alternative shelf assembly to that of FIG. 7J with a drop leaf as opened.
Figure 7N:
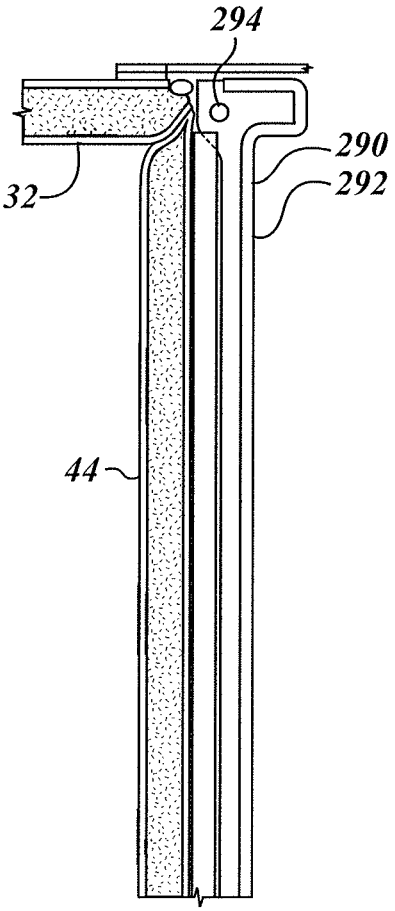
FIG. 7N is a cross-section of the shelf assembly of FIG. 7M in a closed, retracted, or storage, position.

There are other ways of constructing a collapsible or extendable shelf structure. An alternate is shown in FIGS. 7M and 7N. A collapsible, folding shelf assembly is indicated generally as 290. It includes a substantially rigid member 292 that defines a work surface, not unlike member 220 in construction, having a hinge 294 at the proximal edge, and flange margins around the three other sides to enhance stiffness. Although FIG. 7M is a partially cut-away view, the full extent of rigid member 292 is indicated by the intermittent dashed line. Rigid member 292 is a drop leaf. Assembly 290 also includes two movable wings, or arms, or supports, 296, 298 that swing outwardly to support member 292 in its deployed or open position, and swing inwardly to lie flat against the rear wall of the insulated structure, nesting inside the profile of member 292 when the drop-leaf is in its lowered or closed position. It may be that a soft-sided collapsible insulated container assembly may include both the substantially rigid lid assembly of container assembly 20 and an auxiliary shelf assembly, such as folding shelf assembly 260. In such circumstances, in the collapsed condition the substantially rigid lid portion may lie against the front wall of the folded assembly, and the rigid folded shelf assembly may lie substantially flat against the rear wall. Other collapsible shelf arrangements are possible, whether using telescoping members or over-center arms or other means.

In the embodiments of FIGS. 7A-7L and 7M-7N, the working surface can be deployed or retracted without obstructing access to the auxiliary closure member of lid 32. By contrast, in FIGS. 6A-6H, when member 220 is in the closed position, the auxiliary closure member 210 is obstructed. Thus the embodiments of FIGS. 7A-7N provide a temporary, collapsible, working surface that may provide a substantially flat and level place on which to rest objects, without impeding access to the secondary closure member, i.e., the secondary closure member remains free of obstruction whether the working surface is deployed or not.

Figure 1B:
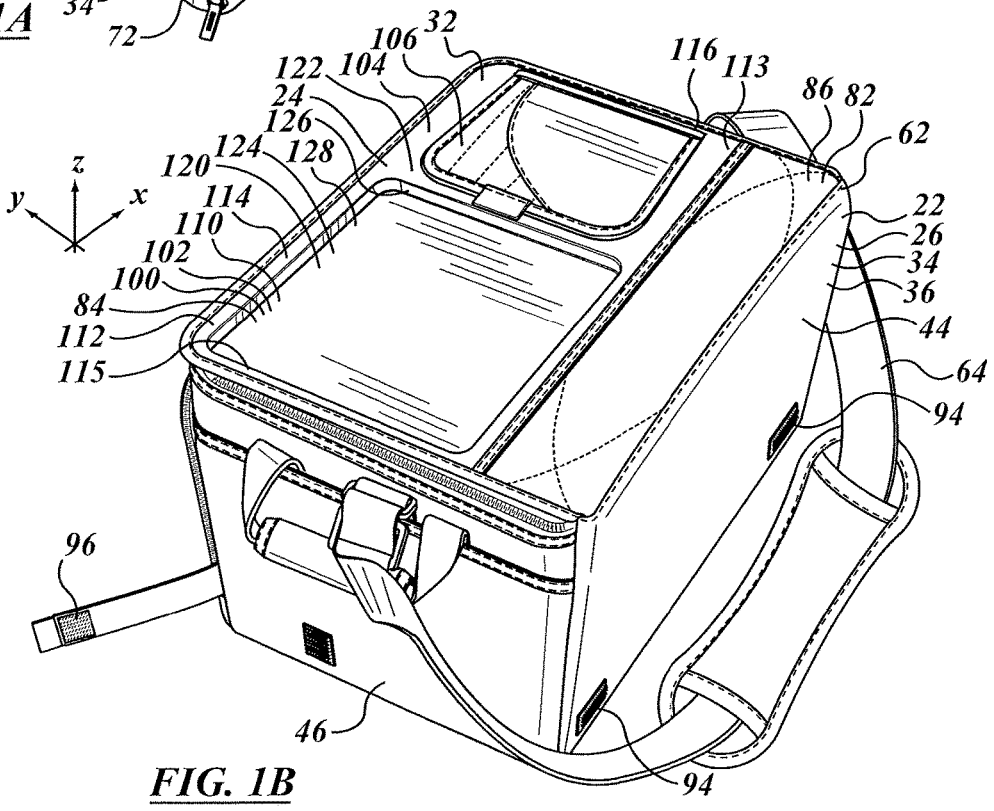
FIG. 1B shows the container assembly of FIG. 1A in a perspective view taken from above on the opposite diagonal to that of the perspective view of FIG. 1A and with the auxiliary closure member closed.
Figure 1C:
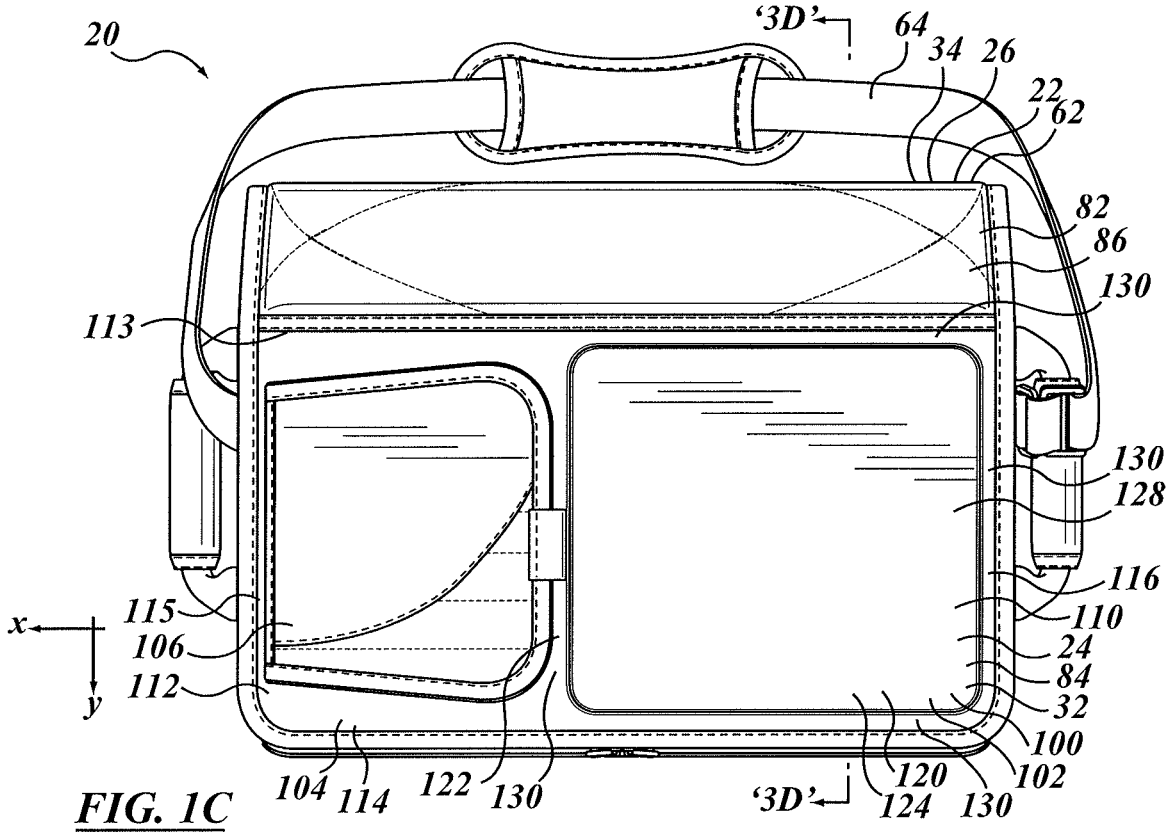
FIG. 1C shows a top view of the container assembly of FIG. 1A.
Figure 1D:
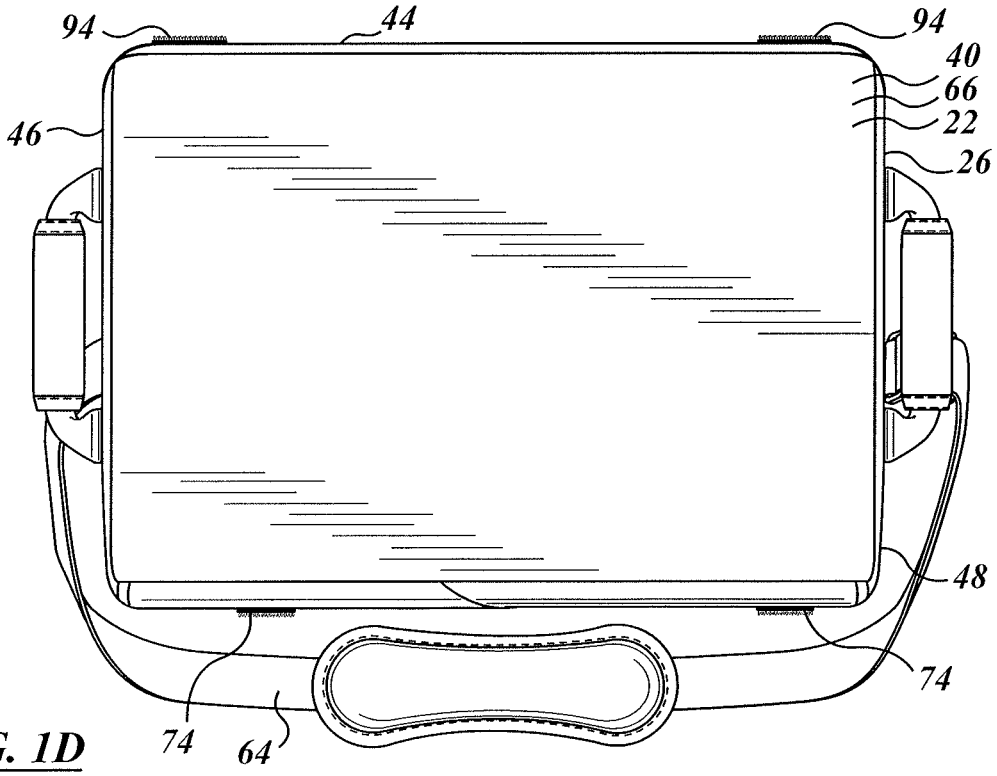
FIG. 1D shows a bottom view of the container of FIG. 1A.
Figure 1E:
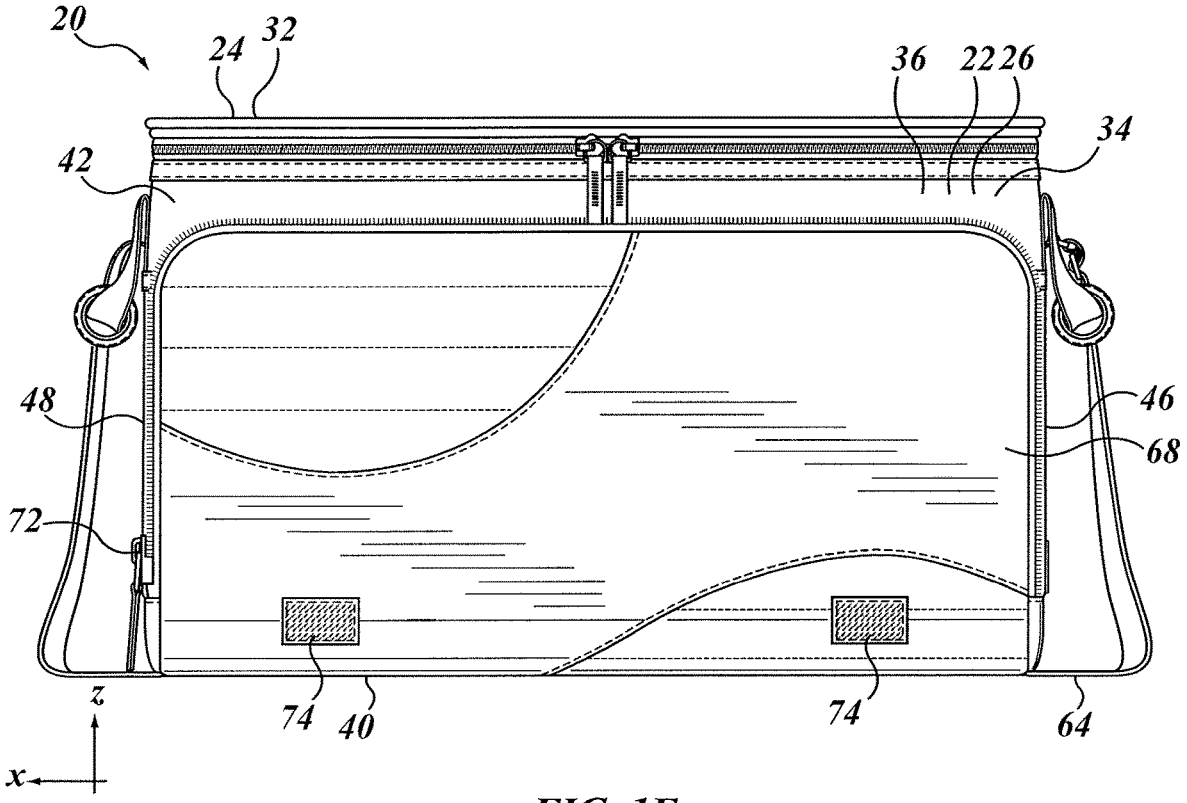
FIG. 1E is a front view of the container assembly of FIG. 1A.
Figure 1F:
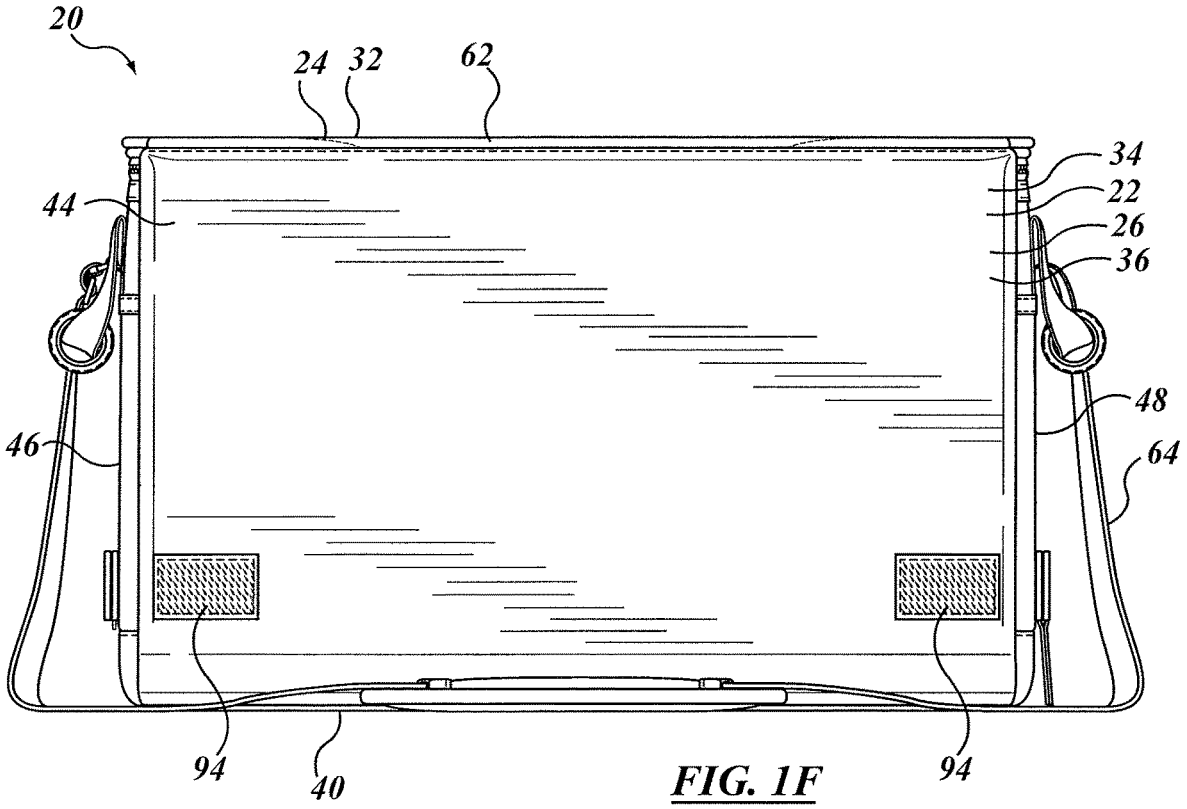
FIG. 1F is a rear view of the container assembly of FIG. 1A.
Figure 1G:
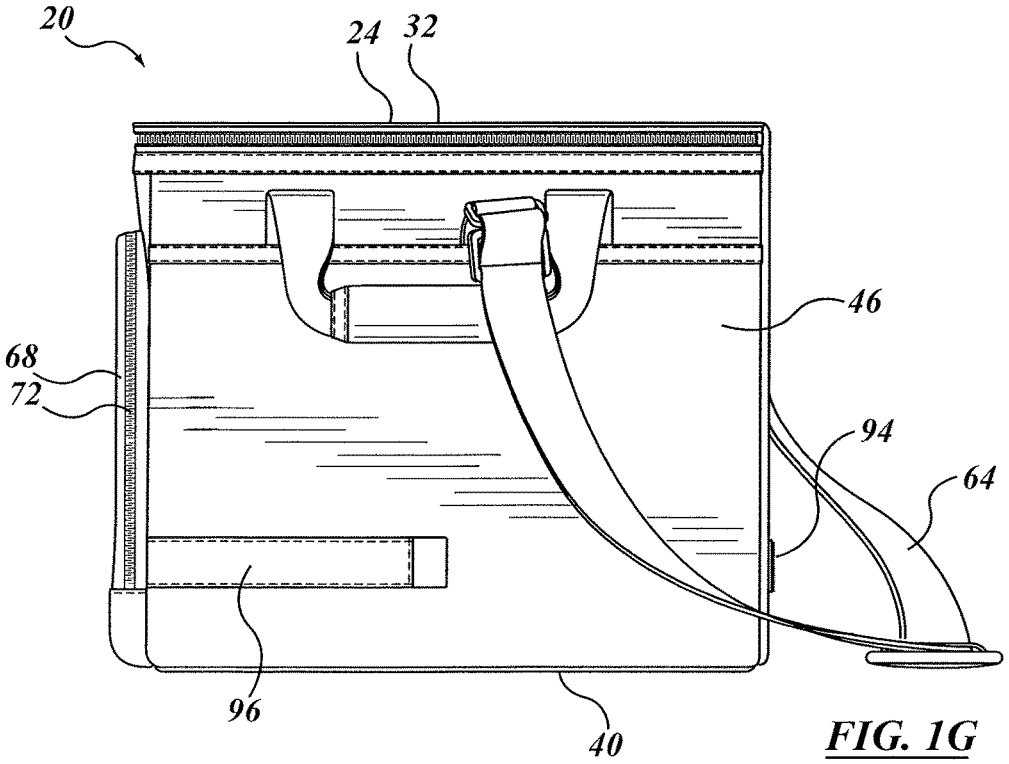
FIG. 1G is a left hand view of the container assembly of FIG. 1A.
Figure 1H:
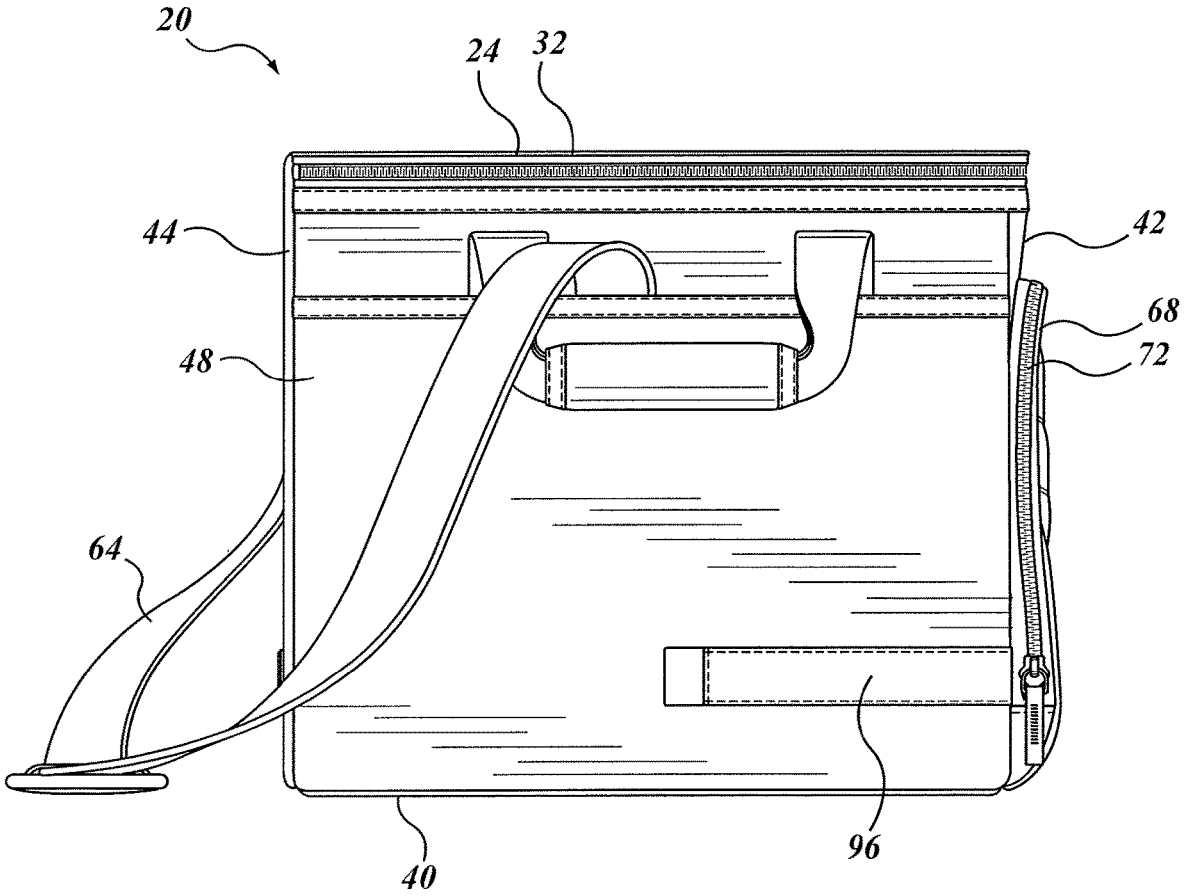
FIG. 1H is a right hand view of the container assembly of FIG. 1A.
Figure 2A:
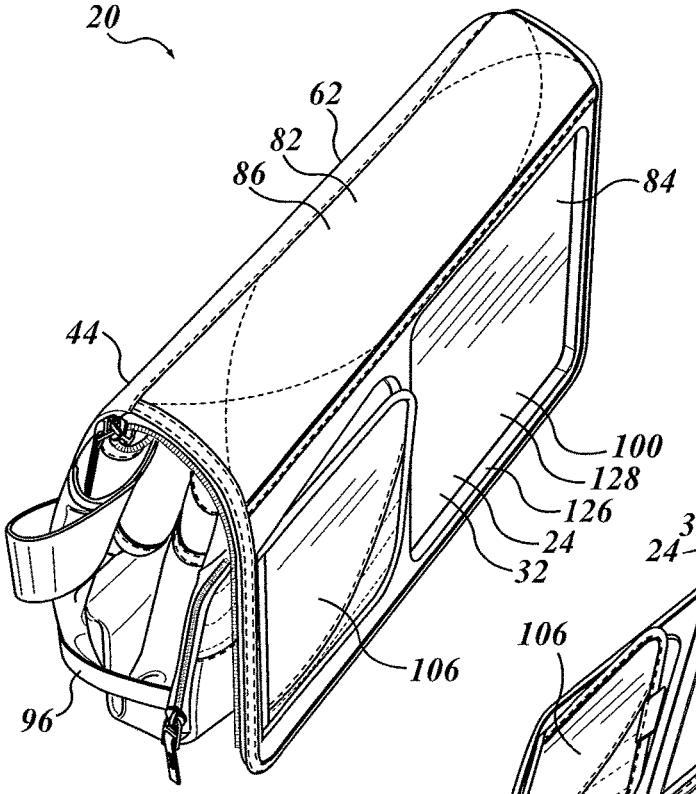
FIG. 2A shows a perspective view taken from in front, above, and to the right, the container assembly of FIG. 1A in a collapsed, or folded, condition.
Figure 2B:
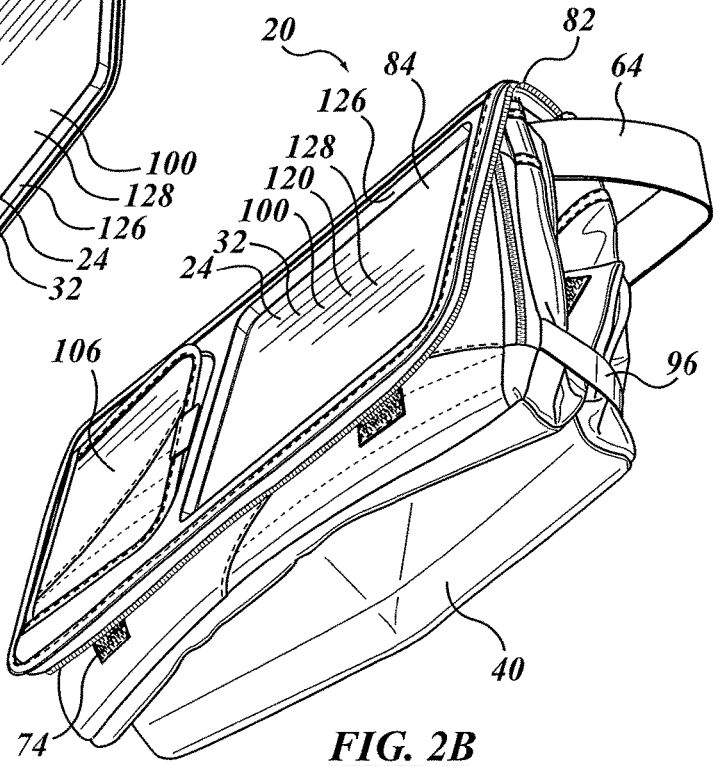
FIG. 2B shows the folded container assembly of FIG. 2A in a perspective view taken from below, in front, and to the left.
Figure 2C:
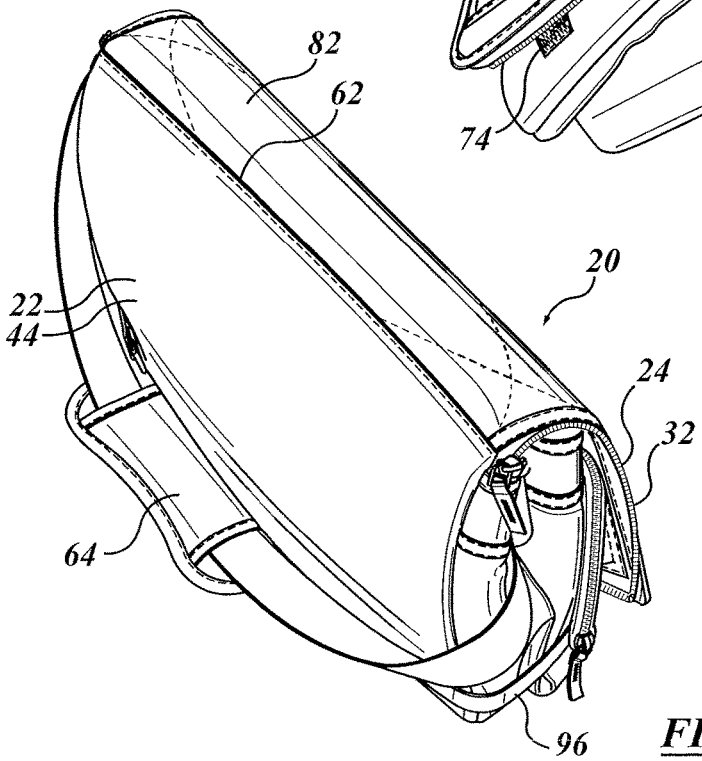
FIG. 2C shows the folded container assembly of FIG. 2A in a perspective view taken from above, behind, and to the right on the opposite diagonal to FIG. 2B.
Figure 2E:
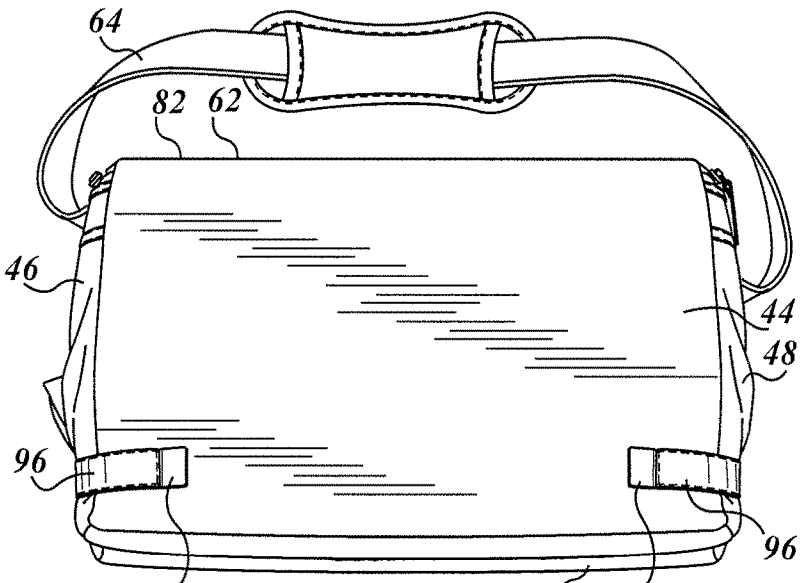
FIG. 2E is a rear view of the container assembly of FIG. 2A.
Figure 2G:
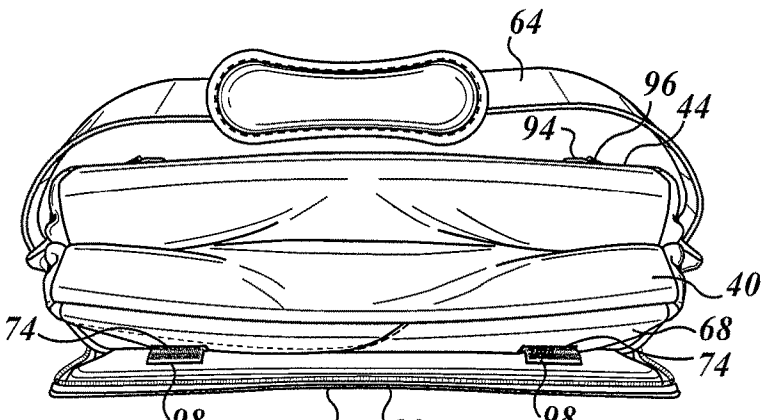
FIG. 2G shows a bottom view of the container of FIG. 2A.
Figure 2D:
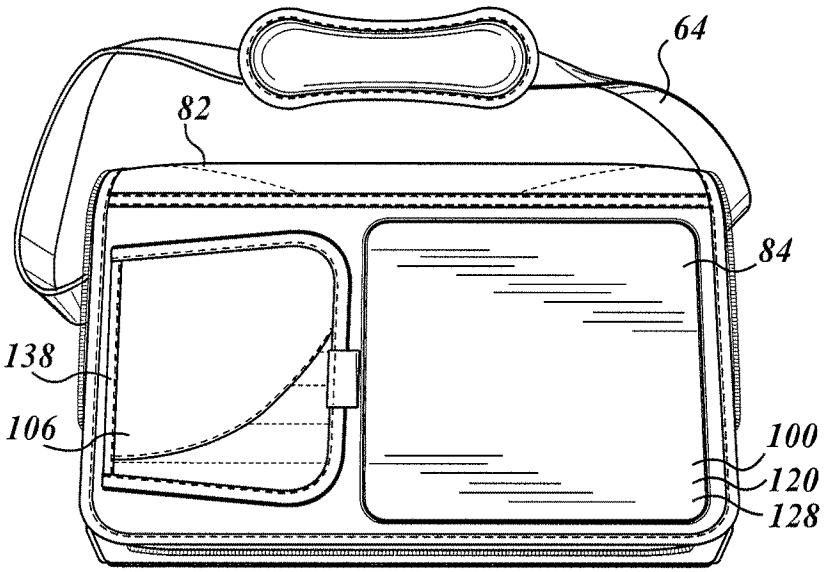
FIG. 2D is a front view of the container assembly of FIG. 2A.
Figure 2F:
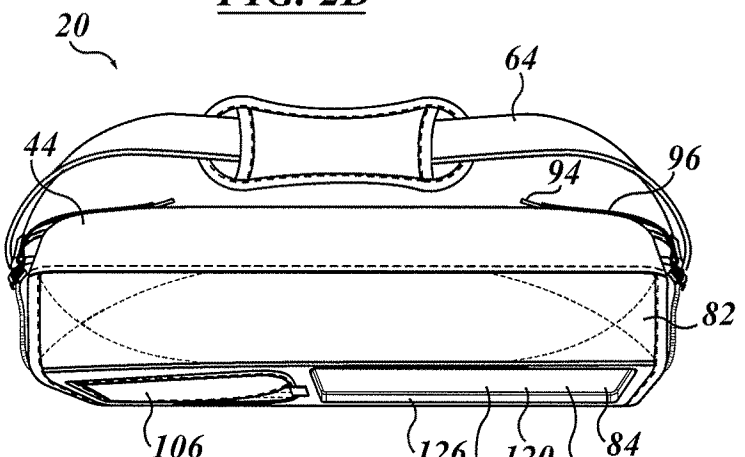
FIG. 2F shows a top view of the container assembly of FIG. 2A.
Figure 2I:
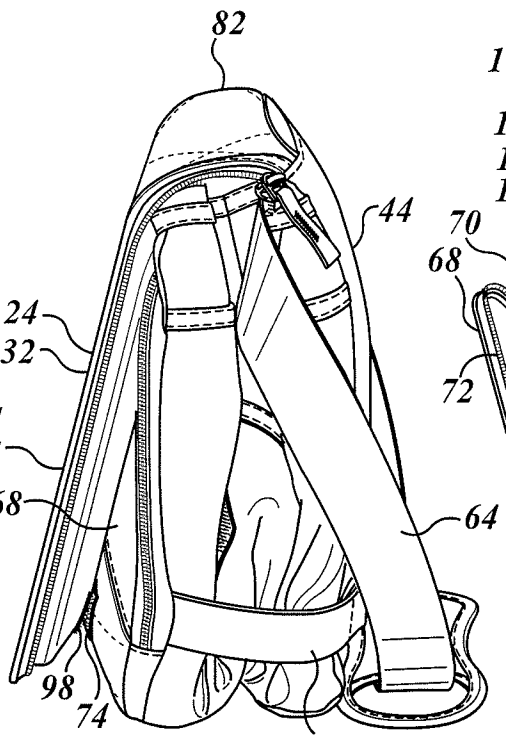
FIG. 2I is a right hand view of the container assembly of FIG. 2A.
Figure 2H:
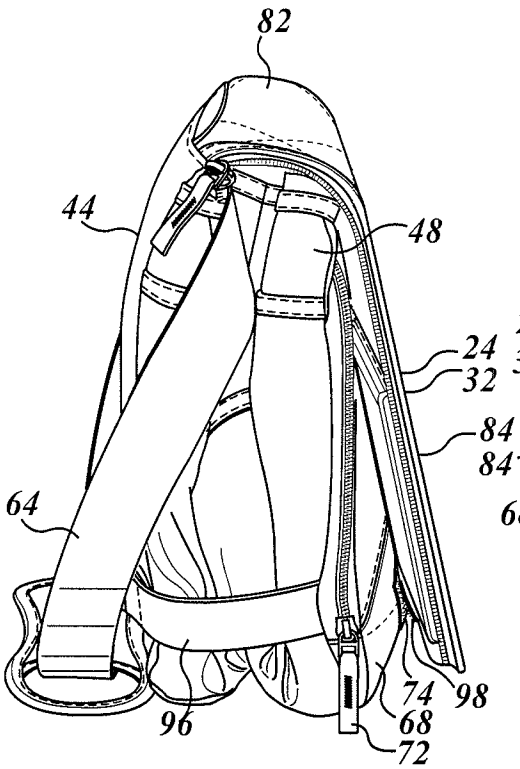
FIG. 2H is a left hand view of the container assembly of FIG. 2A.

In the embodiment of FIGS. 8A-8H, there is a collapsible soft-sided insulated container, or container assembly 300, that is substantially similar to the container assembly 20 of FIG. 1B, and may be taken as being the same in terms of basic soft-sided insulated container construction and features unless otherwise noted.

Container, or container assembly, 300 includes a first portion 302 and a second portion 304. First portion 302 may be termed the base or body portion, and may have an upstanding soft-sided insulated wall structure 306 that defines a chamber 310 therewithin, in which to receive objects that one may wish to keep cool or warm. As usual, the soft-sided insulated wall structure 306 may include a base or bottom panel or bottom wall 308 which may quite typically be rectangular. Respective front, rear, left hand side and right hand side panels may be mounted about the respective edges of the bottom panel and stand upwardly therefrom, the bottom and the various side panels defining a five-sided box.

Second portion 304 may include, or may be, a closure member, or top, or lid, 312 such as may be connected by a hinge 318 to the first or main body portion 302. As before, when container assembly 300 is in the expanded position, lid 312 is movable between an open position and a closed position, and governs access to chamber 310. As with assembly 20, lid 312 of assembly 300 has a first portion, identified as a proximal portion 314 and a second portion, identified as distal portion 316. Proximal portion 314 is hingedly connected to the upper margin of the rear panel of the upstanding wall structure. Distal portion 316 is distant from the hinge connection as at 318, and is therefore distant from the rearward portions of container assembly 300. A tracked fastener, such as a zipper, may run around the remaining edges of lid 312 to permit it to be releasably secured to the right hand side, front, and left hand side portions of the upper rim of main body portion 302.

In the collapsed position, or condition, or configuration, the front panel moves toward the rear panel, and the lid wraps over the collapsed lower body portion. To that end, proximal portion 314 is flexible, or foldable, or bendable, to curve over main body portion 302 such that distal portion 316 then lies in front to the front wall of the unit. Securement fittings in the nature of straps 308, such as may be provided with appropriate hook-and-eye fabric fasteners may then secure the unit in the folded or collapsed or storage configuration.

Lid 312 may have a length $L_{312}$ as measured from the back wall panel to the front wall panel. The proximal portion of the lid assembly may have a back-to-front length indicated as $L_{314}$. The distal portion may have a back to front length indicated as $L_{316}$. Whereas the proximal portion of the lid of assembly 20 was of relatively limited size, length $L_{314}$ of proximal portion 314 may be greater than half of length $L_{312}$, and may be greater than ¾ of $L_{312}$.

Distal portion 316 includes a hard fitting 320. Hard fitting 320 may extend along the forward, or most distant edge from the hinge connection. In contrast to the table top hard panels described above, in which there may be a desire to obtain as large a working surface as possible, hard fitting 320 may extend less than ⅓ of the length $L_{312}$ of lid 312. Hard fitting 320 may have a land or mounting array, or peripheral flange 322 by which hard fitting 320 is secured, as by sticking or bonding, to adjacent fabric materials. As installed, flange 322 may be taken as lying in the dominant place of the lid more generally.

Hard fitting 320 may have a first accommodation 324, which may be a rigid molded drink pocket, or socket, 326. Socket 326 may include a well 328 that extends downwardly into hard fitting 320 to a bottom or base wall 330 positioned at a level that is below, or shy of, the level of flange 322, such that an object placed in well 328 may tend to have a sunken, or partially sunken position relative to lid 312 more generally. Socket 326 may have a round and cylindrical sidewall 332, or may have a taper, or draft angle, opening upward, and may have a diameter comparable to that of a beverage can, be it 2¾" diameter, 3" diameter, or some other. Expressed differently, when container 320 is in its expanded condition and lid 312 is in place, the bottom of the well depends from the level of the lid more generally, and extends inwardly into chamber 310. Accommodation 324 may have a continuous membrane or wall defining the base or inner wall of the socket, that does not leak or drip or drain into chamber 310.

Accommodation 324 may also have an outwardly standing retainer, which may be an outwardly standing wall, and which may be an outwardly or upwardly continuing extension 346 of the sidewall of socket 326. Extension 346 may stand upwardly or outwardly proud of the level of flange 322, and of the general level of the main panel or surface of lid 312 more generally. In that way, accommodation 324 extends both inwardly to the inside of flange 322 and outwardly outside and away from flange 322.

Hard fitting 320 may run along the front edge of lid 312 distant from the hinge. Accommodation 324 may be a drink pocket fitting located at one end of hard fitting 320, that accommodation being located generally in a corner of lid 312. Hard fitting 320 may have a second accommodation 334 located at the distant end, which may be at the other corner of lid 312. There may be a medial portion 336 that extends between the first and second accommodations. Front and rear walls or rims, or channels, or flanges may bound medial portion 336 on either side to front and back, as at 338, 340, defining the edges of fitting 320. These channels or flanges 338, 340 give hard fitting 320 a depth of section tending to make hard fitting 320 function as a beam giving the forward margin of lid 320 a stiffness against bending, and a lateral rigidity. Hard fitting 320 has an abnormally large through-thickness extent. Channels or flanges 338, 340 may be spaced apart a distance corresponding roughly to the diameter of the sockets of first accommodation 324 and second accommodation 334, and may generally tend to be tangential to, or to fit on a smooth curve into, the circular upwardly extending retainer portions of sockets 324 and 334.

Proximal portion 314 may have an access opening 340 defined therein. Access opening 342 may be a zipperless access opening. Access opening 342 may include a movable closure panel, or door, or flap, 344 such as may be movable between closed and open positions to permit a user to reach inside chamber 310 and retrieve, for example, a beverage. The beverage may be opened, and then placed in one of accommodations 324, 334 along the front wall of the cooler, more generally. Closure panel 344 may be of generally the same, or similar, insulated soft-sided construction as that of proximal portion 314 of lid 312 or of the side and rear panel walls of main body portion 302 generally. Closure panel 344 may be pliable or bendable such that when lid 312 is moved to the collapsed position or condition or configuration, and wraps over collapsed main body portion 302, panel 344 bends with lid 312.

Closure panel 344 may be generally rectangular, and may occupy a majority of the area of proximal portion 314. Closure panel 344 may be hingedly attached to proximal portion 314. The hinge attachment may be at, or adjacent to the rear margin of lid 312. Closure panel 344 may be centered along the rear margin. Closure panel 344 may open toward hard fitting 320, i.e., the free edge of closure panel 344 is closest toward, or adjacent to, or next to, the rearward margin of hard fitting 320.

Container assembly 320 may have an auxiliary container assembly, compartment, or enclosure, or wall structure 350 mounted to the front wall of the front panel 320. Auxiliary container assembly 350 may be insulated or non-insulated. Auxiliary container assembly 350 may be expandable or collapsible, seen in the in-use, deployed, or expanded condition in FIG. 8A, and in the collapsed or retracted position behind the wrapped-over distal portion 316 of lid 312 in FIG. 8B. Container assembly 320 may also have a securement 352, such as may be a latch or strap, or releasable fastener, mounted to the rear wall thereof. Securement 352 may then be used releasably to fasten, or otherwise mount, the back or rear panel of the container to the telescoping trailing handle of a wheeled cart or other frame.

Figure 11A:
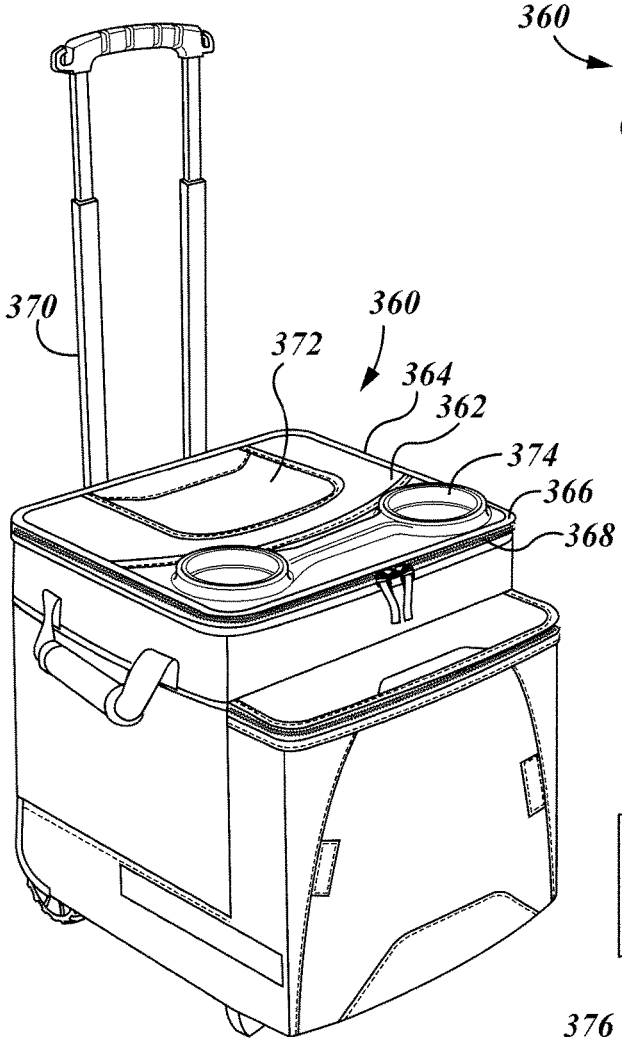
FIG. 11A is an isometric view of an alternate embodiment of soft-sided collapsible insulated container to that of FIG. 8A, as mounted on a wheeled cart.
Figure 11C:
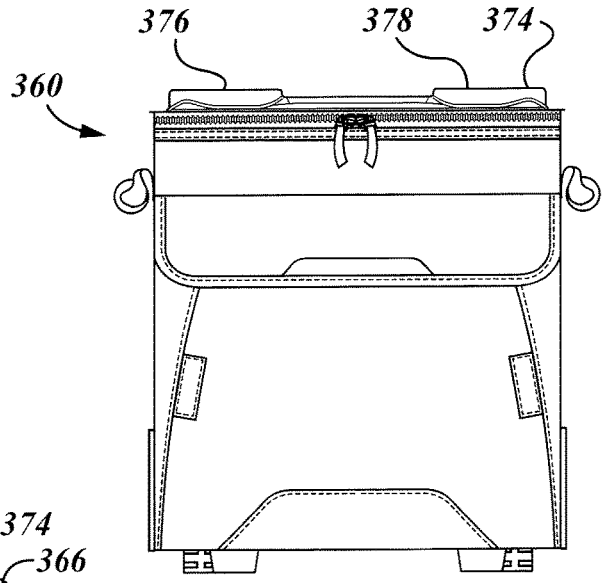
FIG. 11C is a front view of the alternate embodiment of FIG. 11A.
Figure 11B:
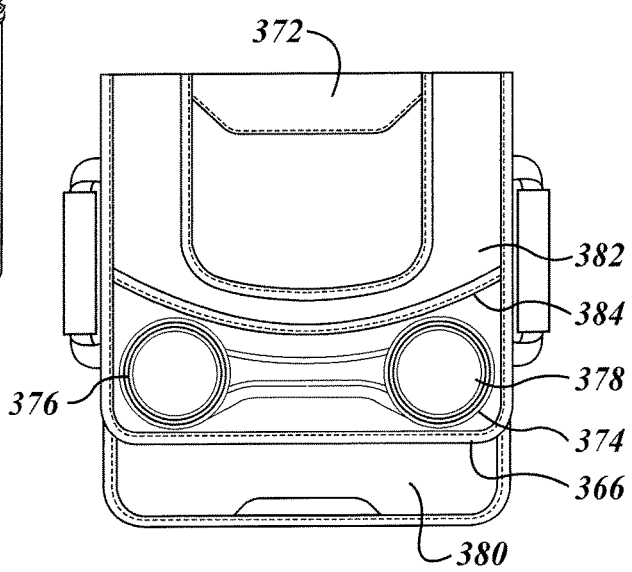
FIG. 11B is a top view of the alternate embodiment of FIG. 11A.

In the embodiment of FIGS. 11A, 11B, and 11C there is another collapsible insulated container, or container assembly 360, that is similar to collapsible insulated container assembly 300. It may be noted that container assembly 360 is provided in combination with a rolling cart 370, to which a container such as container assembly 320 might be mounted, with the bottom panel or wall of the container assembly sitting on a base or foot of the cart, and the back panel or wall attached by securement 352 to the upright handle shafts of the telescoping towing handle.

Assembly 360 differs from assembly 320 insofar as lid 362 has a proximal region or portion 364, and a distal portion 366. Lid 362 is releasably securable in place by a releasable closure securement member 368, which may be a zipper. In this instance, lid 362 is, bodily, the primary closure member or access member, of assembly 360. There is also a secondary closure member or access member, identified as inset panel 372, which, as before, is hingedly mounted along the rearward margin of lid 362, and opens toward distal portion 366. In this instance, distal portion 366 has a rigid member, or hard fitting, 374. As may be noted, hard fitting 374 has two accommodations 376, 378 as before, spaced apart and located at opposite front corners of lid 362. However, they are linked by a single, generally central channel or hat section 380, rather than the two spaced apart channel sections with a medial receptacle such as in assembly 300 in which to place snacks or other objects. Furthermore, the leading edge or margin 382 of distal portion 364 is curved, and the trailing edge or margin 384 of distal portion 366 (and of hard fitting 374) is similarly curved generally to conform to the leading edge of inset access panel 372 the larger curved opening.

Figure 11D:
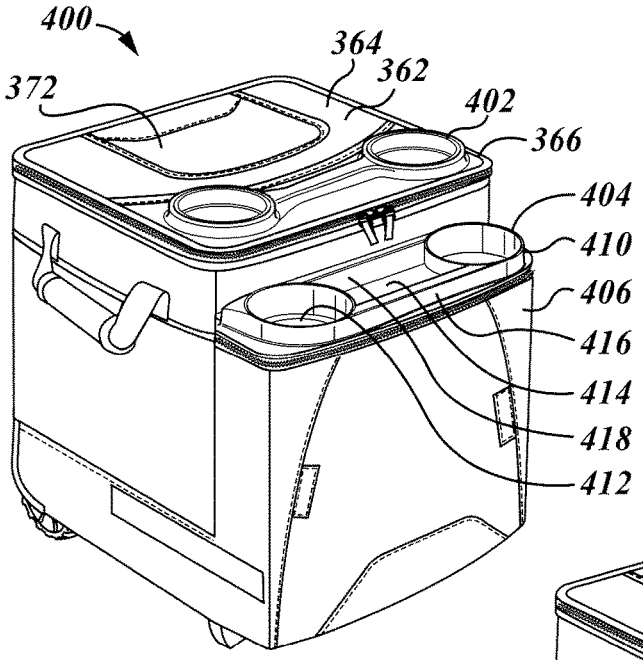
FIG. 11D is an isometric view of an alternate embodiment of soft-sided collapsible insulated container to that of FIG. 11A.
Figure 11E:
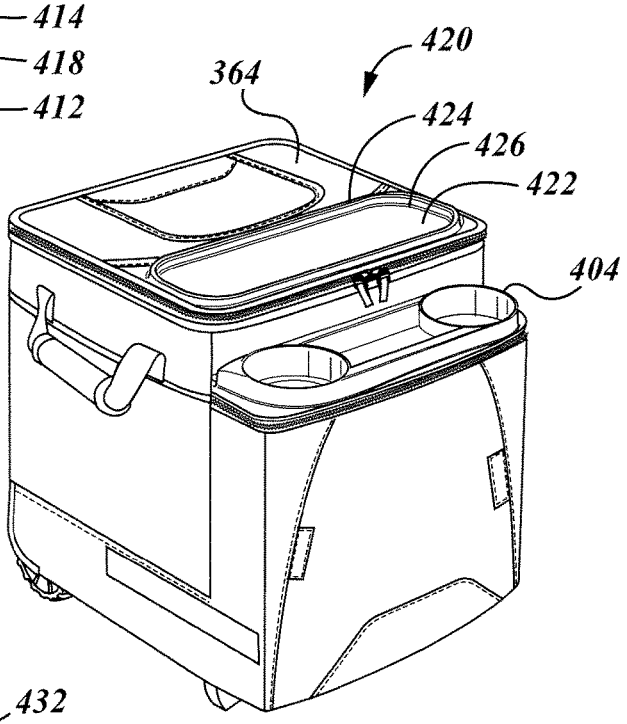
FIG. 11E is an isometric view of a further alternate embodiment of soft-sided collapsible insulated container to that of FIG. 11A.

The alternate embodiments of FIGS. 11D, 11C and 11E may be understood to have substantially the same, or the same, construction as the embodiment of FIG. 11A, except as otherwise noted. In each case, the soft-sided container assembly is collapsible, and may be such as to be suitable for mounting to cart 370.

Container assembly 400 of FIG. 11D is provided with both a top panel hard fitting 402, and a mid-height hard fitting 404 mounted to front wall auxiliary or secondary wall structure 406. Hard fitting 404 and secondary wall structure 406 may be substantially as shown and described in the mid-height retainer fitting of co-pending U.S. patent application Ser. No. 14/793,063 filed Jul. 7, 2015, and incorporated herein by reference. That is, wall structure 406 may be collapsible to move hard fitting 404 to a retracted or collapsed condition. Hard fitting 404 may be as shown therein, or may be similar to, or substantially the same as either hard fitting 320 or 374 shown and described herein. It may include receptacles, or accommodations or sockets, or drink holders, 410, 412. Hard fitting 404 may include a medial portion or web or base, or bottom panel or portion, 414 extending between accommodations 410, 412, and may have a front retainer, or retaining wall, or member, or rib, or lip, or rim, or channel, or flange, 416 such as may tend to discourage objects from slipping off portion 414. In that way, a lodgment, or working surface or niche may be formed, as may be suitable for holding condiments, cutlery, a paring knife, a bottle opener, and so on. Hard fitting 404 may also have a rear retainer or wall or rib or channel or flange, etc., identified as 418. Items 418 and 416 may be substantially the same, and may be symmetrically arranged, both left-to-right and back-to-front. Either or both may function as ribs or reinforcements or stiffeners, as may be. Hard fitting 404 may have a somewhat smaller front-to-rear dimension as compared to hard fitting 402, as auxiliary wall structure 406 may have less depth than that of hard fitting 402.

In the alternate embodiment of FIG. 11E, a container assembly 420 is substantially the same as assemblies 320 and 400, but differs from assembly 400 in having a mid-height, or lower, hard fitting, 404, but, in place of the upper fitting assembly 420 may have a substantially flat work surface, indicated as hard fitting 422. Fitting 422 may have a peripheral retainer or wall, or rim, or lip, as may be, indicated as rim 424. In one embodiment, rim 424 may be relatively low, as compared to the retainer wall or rim or lip of flange 416. In one embodiment it may be half the height or less. As before, however, the longitudinal distance of the hard fitting 422 in the top or lid panel 426 is, as in assemblies 320 and 400, less than half the distance from the rear hinge to the front wall. That is, the majority of the lid retains the soft-sided insulated construction of the bag generally, and may, accordingly, be flexible to roll or fold about the lower body of the assembly in the collapsed condition. In one embodiment, the fore-and-aft depth may correspond to the width of a slice of bread, being approximately 6 mm to 15 mm or ¼ inch to ⅝ of an inch and typically about ½ of an inch or 10-12 mm. However, hard fitting 422 may still provide a relatively flat surface, a working surface, on which to place objects or on which to cut or slice objects, whether fruit, or cheese, or cold cuts, for example.

Figure 11F:
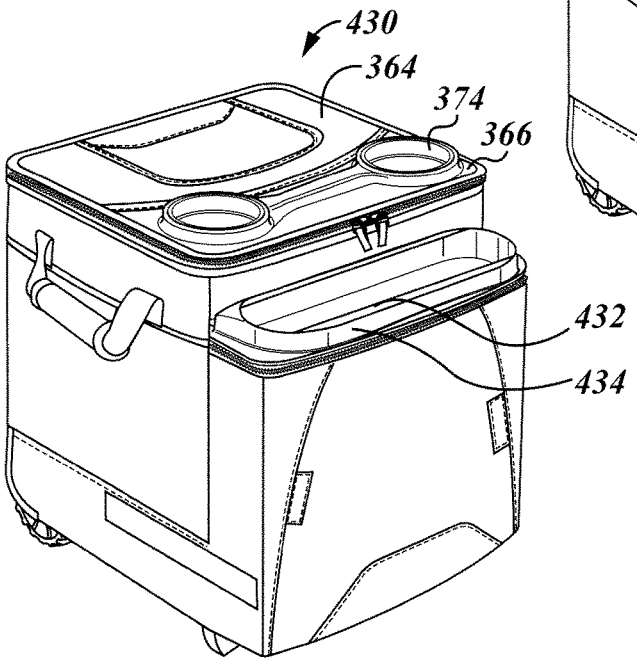
FIG. 11F is an isometric view of an alternate embodiment of soft-sided collapsible insulated container to that of FIG. 11A.

In the further alternative of FIG. 11F, a container assembly 430 is substantially the same as assemblies 320 and 400, but has the reverse arrangement to that of assembly 420 of FIG. 11E in the sense of having a hard or reinforced member in the lid for holding beverages, and a hard or reinforced member without beverage sockets, or drink pockets, in the medial height tray. That is, the mid-height hard fitting 432 defines accommodation or central tray area, or region, or portion, which may be bounded either partially or entirely by a peripheral wall or rim or lip 434. The tray may protrude into the underlying enclosure, as in the manner of well 328. It may have a flat bottom, and, depending on the height of the surrounding wall, may provide a cutting surface. In another embodiment, the peripheral wall may be relatively high, perhaps half an inch or more, to form a holder for cut vegetables, such as carrots or celery, or for lemon, lime or other slices. It may also be used as a tray for condiments or cutlery, for example.

Figure 12A:
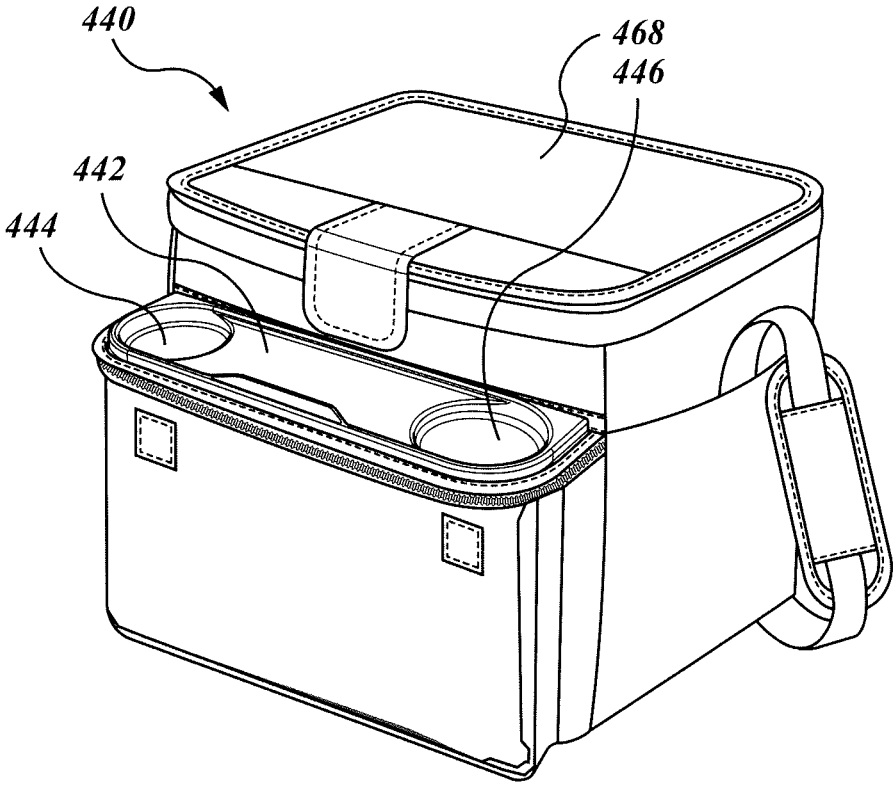
FIG. 12A is an isometric view of an alternate embodiment of soft-sided collapsible insulated container to that of FIG. 8A having a mid-level reinforced member.
Figure 12B:
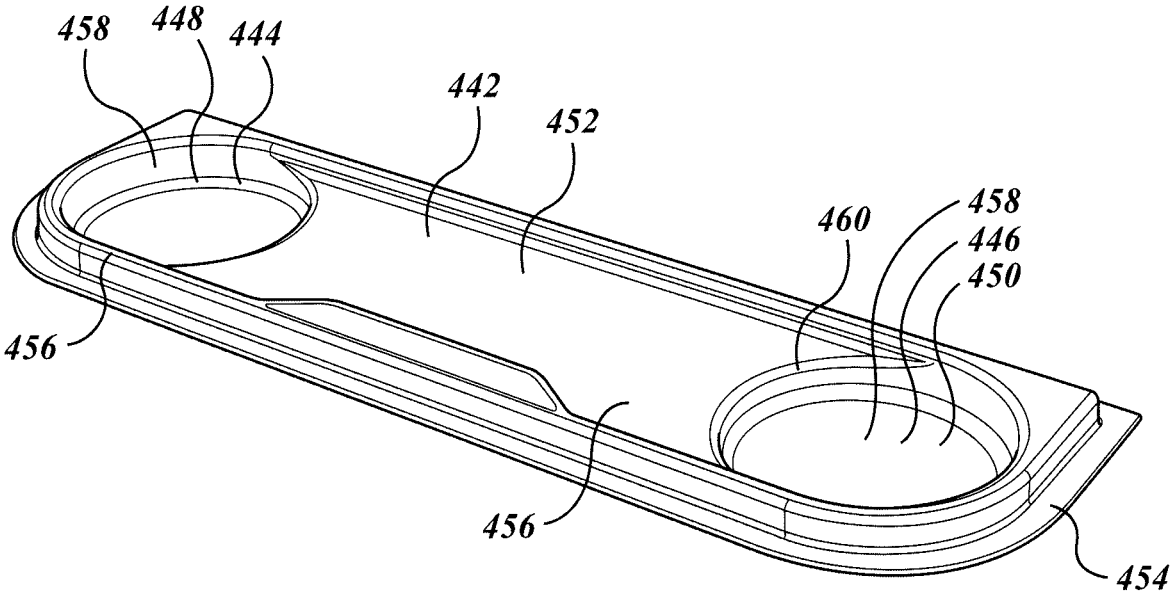
FIG. 12B is an isometric view of a hard reinforcement member of the alternate embodiment of FIG. 11A.
Figure 12C:
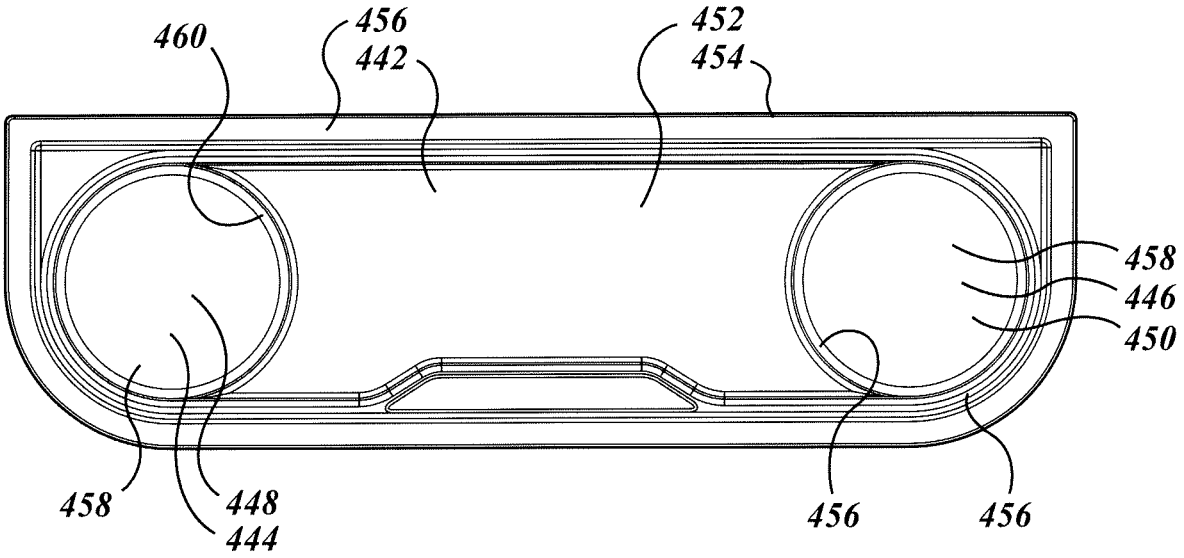
FIG. 12C is a top view of the reinforcement of FIG. 12B.
Figure 12D:
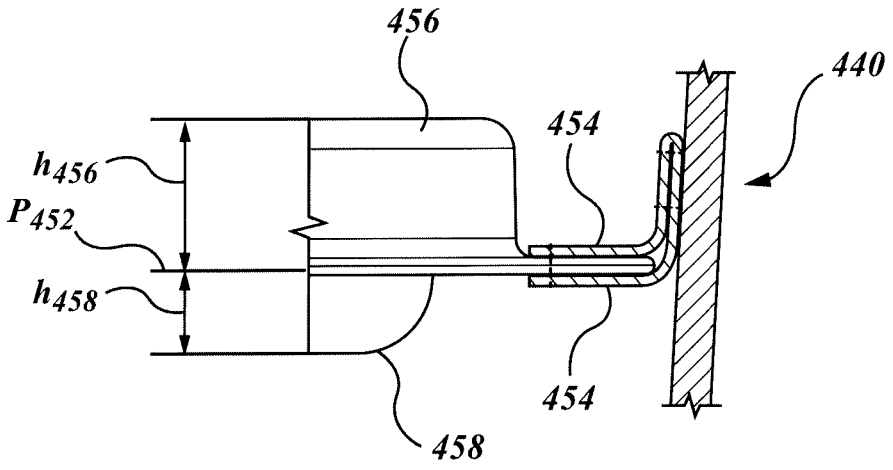
FIG. 12D is a detail of the connection of the reinforcement of FIG. 12B to the main structure of the embodiment of FIG. 12A.

In the embodiment of FIG. 12A there is a soft-sided cooler assembly 440 such as may be understood to be the same, or substantially the same, as found in U.S. Ser. No. 14/793,063 filed Jul. 7, 2015, the illustrations and description thereof being incorporated herein by reference. Unless stated otherwise, assembly 440 may be understood to have the same features of construction as previously described therein. Container assembly 440 may be manufactured in various configurations including a reinforced member in the lid, as previously described, or at mid-level, as shown and as previously described, or both. Assembly 440 may include a reinforced member or working surface member 442 as shown in FIGS. 12B, 12C and 12D. As can be seen member 442 includes first and second ends 444, 446 at which there are wells or sockets, or beverage retainers, or drink pockets 448, 450 respectively, connected by a medial web portion 452. Medial web portion 452 may be substantially planar and may define a working surface intermediate the beverage retainers. Web portion 452 may lie in the same, or substantially the same, plane $P_{452}$ as peripheral mounting or attachment flange 454. As seen, member 442 has a raised peripheral wall 456 that stands outwardly of plane $P_{452}$, the outward distance being indicated as dimension or height $h_{456}$. Raised peripheral wall 456 may be of hollow section, that is, it may be a top hat or channel section. Pockets 448, 450 have well bottoms 458 that stand inwardly in a sunken or depressed relationship relative to web portion 452, the inward distance being shown as $h_{458}$. As may be noted the inward portion of the well has a full circumferential wall 460 that defines a retainer that discourages motion in all directions in the plane of web portion 452. By contrast, the raised outer peripheral wall extends around the outer semi-circle but not around the inner semi-circle. The manner of securement to the main structure is shown in FIG. 12D, in which the fabric attachment 464 is sewn through the external, outwardly extending flange, and also sewn to, for example, the front wall of the upstanding insulated wall structure of the main body of container assembly 440. Member 442 could also be mounted in the lid 468 in a manner the same as or analogous to that indicated above.

Figure 13A:
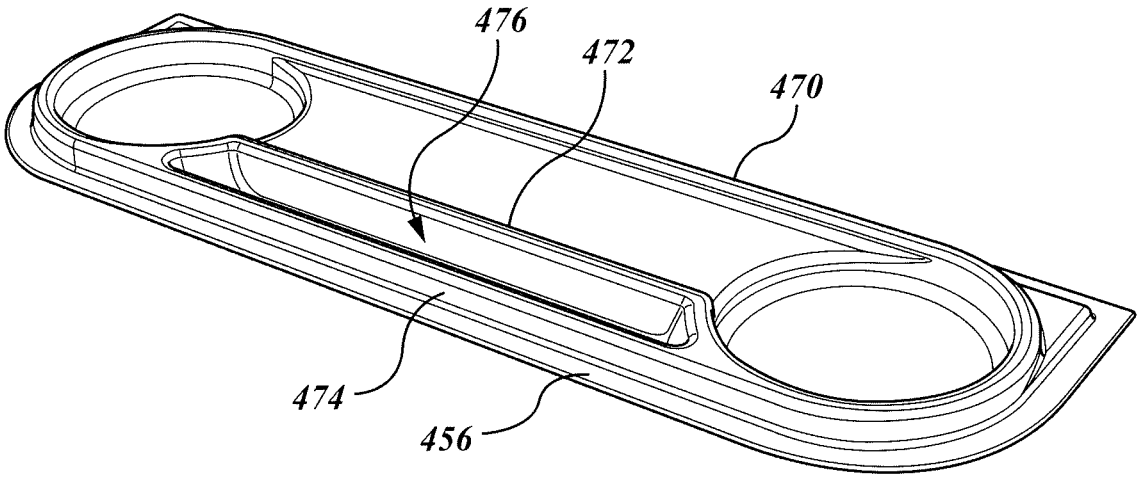
FIG. 13A is an isometric view of an alternate reinforcement to that of FIG. 12B.
Figure 13B:
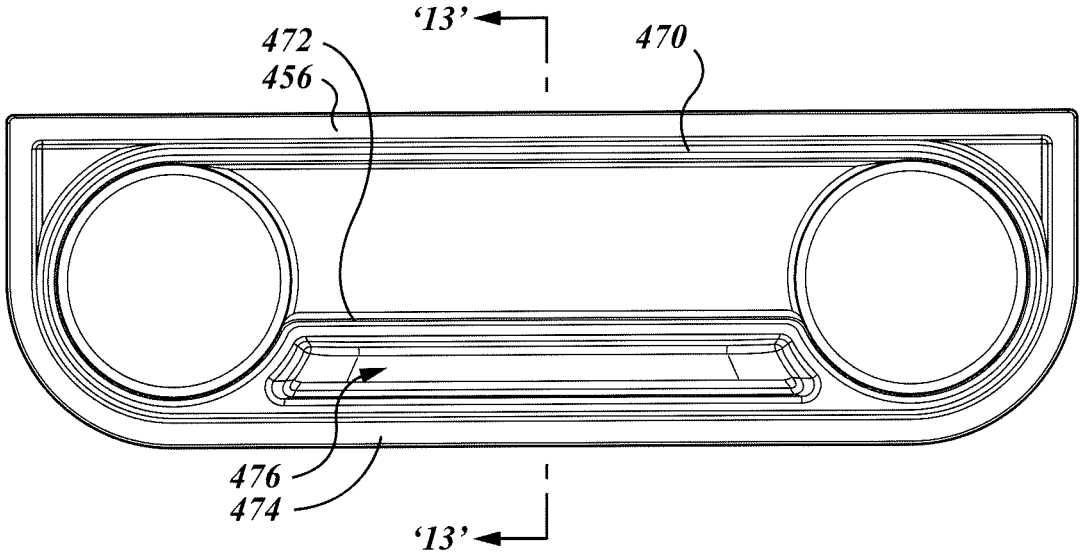
FIG. 13B is a top view of the reinforcement of FIG. 13A.
Figure 13C:
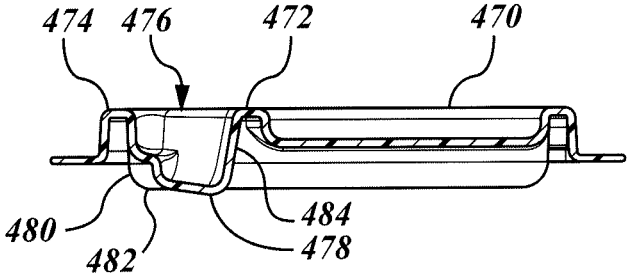
FIG. 13C is a sectional view of the reinforcement of FIG. 13A taken on '13C-13C'.

In the embodiment of FIGS. 13A, 13B and 13C there is a reinforcement member 470 that is substantially similar to member 442. However, in addition to the outer peripheral wall 456, member 470 also has a spaced inner wall 472 running along, in a spaced apart, parallel manner relative to the forward, or outermost sector 474 of wall 456, such that a well, socket, seat, shelf, ledge, retainer, footing, step, or accommodation 476 is formed in which to receive, for example, the lower margin of a portable electronic communications device, such as an i-Pad™. The accommodation may itself have an internal step, ledge, or index 478, such that accommodation 476 has a wide measure or seat 480, for receiving relatively wider devices, and also a narrow measure, or seat, 482 for receiving relatively narrower devices. The rearward or inner wall 484 may be slanted, as shown, such that a device seated therein may have a slant, or backward slope, or lean, such that the device is tilted or canted backward somewhat. The depth of accommodation 476 may extend inwardly beyond the plane of the reinforcement mounting flanges more generally, and may extend the same distance as the drink retainer wells.

Figure 14A:
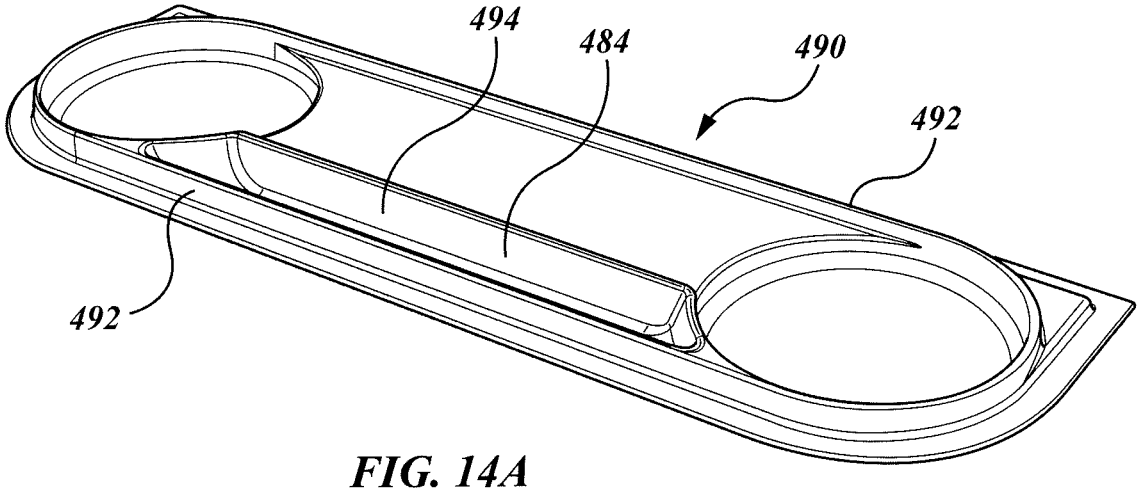
FIG. 14A is an isometric view of an alternate reinforcement to that of FIG. 12B.
Figure 14B:
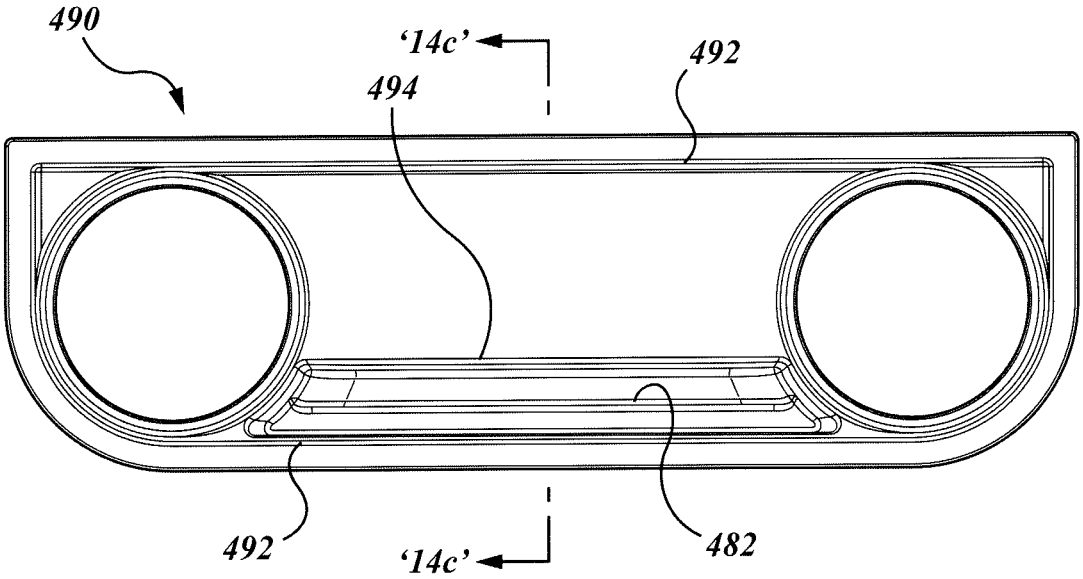
FIG. 14B is a top view of the reinforcement of FIG. 14A.
Figure 14C:
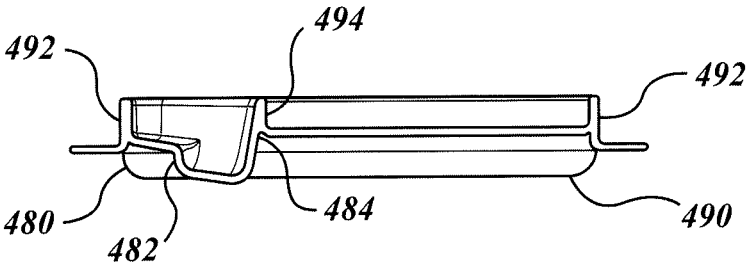
FIG. 14C is a sectional view of the reinforcement of FIG. 14A taken on '14C-14C'.

In the embodiment of FIGS. 14A, 14B and 14C, a reinforcement member 490 is the same as, or substantially similar to, member 470, but rather than employing channel sections, peripheral wall 492 and retainer wall 494 are single webs.

Figure 8A:
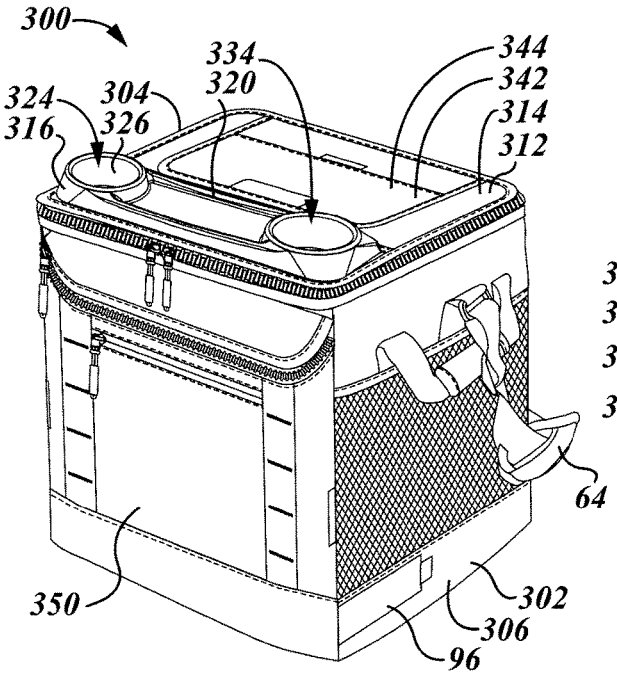
FIG. 8A shows an isometric view of an alternate embodiment of collapsible, soft-sided insulated container to that of FIG. 1A in a deployed or expanded condition.
Figure 8H:
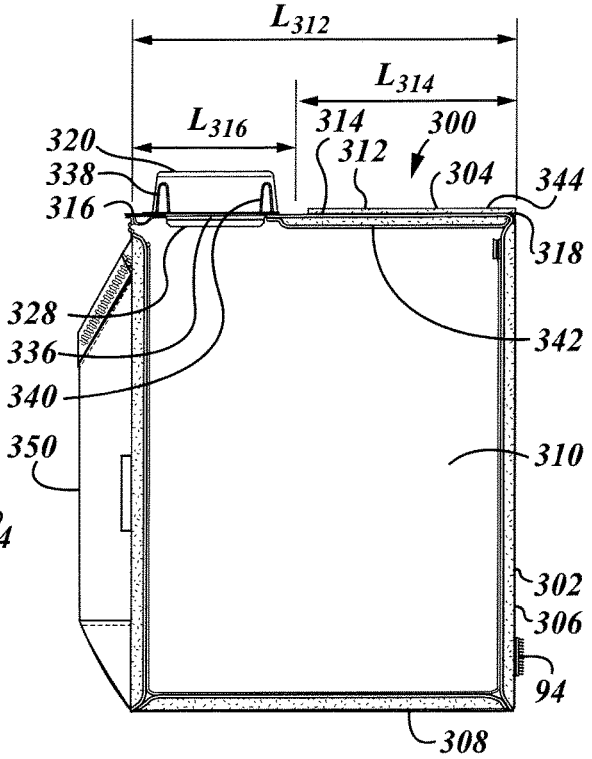
FIG. 8H is a cross-sectional view of the container assembly of FIG. 8A taken on the centerline plane of symmetry.
Figure 8B:
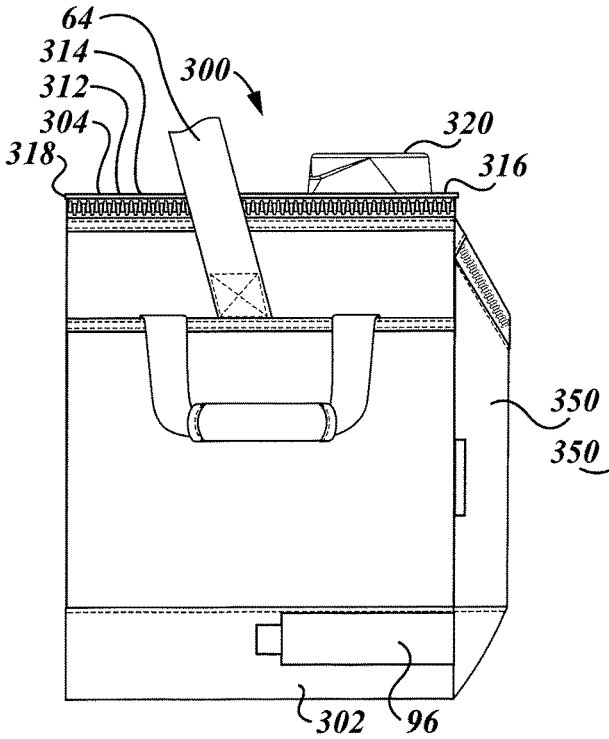
FIG. 8B is a right hand side view of the container of FIG. 8A.
Figure 8C:
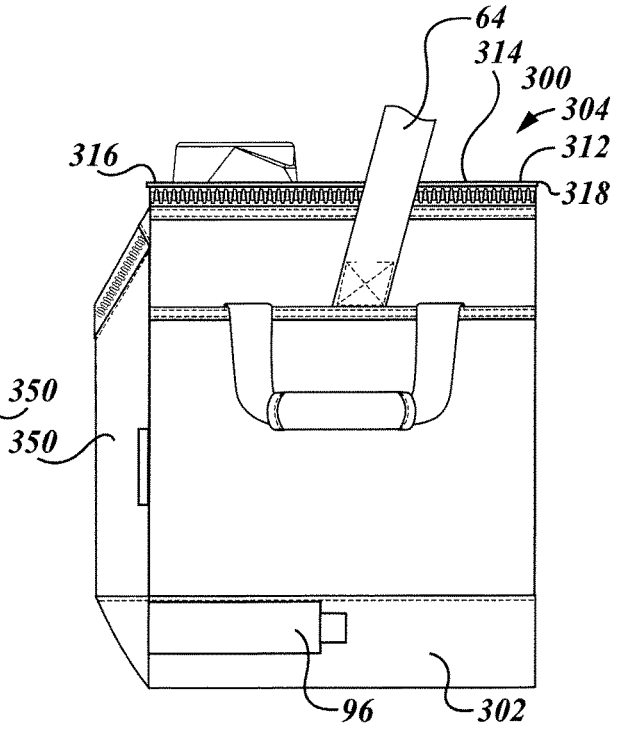
FIG. 8C is a left hand side view of the container of FIG. 8A.
Figure 8E:
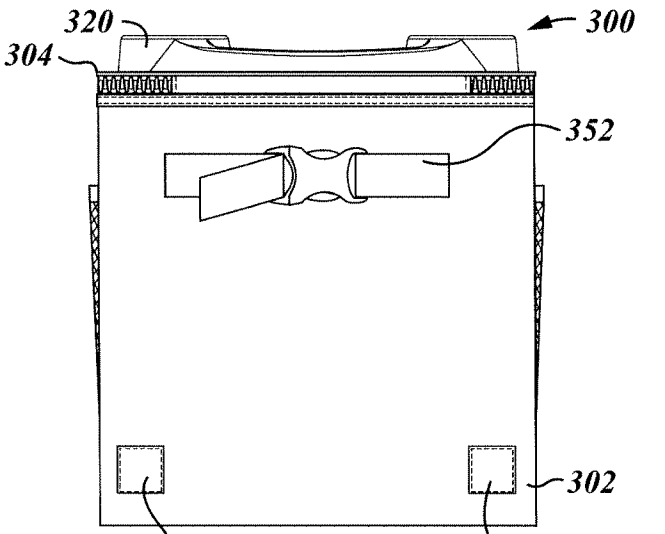
FIG. 8E is a rear view of the container of FIG. 8A.
Figure 8G:
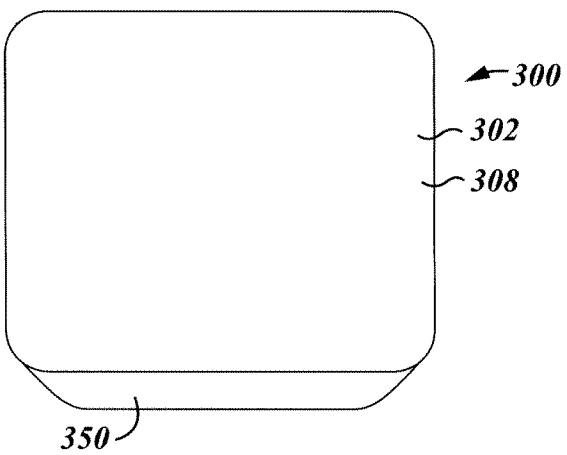
FIG. 8G is a bottom view of the container of FIG. 8A.
Figure 8D:
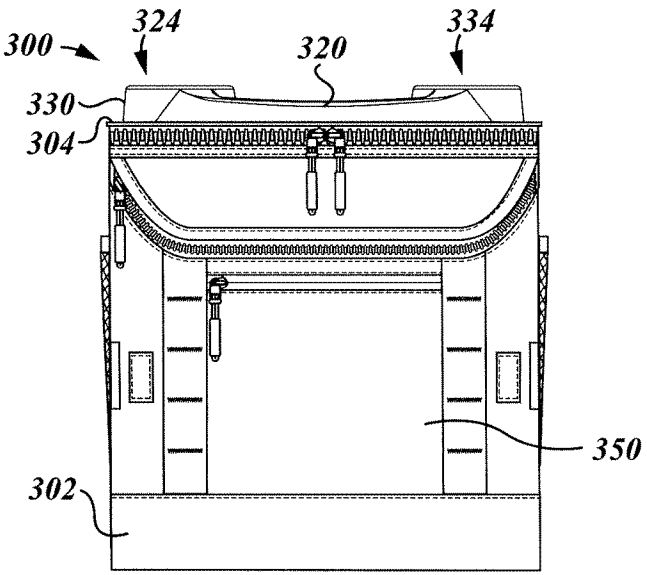
FIG. 8D is a front view of the container of FIG. 8A.
Figure 8F:
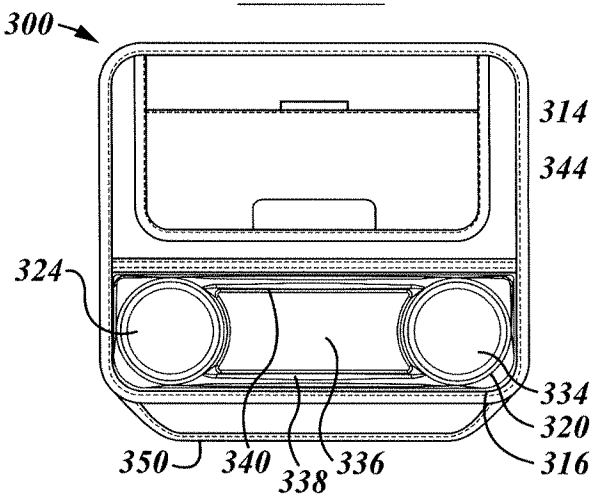
FIG. 8F is a top view of the container of FIG. 8A.
Figure 9A:
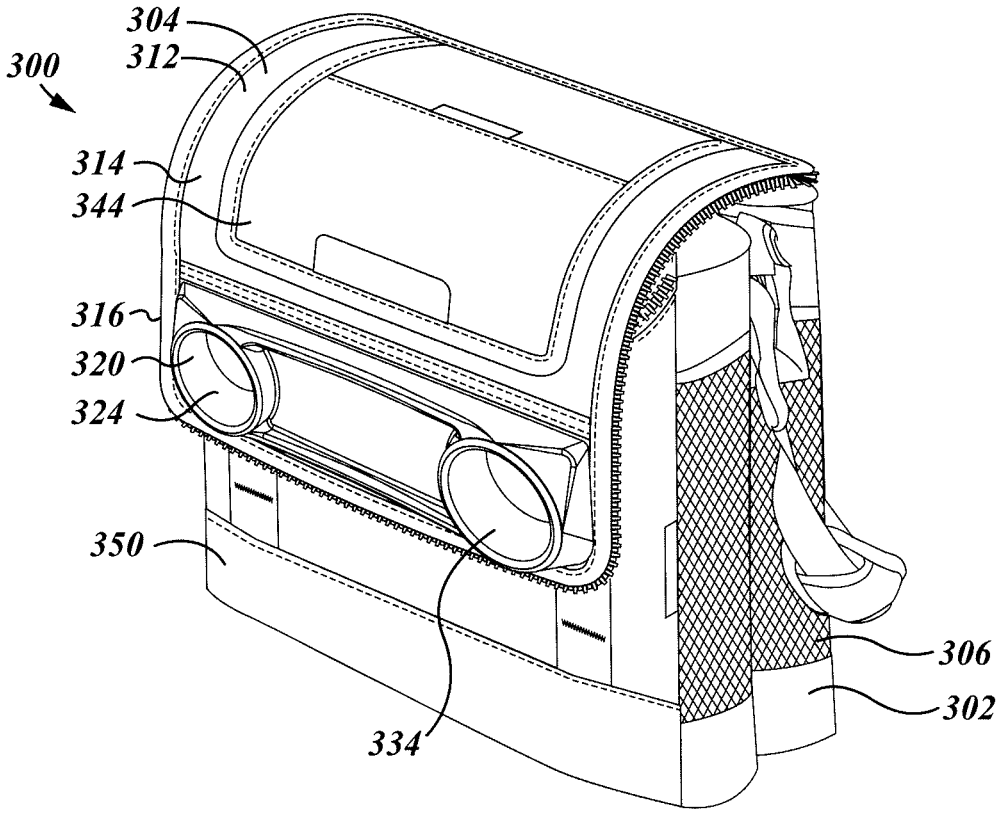
FIG. 9A shows an isometric view of the collapsible, soft-sided insulated container of FIG. 8A in retracted, storage, or collapsed condition.
Figure 9B:
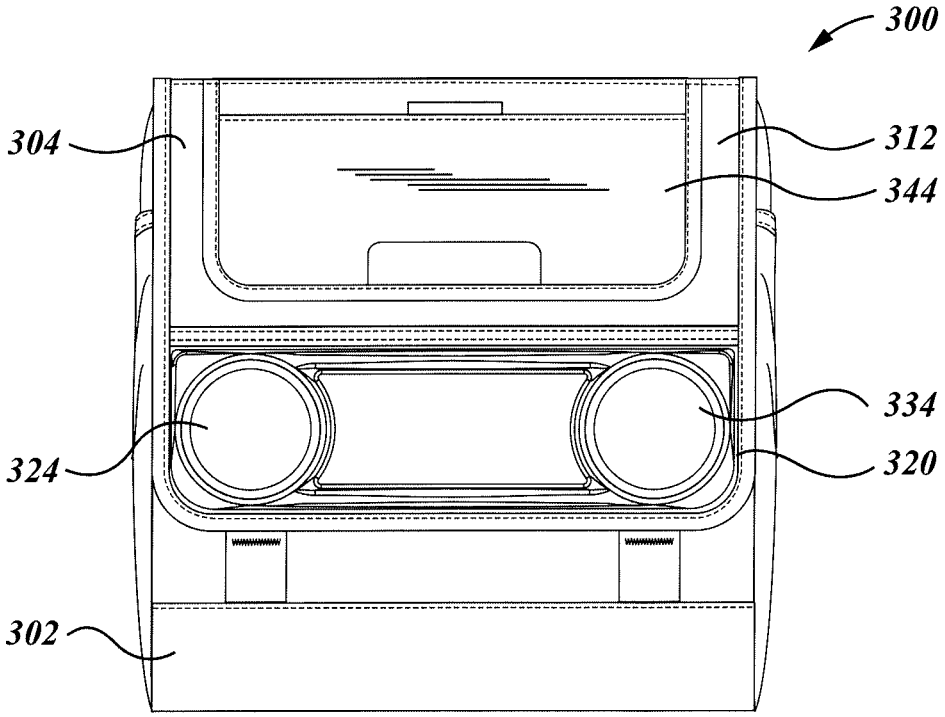
FIG. 9B is a front view of the container of FIG. 9A.
Figure 9E:
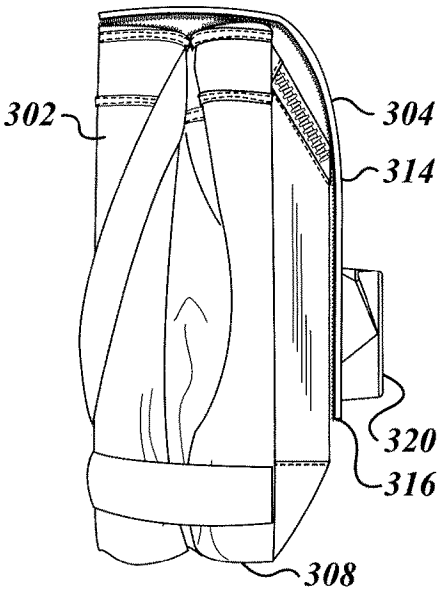
FIG. 9E is a left hand side view of the container of FIG. 9A.
Figure 9D:
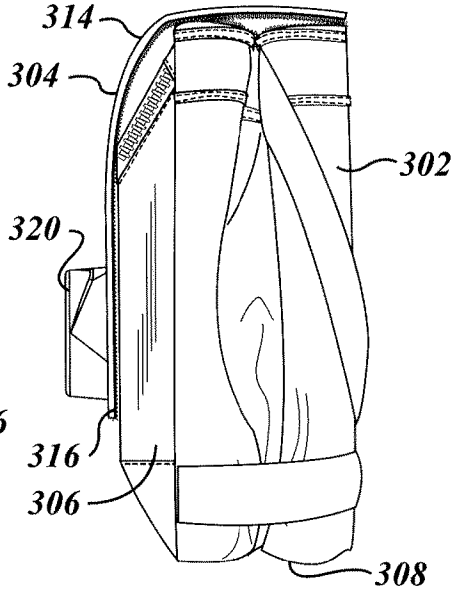
FIG. 9D is a right hand side view of the container of FIG. 9A.
Figure 9C:
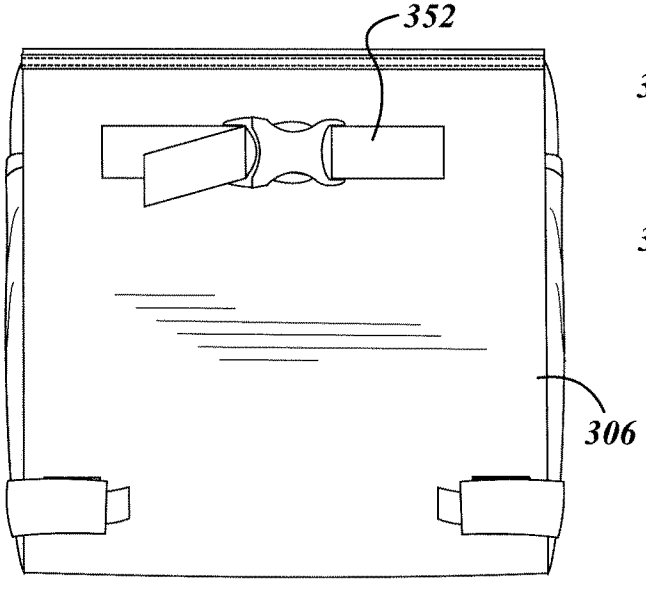
FIG. 9C is a rear view of the container of FIG. 9A.
Figure 9G:
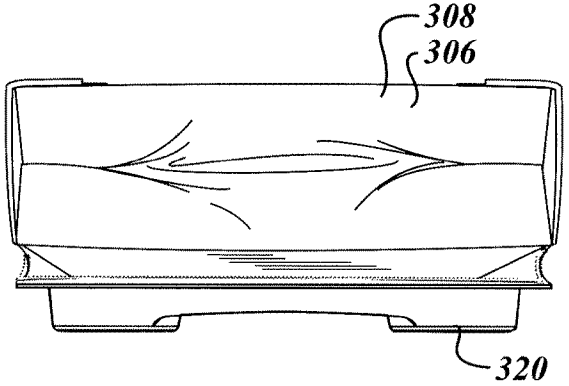
FIG. 9G is a bottom view of the container of FIG. 9A.
Figure 9F:
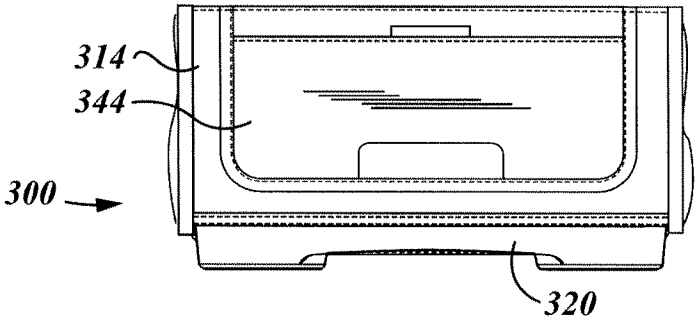
FIG. 9F is a top view of the container of FIG. 9A.
Figure 10A:
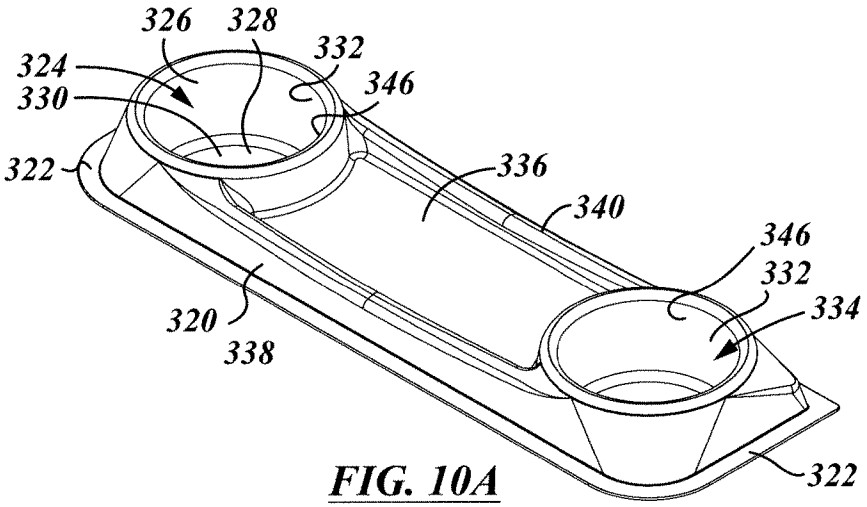
FIG. 10A is a perspective view of a hard fitting for the lid of the container of FIG. 8A.
Figure 10D:
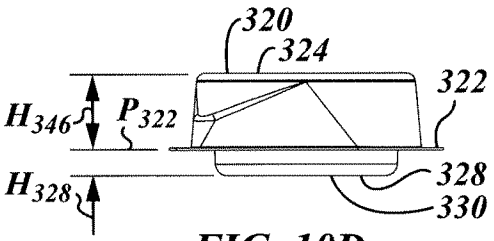
FIG. 10D is a right hand side view of the hard fitting of FIG. 10A.
Figure 10E:
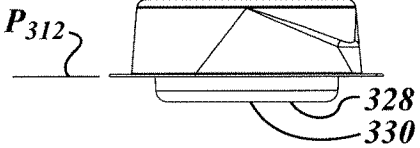
FIG. 10E is a left hand side view of the hard fitting of FIG. 10A.
Figure 10B:
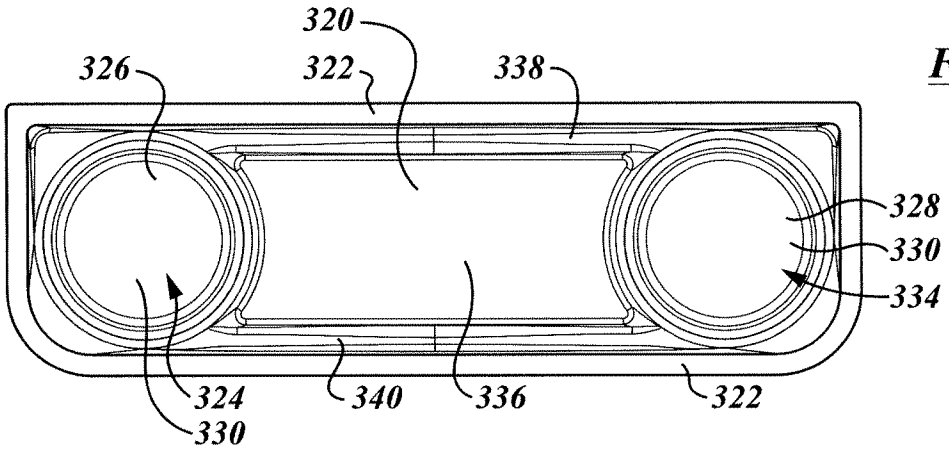
FIG. 10B is a top view of the hard fitting of FIG. 10A.
Figure 10C:
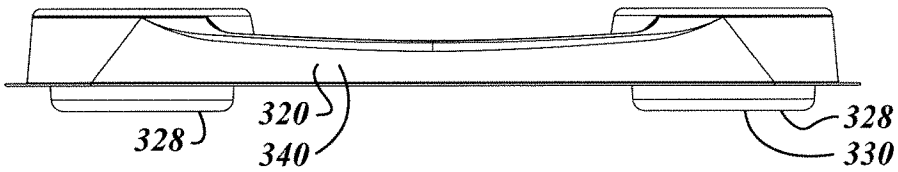
FIG. 10C is a front view of the hard fitting of FIG. 10A.
Figure 15A:
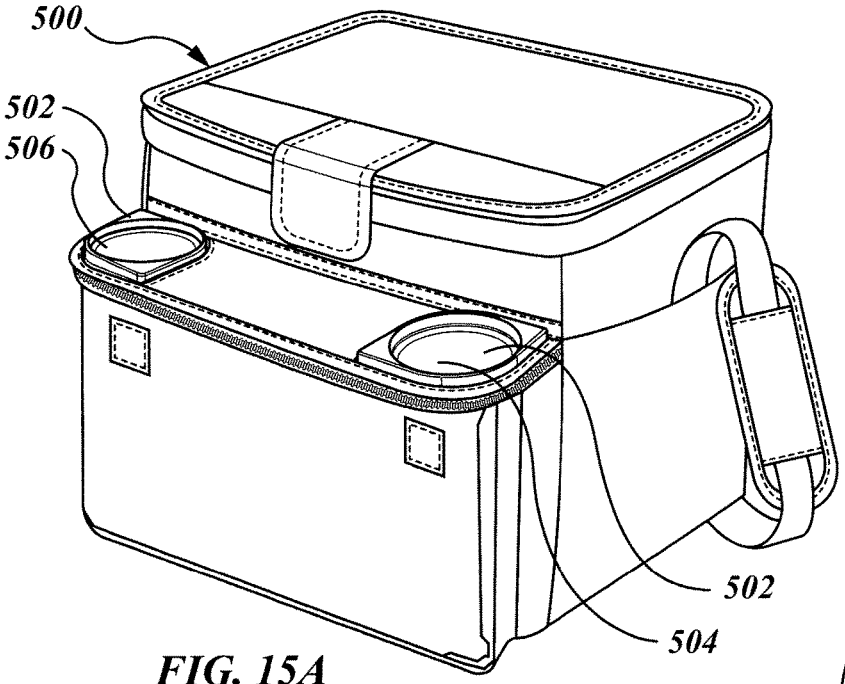
FIG. 15A is an isometric view of an alternate embodiment to that of FIG. 12A.
Figure 15B:
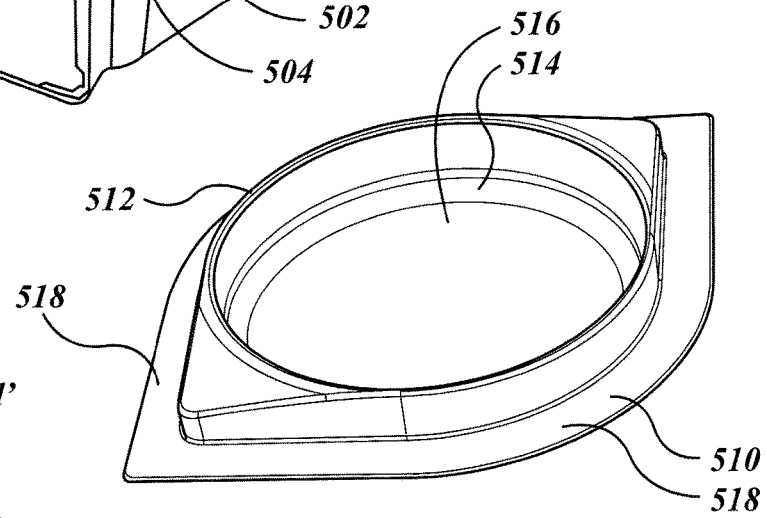
FIG. 15B is an isometric view of an alternate embodiment of hard member to that of the reinforcement of FIG. 12B.
Figure 15C:
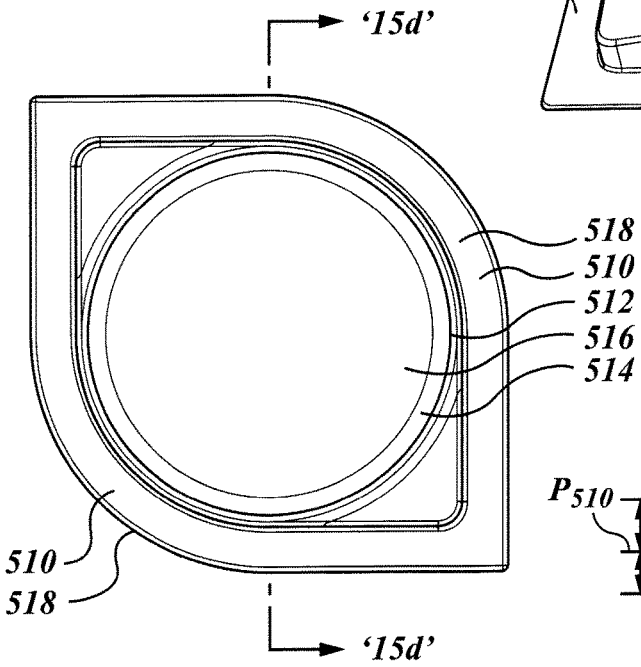
FIG. 15C is a top view of the alternate embodiment of FIG. 15A.
Figure 15D:
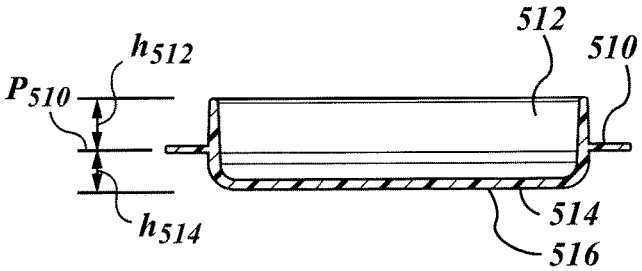
FIG. 15D is a cross-section of the hard member of FIG. 15C taken on '15D-15D'.
Figure 16A:
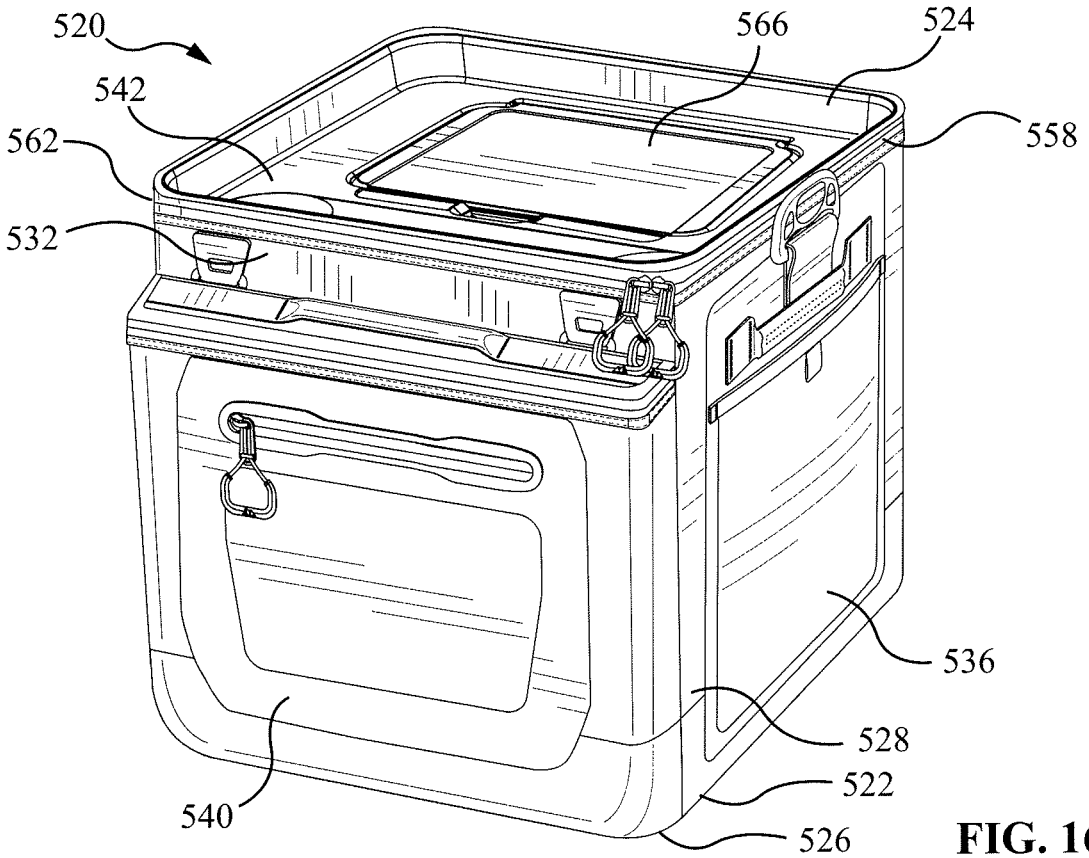
FIG. 16A is a perspective view from the front, left, and slightly above of an alternate embodiment of soft-sided insulated container to that of FIG. 3A or 11A.
Figure 16B:
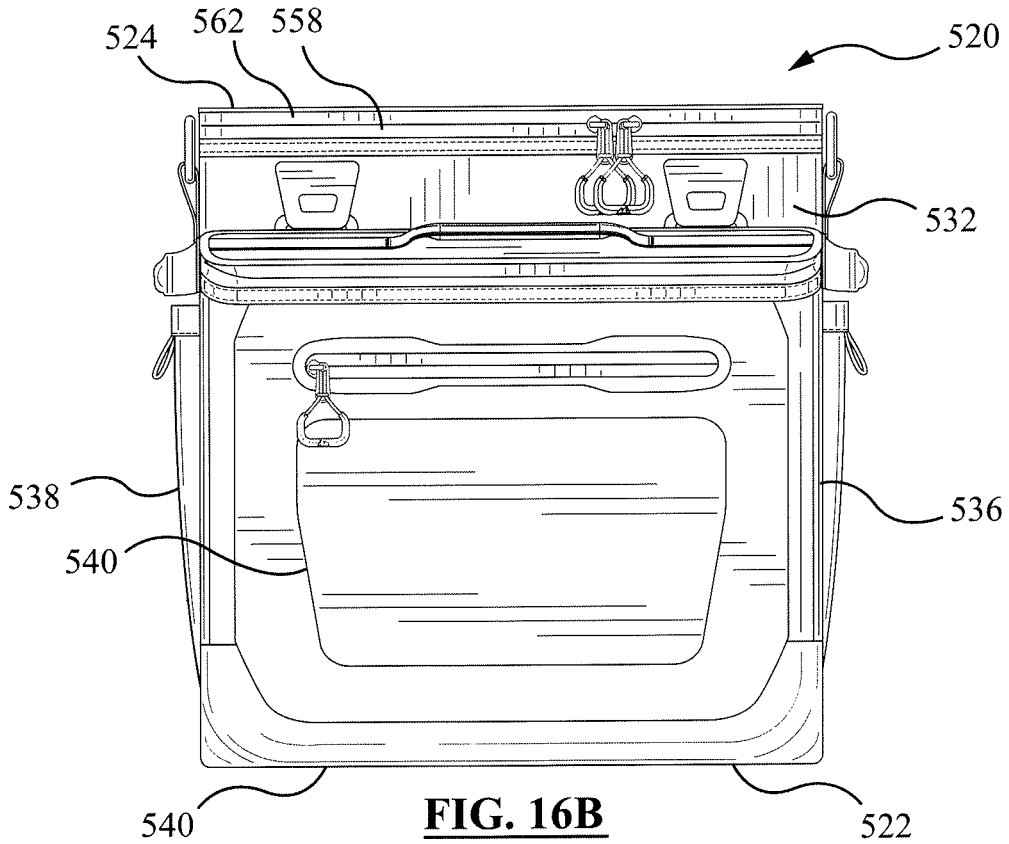
FIG. 16B is a front view of the soft-sided insulated container of FIG. 16A.
Figure 16C:
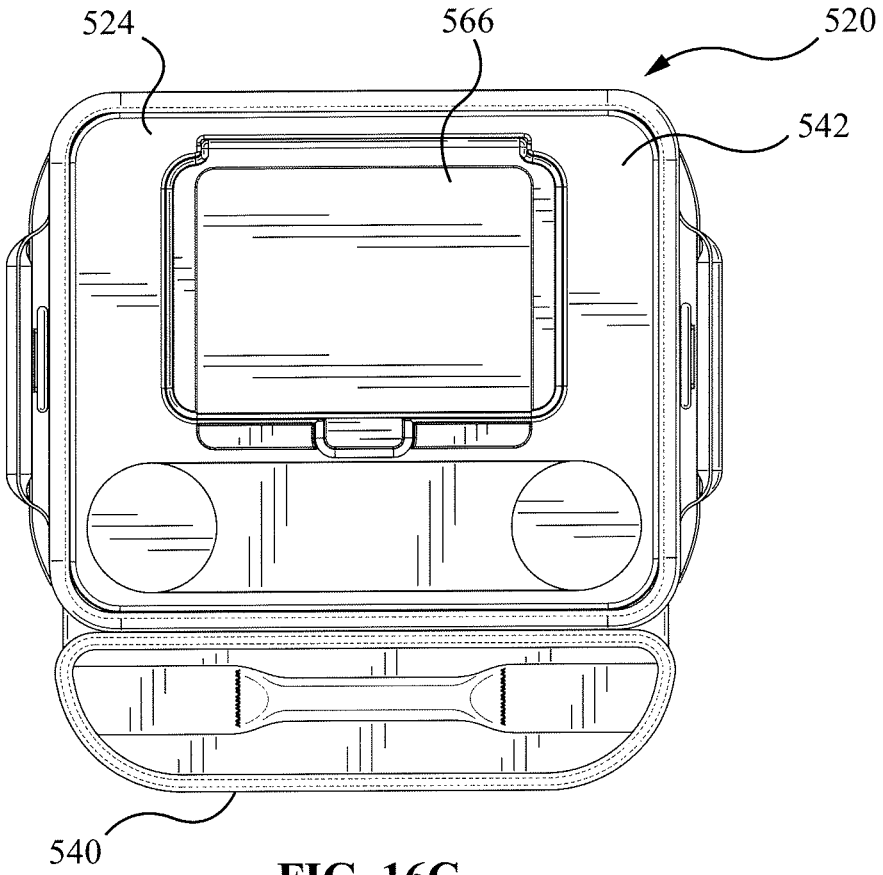
FIG. 16C is a top view of the soft-sided insulated container of FIG. 16A.
Figure 16D:
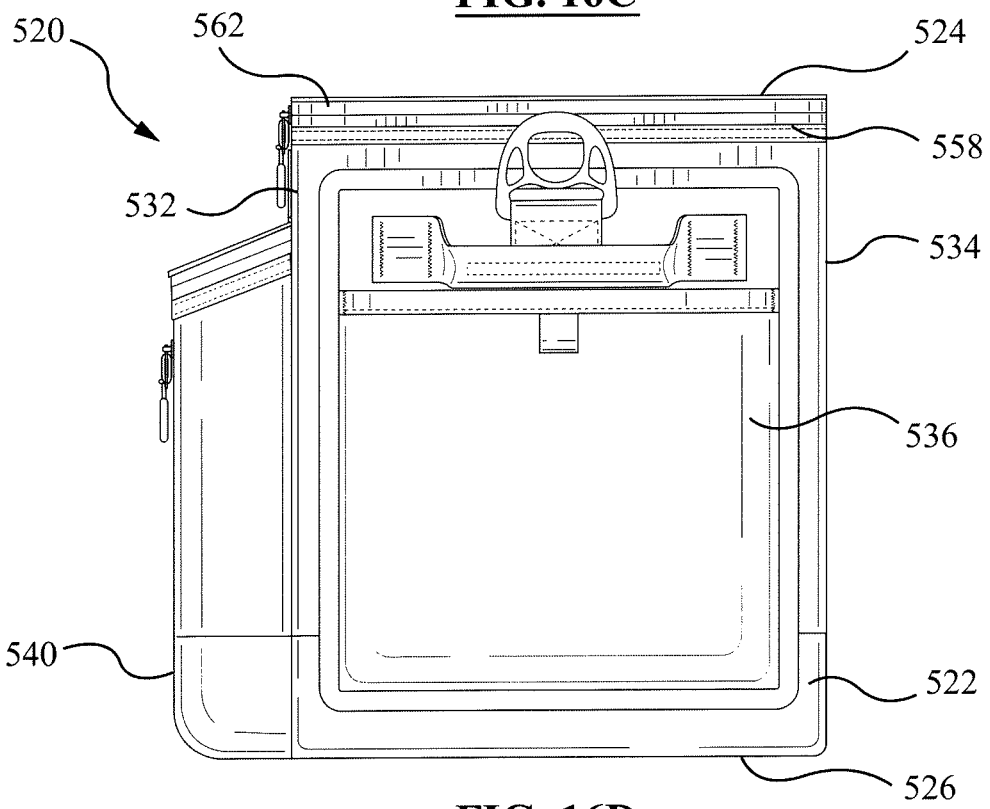
FIG. 16D is a left side, or left end, view of the soft-sided insulated container assembly of FIG. 16A, the right hand side, or right hand end being the mirror opposite.

In the embodiment of FIGS. 15A, 15B, 15C and 15D, soft-sided insulated container assembly 500 is substantially the same as container assembly 300 or 440, except that rather than having a full width reinforcement or work surface member, assembly 500 employs one or more hard fittings 502 such as may be located at the mid-level expansion lid corners, as shown in FIG. 15A, or at the corners of the main lid, analogous to FIG. 8A. The left hand corner fitting 504 may be made the same as the right hand corner fitting 506, such that only a single mold need be used. Each corner fitting has a main flange 510 that lies in the plane of the adjacent web, be it of the mid-level lid or the main lid, as may be, a raised peripheral retaining wall 512 the stands outwardly (i.e., typically upwardly) proud of flange 510 a distance $h_{512}$, and a well and well bottom 514, 516 that lie inwardly sunken, or shy of, the plane $P_{510}$ of flange 510 a distance $h_{514}$. As with the other embodiments, the inward distance of the well of the beverage retainer may correspond to, or be slightly deeper than, the thickness of the underlying insulated fabric wall, or if there is no underlying wall, the thickness of the wall insulation of the vertical sidewalls. The height of the upstanding retainer wall is typically greater than the depth of the sunken well, such that most of the retaining depth lies above, or outwardly of, the plane of the flange.

Flange 510 provides a stitching attachment interface, as above, by which the respective corner fitting may be secured to the fabric of the cover or to the corner or edge seam or beading. At least one edge or region or portion 518 of flange 510 may be radiused to follow, or to set, the curvature of the corner of the panel, and of that portion of the container. In one embodiment two opposed curved portions 518 may be used such that the fitting has two diagonally opposed pointed corners. Although the embodiment of container assembly 500 lacks a fully extending lateral hard plastic web, the use of hardened corner fitting may still tend to stiffen the structure to some extent nonetheless.

In the embodiment of FIGS. 16A-16D and 17A-17D, a soft-sided insulated container assembly is indicated generally as 520. As in the embodiments described above, it has a first portion 522 and a second portion 524. First portion 522 may be, and in the illustrated embodiment is, the bottom or main portion of the container, and second portion 524 is the top portion, or top assembly, or lid, or lid assembly, however it may be called, of container assembly 520. In the embodiment shown, lid assembly 524 is hingedly joined to the main body portion along the upper rear margin of main body portion 522, and is movable between first and second, or open and closed positions to govern access to an internal chamber 530.

Main body portion 522 has a bottom wall 526 and an upstanding peripheral sidewall 528 that extends about the periphery of bottom wall 526. Peripheral sidewall 528 includes a front wall or front wall panel 532, a rear wall panel 534, a right hand side or right hand end 536, and a left hand end 538. Main body portion 522 may include a secondary compartment structure 540 that may be similar to, or largely the same as the front compartment structures described above, and may include, or not, a secondary work surface structure as described above. To this point, the design, structure, and materials of main body portion 522 may be substantially the same as the various main body portions described above. It may or may not have a rigid liner. Upstanding peripheral sidewall 528 and bottom wall 526 co-operate to form an open-topped five-sided box having chamber 530 defined therewithin.

The lid portion, namely lid assembly 524 differs from the lids and lid portions described above insofar as it includes a "deep dish" structure, which may be made as a rigid molding, such as may be made from a substantially rigid material, be it an injection molded part of a blow molded part, or similar item. That is, lid assembly 524 may include a main structural member 542 that includes a main panel 544, or base wall, or web, that, when the lid is closed, extends spanwise from side to side and front-to-back of member 542. Main panel 544 is surrounded by a turned-up peripheral wall, or flange, or rim 546 that has a front portion 548, a rear portion 550, a left hand portion 552 and a right hand portion 554. In the example shown, the uppermost margin of each of the various portions includes a corresponding portion of an out-turned peripheral lip or flange 560, which, itself, forms a flange relative to up-turned peripheral wall 546, flange 560 having portions corresponding to the front, rear, and side portions of peripheral wall 546. The combination of main panel 544, flange 546 and flange 560 is effectively to provide a Z-section running around the margin of the lid. A strip of fabric 562 may be mounted to the outside face of flange 546. Along one portion, a fabric hinge is formed, as in the embodiments above, to join the rear edge or margin of lid assembly 524 to main body assembly 522. A closure member, such as a tracked fastener such as a zipper 558 may run around the remaining three sides of the closure, with one half of the zipper teeth sewn to the lowermost margin of strip of fabric 562 along the three non-hinged sides (i.e., the front, left, and right). Zipper 558 constitutes a securement that releasably retains lid assembly 524 in the closed position. The teeth of zipper 558 may lie on the outside of the peripheral flange 546, such that it provides a flat surface for the zipper to run against. Moreover, in this circumstance, the main web, or flat portion of main structural member 542 which defines working surface 574 lies at a level that may be roughly level with, or below, the level of the join of the zipper teeth when engaged.

Figure 17A:
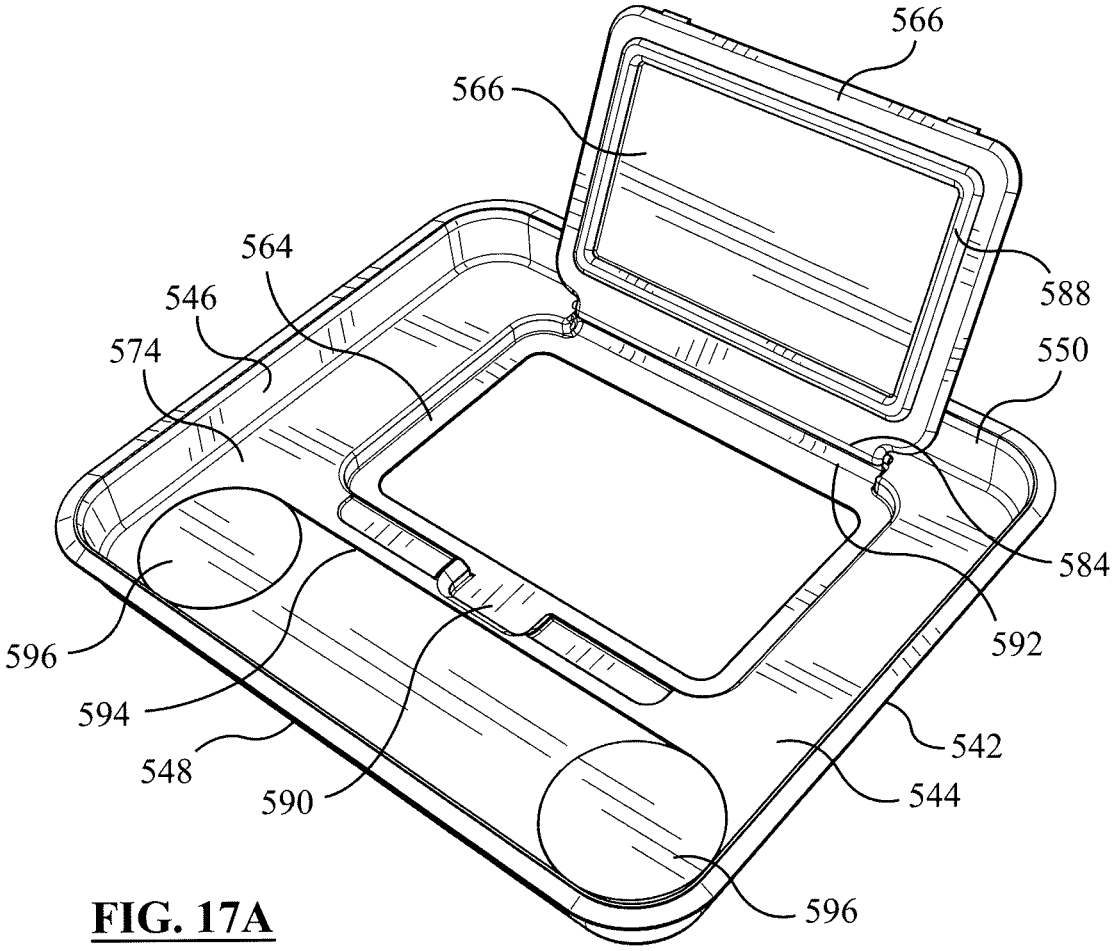
FIG. 17A shows a perspective view from in front, above, and to the left of a lid assembly of the soft-sided insulated container of FIG. 16A, with an inset door in an open condition or configuration.
Figure 17B:
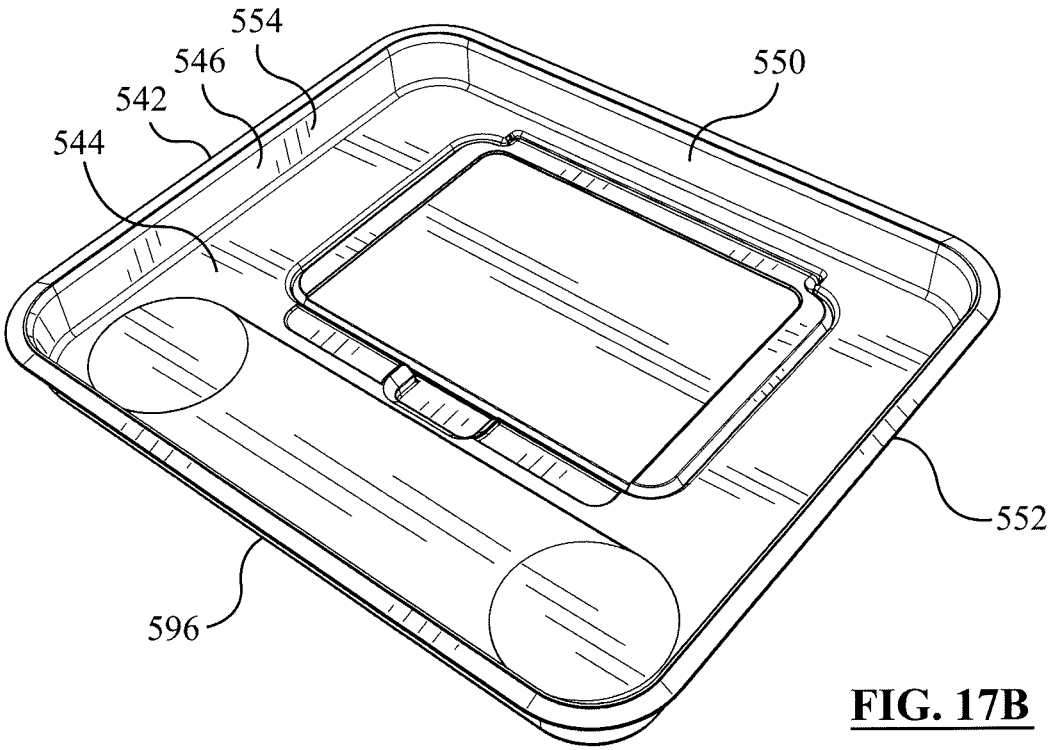
FIG. 17B shows a perspective view of the lid assembly of FIG. 17A from below.
Figure 17C:
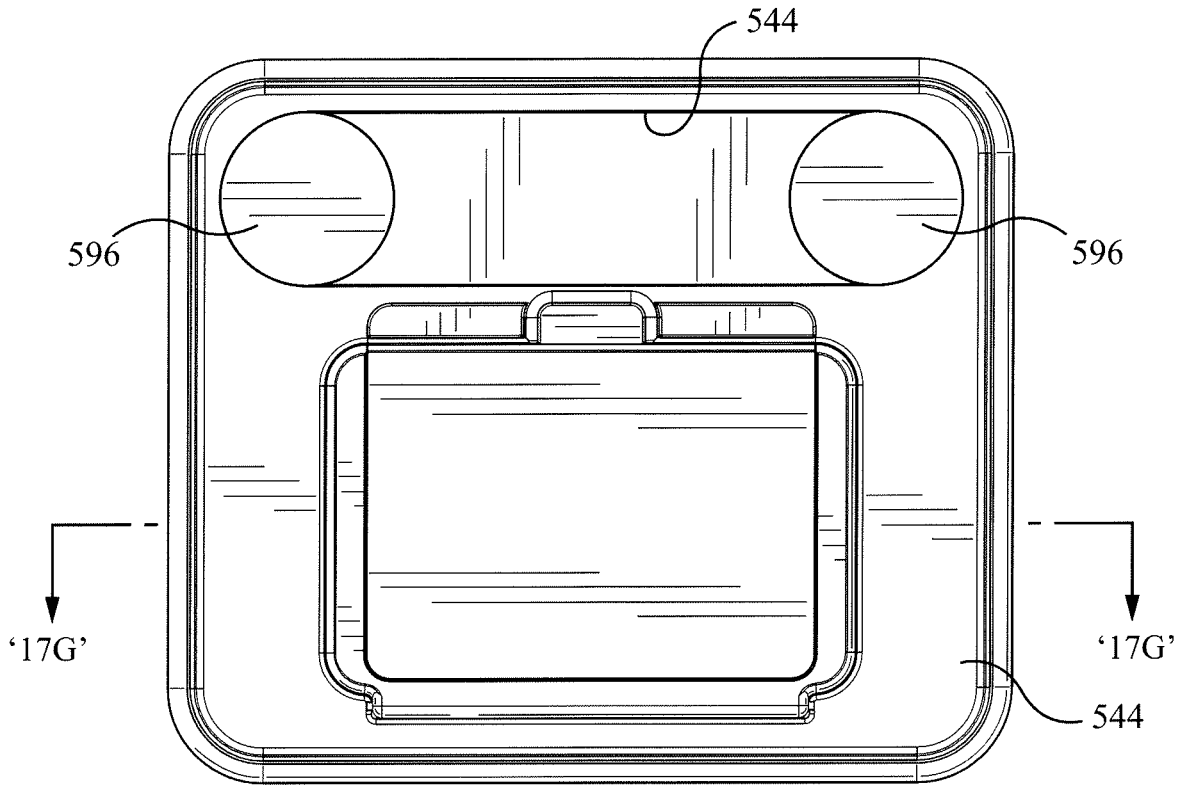
FIG. 17C is a top view of the lid assembly of FIG. 17A.
Figure 17D:
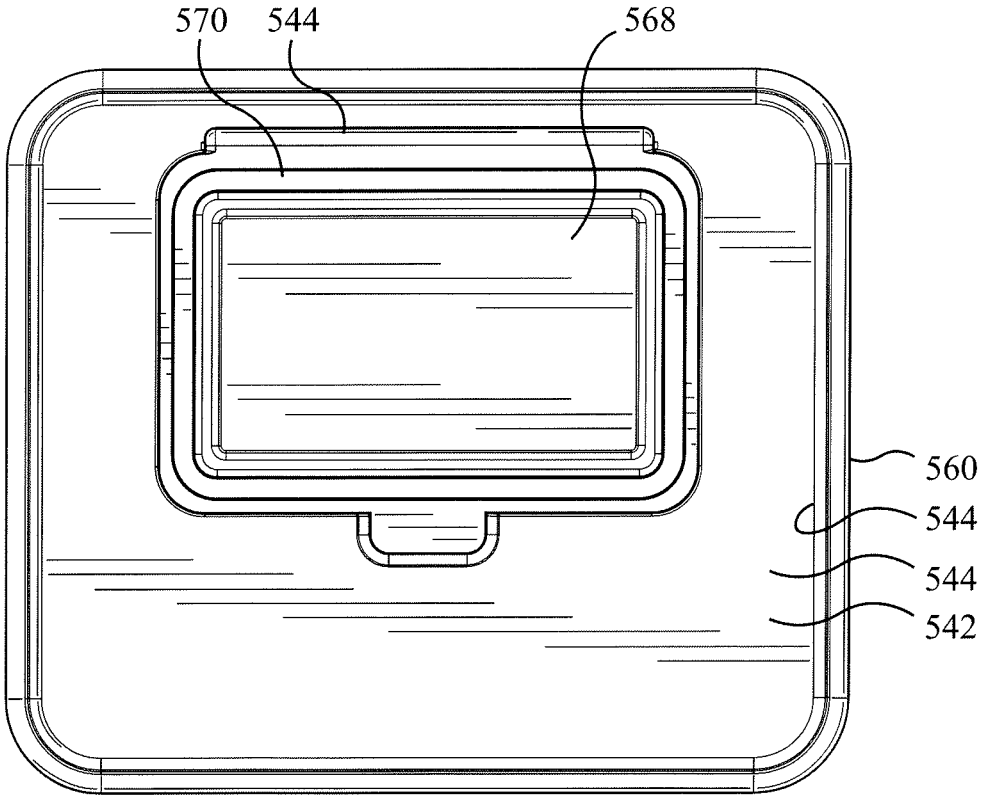
FIG. 17D is a bottom view of the lid assembly of FIG. 17A.
Figure 17E:
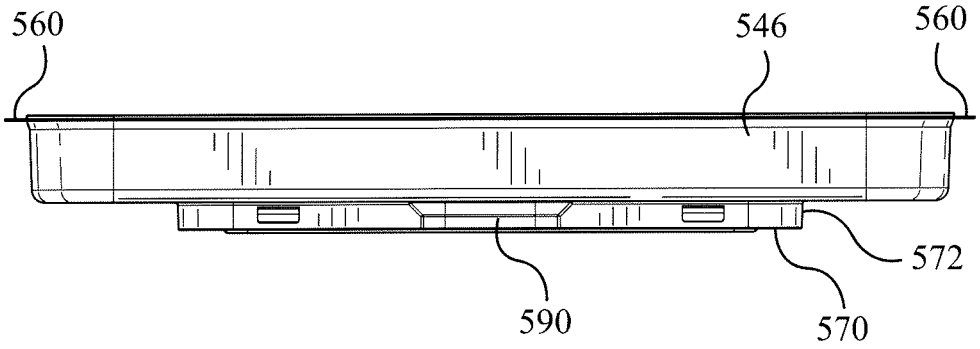
FIG. 17E is a front view of the lid assembly of FIG. 17A.
Figure 17F:
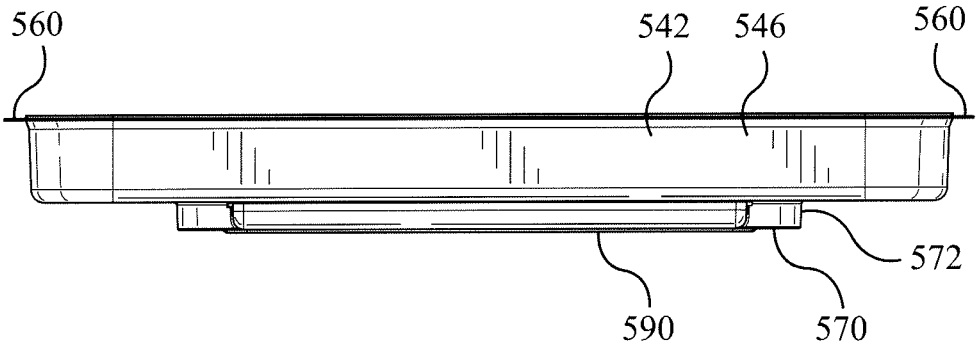
FIG. 17F is a rear view of the lid assembly of FIG. 17A.
Figure 17G:
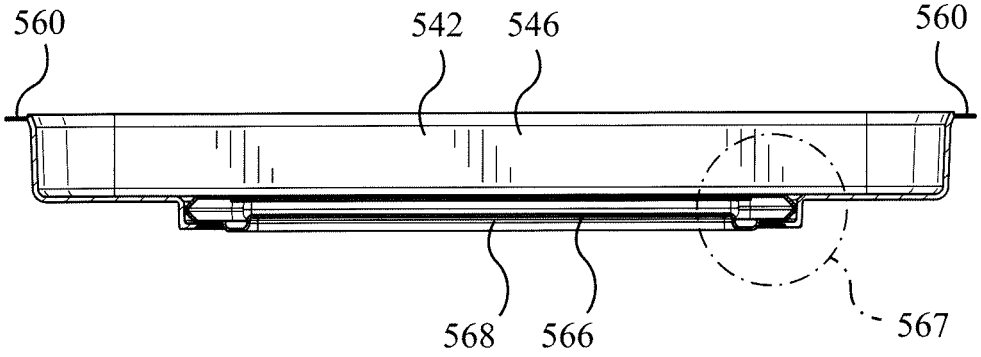
FIG. 17G is a view taken on section '17G-17G' of FIG. 17C.

Lid assembly 524 may also include, and in the illustrated embodiment of FIGS. 17A and 17B does include, a secondary access, or secondary closure to chamber 530. That is, while lid assembly can be opened, as by releasing zipper 558, and rotating lid assembly 524 about the hinge along its rear edge, lid assembly may, alternatively, remain in place, generally, and a second, or auxiliary, closure member 570 may be opened instead. To that end, main structural member 542 may have an aperture or opening 564 formed therein, and may have a second closure member, such as auxiliary closure, or door, 566 mounted to co-operate with opening 564. That is, door 566 is movable between a first position (i.e., closed) and a second position (i.e., open) to govern access to chamber 530 through opening 564. Door 566 may be hingedly mounted, such that it pivots along a hinge line axis in moving between the open and closed positions. The hinge line may be proximate to, or more proximate to than not, the rear margin of lid assembly 524, such that door 566 opens forward (i.e., when door 566 is open, access to chamber 530 is unobstructed along the forward edge. Alternatively, the hinge may be closest to one of the side edges, on a front-to-rear hinge line axis, so that door 566 opens cross-wise.

Opening 564 may be of any suitable shape, e.g., round, oval, elliptical, square, rectangular, etc. In the embodiment shown it is four sided and has the form of a rectangle. Whatever the shape of opening 564 may be, door 566 will have a complementary footprint that co-operates with opening 564. In this case, rectangular opening 564 has a pair of long sides and a pair of short sides. The long sides run cross-wise on the lid, the short sides run frontward-and-backward. One of the long sides is the hinge side of the door, and is located most closely proximate to the rear margin of main panel 544 and of main structural member 542 generally.

Opening 564 may have, and in the embodiment shown does have, a recessed peripheral member such as flange 570. Flange 570 is connected to main panel 544 by an upstanding peripheral web 572. Flange 570 and web 572 have long and short side portions corresponding to the respective long and short sides of the rectangular shape of opening 564. The combination of flange 570, web 572, and the influence of the adjacent portions of main panel 544 to which it is formed define a stiffened section, in this instance a Z-section that defines a peripheral bezel, or ring, or seat that has the stiffness or structural reinforcement of the Z-section, and hence a tendency to hold its shape and flatness as a rectangular frame, i.e., a door frame, for door 566 in the door frame section 567 of this embodiment shown in FIG. 17J. In this instance overall structure produced by the inward offset of flange 546 relative to main panel 544 generally, being equivalent to the height of web 572 between them, yields an alcove, or socket, or recess, or accommodation 580 corresponding to door 566. The upper or outward surface 574 of flange 570 defines a land or seat of a shape corresponding to the footprint of door 566, and the height of web 572 is such that, when closed, door 566 locates in accommodation 580, at least partially sunken relative to main panel 544. In the embodiment shown, door 566 is sunken to be flush, or substantially flush with panel 544, as seen in the enlarged detail of FIG. 17I thus yielding a continuous, or substantially continuous flat surface within the "dish" of main structural member 542.

As may be noted, door 566 may be made from, and in the embodiment illustrated is made from, a hollow molded plastic member having large flat main or central web portion 568. It may include a chamfered or chiseled edge or nosing 582 along the front and side edges, and a rounded barrel 584 and trunnions or axles, or a hinge pin 586 along the rear edge. On the inner or underside of door 566 there may be a peripheral bead 588 of greater depth, bead 588 being formed to locate within, and in facing opposition to, the inwardly facing edge of flange 570. In some embodiments, door 566 may have a peripheral seal mounted on the underside of nosing 582 for engagement with surface 574. The seal may be made of an elastomer.

Along the rearward edge of accommodation 580, main structural member 542 may have a moulded partial barrel or partial cylindrical section 592 that receives and co-operates with barrel 584 of door 566, and may be formed to have female fittings or sockets in which to receive the hinge pin, or trunnion fittings, of door 566. Along the forward edge of accommodation 580 there is a relief, or allowance, or cusp, or rebate, or cavity or recess 590, such as a finger recess, let into main structural member 542 to allow a user to insert a finger, or fingers, to grasp and lift the chiseled forward edge when opening door 566. Forward of door 566, main structural member 542 may have on its surface a raised boundary, or bead 594. Bead 594 may function as, and may define, a spill retainer, such as when drinks are placed on the large circular drink pads 596. Bead 594 may have a generally oval shape. The surface within bead 594, including pads 596, is an uninterrupted wipeable surface to facilitate cleaning.

Figure 17H:
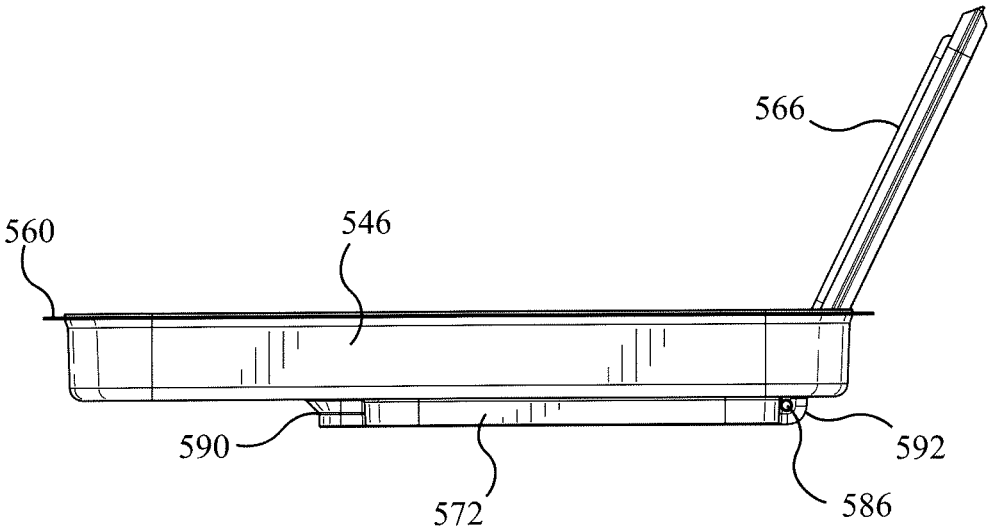
FIG. 17H is a left side view of the lid assembly of FIG. 17A with the inset door in the open position or configuration.
Figure 17I:
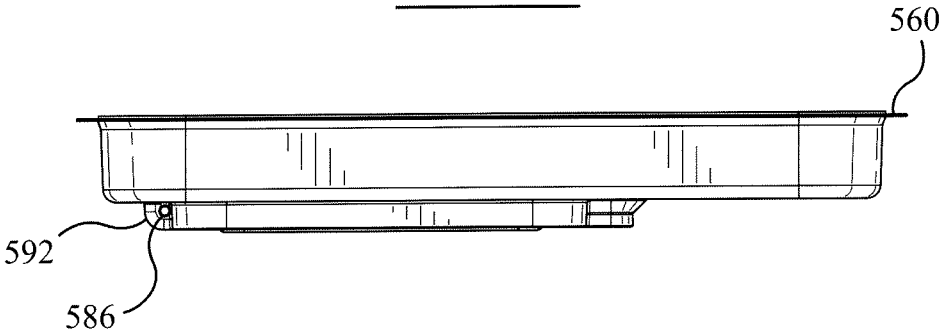
FIG. 17I is a right hand view of the lid assembly of FIG. 17A in the closed position or configuration.
Figure 17J:
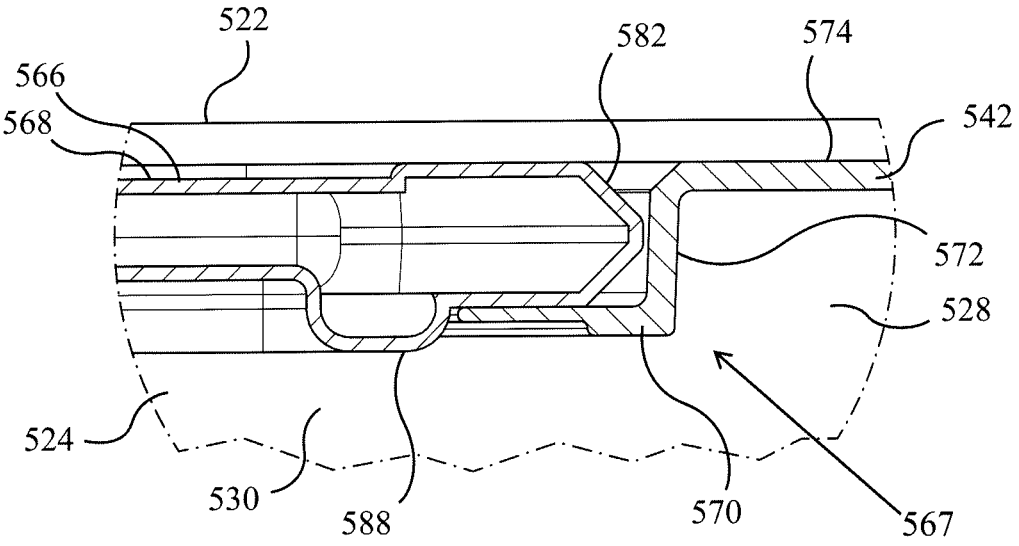
FIG. 17J is an enlarged detail of the section of FIG. 17G taken on arrow 567.

In this example, the upper surface 598 of main structural member 542 defines a work surface adjacent to the auxiliary opening. When door 566 is closed, it co-operates with that work surface, and can be thought of as an extension of the work surface. As can be seen in FIG. 17H, when door 566 is open, the combination of hinge offset from rear portion 550 of peripheral wall 546, and the height of peripheral wall 546 means that it functions as a stay or prop against which door 566 can rest in the open position. In this position door 566 is predominantly upright, and outwardly inclined. That is, in the embodiment shown, as measured from the hinge pin axis, the lateral run to the edge of the rim is less than the vertical rise.

In place of flat pads 596, main structural member 542 could alternatively have sunken drink pockets formed in the molded part, as described above. The use of flat pads 596 as in FIGS. 16C and 17C may tend to increase the expanse of the useful working surface, as when preparing a sandwich or cutting a lime or lemon, for example. The use of a "deep dish" format, where the depth of the peripheral wall is quite substantial—e.g., of the order of 2 cm-4 cm, (roughly ¾" to 1½") may tend to be more than ¼, or more than ⅓ of the diameter of a standard drink can (in North America, typically a soda or beer can is just under 5" high and about 2⅝ inches in diameter). Thus, even if a drink can falls over on its side, the contact height when it rolls against the sidewall rim may tend to be at a point where, for the can to fall off, the center of gravity of even a full can lies at less than twice the height of the rim. Expressed in a different way, the point of contact of a can (i.e., a round cylinder) rolling against the rim may tend to have a tangent plane along the line of contact that has a slope (i.e., rise over run) of greater than 1, such as may reduce the likelihood that it will roll off. The large, deep well means that spills are more likely to be caught, and, in travel, items can be carried in the well more easily without falling off, possible with the aid of a cover or elastomeric straps (e.g., "bungee cords). In effect, the entire lid becomes a large socket in which to retain objects. In that socket, the insulated fabric of the soft-sided walls of the insulated container, such as insulated strip of fabric 562 extend to a height that is greater than the height of the main web 544 or working surface 574 of main structural member 542. In that assembly, the outer peripheral flange 560 at the uppermost end of lid assembly 524 is located at a greater height than the spanning portion, i.e., main panel 544 that defines the work surface 574. That is, work surface 574 is sunken or recessed relative to the overall periphery of lid assembly 524 as at flange 560.

In summary, the insulated container assembly may have a hard fitting that has accommodations or pockets, or sockets, such as for beverages, or the hard fitting may have a flat working surface, or may define a tray or catchment with a raised peripheral wall. The lid may have a hard fitting with any of these. The container assembly may have a single hard fitting, such as may run along the forward or distal margin of the lid. Alternatively, the assembly may have both a hard fitting in the lid and a mid-height hard fitting in the forward secondary or auxiliary container structure mounted to the front face of the unit. One of the hard fittings may be a drink pocket fitting, with a single drink pocket or more than one drink pockets. Each of the embodiments may also have a rearward deployable table or work surface such as may be used by itself or in conjunction with a lid-top work surface or drink pockets.

The embodiments illustrated and described above illustrate individual non-limiting examples in which the principles of the present invention are employed. It is possible to make other embodiments that employ the principles of the invention and that fall within the following claims. To the extent that the features of those examples are not mutually exclusive of each other, the features of the various embodiments may be mixed-and-matched, i.e., combined, in such manner as may be appropriate, without having to resort to repetitive description of those features in respect of each possible combination or permutation. The invention is not limited to the specific examples or details which are given by way of illustration herein, but only by the claims, as mandated by law. The claims are to be given the benefit of purposive interpretation to include equivalents under the doctrine of equivalents.

Although the various embodiments have been illustrated and described herein, the principles of the present invention are not limited to these specific examples which are given by way of illustration.

We claim:

1. A soft-sided insulated container comprising:

a soft-sided insulated body defining an insulated chamber therewithin;

a lid, said lid being hingedly mounted to a rearward portion of the soft-sided insulated body, and being movable between open and closed positions to govern access to said insulated chamber;

said lid having a distal portion most distant from said rearward portion;

said lid having a rigid fitting;

said rigid fitting defines a work surface extending across said distal portion of said lid;

said rigid fitting including an inset opening;

said inset opening having an access door movable to give access to said chamber;

said rigid fitting having an upstanding retainer extending outwardly proud of said work surface, said upstanding retainer extending peripherally about at least a portion of said work surface.

2. The soft-sided insulated container of claim 1 wherein said rigid fitting defines a leading edge margin of said distal portion most distant from said rearward portion.

3. The soft-sided insulated container of claim 1 wherein said rigid fitting has a substantially planar web, said web has a socket formed therein, said socket defining a well, and said well of said socket protrudes inwardly shy of said web and said retainer stands outwardly proud of said web.

4. The soft-sided insulated container of claim 3 wherein said socket is a first said socket, said rigid fitting has a second said socket; and said rigid fitting includes a substantially planar medial web extending between said first and second sockets.

5. The soft-sided insulated container of claim 1 wherein:

said lid is releasably secured to said soft-sided insulated body by a first closure member, said first closure member being operable to permit said lid to move between an open position and a closed position.

6. The soft-sided insulated container of claim 1 wherein said inset opening is sunken relative to said work surface.

7. The soft-sided insulated container of claim 1 wherein said access door of said inset opening is one of (a) flush; and (b) shy, relative to said work surface when closed.

8. The soft-sided insulated container of claim 1 wherein said body is collapsible, and said proximal portion is foldable thereover when said body is collapsed.

9. The soft-sided insulated container of claim 8 wherein said rigid fitting has an upstanding peripheral wall, said upstanding peripheral wall has an outermost peripheral rim, and said work surface is sunken relative to said outermost peripheral rim.

10. The soft-sided insulated container of claim 1 wherein said inset opening access door opens toward said work surface.

11. A soft-sided insulated container, comprising:

a soft-sided insulated body defining an insulated chamber therewithin, and a lid assembly hingedly mounted thereto, said lid assembly being movable between an open position and a closed position relative to said chamber;

a securement by which releasably to retain said lid assembly in said closed position;

said lid assembly being hingedly connected to a rearward portion of said body;

said lid assembly includes a rigid member running along a margin thereof most distant from said rearward portion of said body;

said rigid member having at least one retainer defined therein, said retainer including a rigid well that protrudes inwardly relative to said chamber when said lid is closed, and a rim that stands outwardly of said lid assembly.

12. The soft-sided insulated container of claim 11 wherein said lid has an inset opening and an access panel mounted amidst said rigid member, said access panel being movable to open and close said inset opening.

13. The soft-sided insulated container of claim 12 wherein said inset access panel is a hingedly mounted access door, and said hingedly mounted access door is mounted in a recess in said work surface.

14. The soft-sided insulated container of claim 11 wherein said body is movable between a collapsed configuration and an expanded configuration.

15. The soft-sided insulated container of claim 11 wherein:

said lid assembly has a proximal portion closest to said rearward portion of said body;

said well of said rigid member includes a work surface;

said lid has an inset opening and an access panel mounted amidst said work surface of said rigid member, said access panel being movable to open and closed positions relative to said inset opening;

said inset access panel is a hingedly mounted access door, and said hingedly mounted access door is mounted in a recess in said work surface, said access door being one of (a) flush with and (b) shy of, said work surface;

said rigid member has an upstanding web that extends away from said work surface, and a peripheral outermost flange distant from said work surface, said outermost flange, said upstanding web and said work surface forming a Z-section;

said rigid member has a depression formed therein to define said recess in which to locate said access door;

said depression includes a web and a flange formed peripherally about inset opening, said web and flange formed about said inset opening co-operating with said working surface of said rigid member to define a reinforced structural section framing said inset opening; and said access panel being hingedly mounted, said access panel opening toward said work surface; and in an open position said rim of said rigid member supporting said access door in that open position.

16. The soft-sided insulated container of claim 11 wherein:

said lid assembly has a proximal portion closest to said rearward portion of said body;

said well of said rigid member includes a work surface;

said lid has an inset opening and access panel mounted amidst said work surface of said rigid member, said access panel being movable to open and closed positions relative to said inset opening;

said inset access panel is a hingedly mounted access door, and said hingedly mounted access door is mounted in a recess in said work surface, said access door being one of (a) flush with and (b) shy of, said work surface;

said rigid member has an upstanding web that extends away from said work surface, and a peripheral outermost flange distant from said work surface, said outermost flange, said upstanding web and said work surface forming a Z-section;

said rigid member has a depression formed therein to define said recess in which to locate said access door;

said depression includes a web and a flange formed peripherally about inset opening, said web and flange formed about said inset opening co-operating with said working surface of said rigid member to define a reinforced structural section framing said inset opening; and said access panel being hingedly mounted, said access panel opening toward said work surface; and in an open position said rim of said rigid member supporting said access door in that open position.

17. A soft-sided insulated container comprising:

a soft-sided insulated body defining an insulated chamber therewithin;

a lid, said lid having a proximal portion hingedly mounted to a rearward portion of the soft-sided insulated body;

said lid having a distal portion most distant from said rearward portion;

said distal portion having a rigid fitting extending therealong;

said rigid fitting occupying a majority of said lid;

said rigid fitting defining a wipeable work surface; and said rigid fitting including a peripheral retaining rim standing upwardly proud of said work surface.

18. The soft-sided insulated container of claim 17 wherein said rigid fitting includes a drink pocket amidst said work surface.

19. The soft-sided insulated container of claim 18 wherein said rigid fitting includes a portion that is co-planar with said lid, a first portion of said drink pocket extends proud of said lid; and a second portion of said drink pocket includes a well that extends shy of said lid.

20. The soft-sided insulated container of claim 17 wherein said lid assembly includes soft-sided insulated fabric and said rigid member mounted together, and said work surface is sunken relative to said soft-sided insulated fabric.

* * * * *